United States Patent [19]

Sapino et al.

[11] 4,152,981

[45] May 8, 1979

[54] DUAL PITCH IMPACT PRINTING MECHANISM AND METHOD

[75] Inventors: Anthony P. Sapino, Rochester; Donald S. Swatik, New Baltimore; Robert E. Costello, Utica; Vahe H. Malakian, Sterling Heights; Kenneth Staugaard, Rochester, all of Mich.

[73] Assignee: Computer Peripherals, Inc., Rochester, Mich.

[21] Appl. No.: 803,322

[22] Filed: Jun. 3, 1977

[51] Int. Cl.[2] ..... B41J 9/12

[52] U.S. Cl. ..... 101/93.01; 101/93.09; 101/93.14; 400/305

[58] Field of Search ..... 101/93.01, 426, 93.09, 101/93.13, 93.14, 109, 110, 111; 197/84 R, 84 A, 84 B; 400/303, 305, 306

[56] References Cited

U.S. PATENT DOCUMENTS

| | | | |
|---|---|---|---|
| 3,012,499 | 12/1961 | Amada | 101/93.14 X |
| 3,220,343 | 11/1965 | Wasserman | 101/93.09 |
| 3,461,796 | 8/1969 | Belson et al. | 101/93.09 X |
| 3,697,958 | 10/1972 | Loren | 101/93.14 X |
| 3,742,845 | 7/1973 | Giani | 101/93.14 X |
| 3,797,387 | 3/1974 | Decker et al. | 101/93.09 |
| 3,845,709 | 11/1974 | Gardiner | 101/93.14 |
| 3,880,075 | 4/1975 | Bovett et al. | 101/111 |
| 3,899,968 | 8/1975 | McDevitt | 101/111 |
| 4,009,654 | 3/1977 | Harris et al. | 101/93.14 X |
| 4,055,117 | 10/1977 | Munday | 101/111 X |

OTHER PUBLICATIONS

Mathers, "Point Element Pitch Selection," IBM Technical Disclosure Bulletin, vol. 19, No. 6, 11/76, p. 1959.

*Primary Examiner*—Edward M. Coven
*Attorney, Agent, or Firm*—G. J. Muckenthaler; W. Hawk, Jr.; J. T. Cavender

[57] ABSTRACT

An impact printer is provided which is capable of printing at either 10 characters per inch (standard pitch) or 15 characters per inch (compressed pitch) by changing the type character carrying member, such type carring member including multiple font character sets thereon. The type character carrying members or bands include timing marks thereon for detecting or sensing the type band (standard or compressed pitch), the type character font set, and for tracking the type characters on the band. The printer also includes time shared hammer means which are movable or shifted a precise distance of 1/10 inch for a standard pitch band or a precise distance of 1/15 inch for a compressed pitch band, such movement being operable by control mechanism responsive to pulses derived from the timing marks relative to the horizontal position mechanism and the type band on the printer (standard or compressed pitch).

50 Claims, 51 Drawing Figures

TO HAMMER DRIVERS
- SR CLR
- SR → HD
- HEP 1
- HEP 2
- SR STEP
+ COMPARE
- HMR DR CLK
- VERTICAL ADVANCE (TO PAPER ADVANCE SERVO CONTROL)
601
615
683
681
527
457
CLOCK 2
Φ1 CLOCK
Φ2 CLOCK
183
HAMMER ENABLE PULSE (HEP - X)
184
CLOCK GENERATOR
185
VERTICAL PAPER ADVANCE LOGIC
563
- VERT STB
FORMAT DATA
+ COMP PITCH
+ STD PITCH
HPC 2⁰ - 2¹
- SR STEP
181
COMPARE

+5
+5
220
CHARACTER LATCH
222
Q3
212
+5
150
CHAR PULSE
224
-CHAR FF PULSE
218
Q2
214
Q1
216

+5
+5
230
Q4
238
HOME LATCH
240
+5
148
HOME PULSE
236
234
Q6
Q5
232
HOME TRIG PULSE
243
244
250
HOME TRIG O/S
COMP PITCH DELAY O/S
COMP PITCH O/S
COMP PITCH LATCH
254
+5
242
252
+STD PITCH
TO CONT LOGIC
248
246
255
-POWER ON MAST CLR
258
-GATE OPEN
256
-BAND UP TO SPEED 381
382
- HOR STB LT
FROM HOR SERVO LOGIC
386
390
HOR ADV RESET ENABLE FF
380
S
J
CLK
K
R
Q
Q̄
383
384
- HOR STB RT
FROM HOR SERVO LOGIC
388
559
392
400
- HOR MOTION ENABLE
HOR ADV FF
402
255
+ STD PITCH
- INHIBIT
- PWR ON MAST CLR
- HOR ADV
TO HOR SERVO LOGIC
403
394
HOR POS CNTR
COUNT UP
COUNT DOWN
R
Q3
Q2
Q1
Q0
399
+ HPC 2'
+ HPC 2°
396
- BAND UP TO SPEED
410
411
398
- HOR DIR RT
413
412
404
406
408
- PRT I
549
RIGHT/LEFT DIR FF
+5

| FONT LENGTH | COUNTER PRESET |
|---|---|
| 48 | 207 |
| 64 | 191 |
| 96 | 159 |
| 128 | 127 |

485
+ INP OPT CNTR MAX
496
498
PRT LOAD OPT CNTR
492
OPTION FF
494
OPT FF
495
+ SSR = 4
611
+ TSSP 5
589
J
CK
K
R
Q
Q̄
+ Φ 2 CLOCK
- MASTER CLEAR
487
+ OUT OPT CNTR MAX
491
- PRT LD OPT CNTR
471
+ OC 2'
502
473
+ OC 2°
506
508
685
+ COMP PITCH
- BCG CLK
509
504
+ Φ 1 CLOCK
+5
510
512
- SR STEP TO HMR DR
HPC 2'
399
527
526
HPC 2°
411
SHIFT REG STEP CNTR
514
D
C
B
A
$Q_D$
490
$D_C$
516
520
$Q_B$
- Φ 1 CLK
CLK
LD
P
T
CLR
$Q_A$
518
522
524
685
+ COMP PITCH
+ STD PITCH
255

-TSSP 2
SUBSCAN TIMING GENERATOR
+TSS P1
-Φ1 CLK
CLK
QA
592
594
593
+TSSP 2
QB
+PU
R
QC
+TSSP 3
595
596
QD
+TSSP 4
-TSSP 4
597
+TSSP 5
589
QE
+TSSP 6
A
QF
588
QG
+TSSP 7
598
602
+SSP FF
B
QH
+TSSP 8
Φ2 CLK
600
601
-SR CLR
TO HMR DR
-TSSP 8
+HP FF
587
-HP FF
583
+5
SUBSCAN REGISTER
612
613
-HP FF
-[HP FF • SSR = 4]
604
CK
R
614
615
+[SR → HD]
4
4D 4Q
1
TO HMR DR
590
+SSR = 1
591
1
1D 1Q
2
606
605
+SSR = 2
2
2D 2Q
3
609
608
+SSR = 3
3
3D 3Q̄
4
611
3Q
+SSR = 4
610
551
+PRT 2
571
-[SC = 255]

CMP TO NEXT HMR DRIVER
HMR DR LSI CHIP
DARLINGTON DRIVER
COIL
683
- HEP 1
- HEP 2
681
615
- SR → HD
- HD CLK
SHIFT REGISTER
710
FROM HAMMER DRIVER 2 (FIG. 4B)
+ CMP
- SR STEP
- SR CLR
527
601
712
714
716
718
720
722
724
726
728
730
732
734
736
738
740
742
744
746
748
750
1 5 9 13
2 6 10 14
3 7 11 15
4 8 12 16
17 21 25 29
18 22 26 30
19 23 27 31
20 24 28 32
33 NC NC NC
34 NC NC NC

DUAL PITCH IMPACT PRINTING MECHANISM AND METHOD

BACKGROUND OF THE INVENTION

In higher speed line printing, it has been found that the band or belt type printer has certain advantages over the drum type printer. The band is caused to be driven in continuous manner along a line of printing wherein a plurality of hammers are aligned to be selectively driven into impact with record media and an associated ribbon against type characters on the print band. Since it is desired to control the speed of the print band within close tolerances so as to permit driving of the hammers into proper registration with the characters on the print band, the band speed is an important aspect of the printer. The prior art has utilized timing marks on the band, and timing pulses derived from such marks on the print band have served to control the speed of the band by means of servo motor control. Synchronous A.C. motors have also been used to drive the type bands.

Additionally, it is well known that a type or character band includes a plurality of font sets wherein each character of every font set is continuously scanned by the control apparatus so as to fire the selected hammers at the precise time that the characters pass the various print positions. The band may include marks thereon which correspond to the characters and may also include marks to indicate the various font sets with sensing or detecting means being provided to send pulses to the control mechanism at precise times for firing the hammers.

Another feature of a band printer includes the providing of hammers wherein a separate hammer is provided for each print position with a hammer driver for each hammer. Other band printers have utilized timeshared hammer techniques wherein the hammers are of multiwidth and span more than one print column position, or single width hammers which are movable to more than one print position and are arranged in a bank with such bank being movable or displaced along a line of printing.

The print band usually has the characters etched, engraved, embossed or otherwise found on or attached to the surface of the band with the timing marks also being attached on or embedded in the band. Such timing marks are utilized in the control circuitry of printing control means wherein storage means, tracking means and timing comparison means operate with the input data to fire the hammers at the precise times to print the desired data on the record media.

A common printing format includes spacing of the imprinted characters at 1/10 inch for printing all the characters in a line of print. Since the characters in a line of print are aligned with the print hammers for a short period of time, it should be realized that the print hammers must be fired at the exact instant the proper characters appear at the print positions.

Representative prior art in the area of band printers include U.S. Pat. No. 2,993,437, issued July 25, 1961, to F. M. Demer et al., which discloses high speed printer apparatus operable on a subcycle basis by spacing characters on the type chain so that only certain separate print positions along the print line will have characters aligned therewith at any one time. Intermediate print positions will subsequently have other characters aligned therewith and printing at such print positions cannot occur until subsequent subcycles occur. The number of subcycles necessary for aligning the different character fonts with every print position depends on the spacing ratio between the characters and the adjacent print positions. The characters are placed so that three characters span four print positions or every other character is aligned at every third hammer position to give a typed spacing of $1\frac{1}{2}$ pitch. Sequences of subcycles are repeated until one set of characters has been aligned with every print station.

U.S. Pat. No. 3,012,499 issued Dec. 12, 1961, to S. Amada, discloses a high speed printing system for increasing the number of words or letters printed in a line to increase the quality of words or letters recorded in a unit of type. The type characters are arranged in a plurality of rows on the type belt and the type hammers are arranged with certain offset rows and with selected hammers being shifted for operation at other rows.

U.S. Pat. No. 3,697,958 issued Oct. 10, 1972, to J. J. Larew, discloses a font selecting system including a method for shifting from a first to a second font of printing data responsive to remote signals. The apparatus is operative to selectively print characters from one of a plurality of fonts in response to signals identifying the font and the characters and includes means for storing the character data, font selection means responsive to the font selection signals to modify the stored data, means for generating data representative of characters and their positions and means for comparing the stored data with the generated data to control printing of the desired characters.

U.S. Pat. No. 3,699,884 issued Oct. 24, 1972, to L. W. Marsh, Jr. et al. discloses control for a chain printer including character generation accomplished where type spacing is greater than print position spacing by tracking the scan of the memory with a single tracking or address counter and using the output thereof to control the character generation and comparison functions. The phase counter arrests the advance of the character generator when predetermined counts are exhibited by the tracking counter and maintain the character generation sequence. Generation of beginning of the font or index synchronizing pulses regardless of the length of the font is accomplished by deriving a sequence of pulses from a code disc and using the moving type character carrier to gate the proper pulse to control circuits in accordance with the length of the font on the carrier.

U.S. Pat. No. 3,795,186 issued Mar. 5, 1974, to R. H. Curtiss et al. discloses a high speed printer wherein the type carrier includes a number of type fonts thereon and co-acts with a number of sets of hammers, one hammer for each character position in a line and a hammer driver for each set of hammers, the hammers being time shared among those of a set. The characters from the type carrier are spaced from one another at a distance greater than the spacing between character positions on the print medium.

And, U.S. Pat. No. 3,952,648 issued Apr. 27, 1976, to J. Sery et al. discloses a character printing device wherein the spacing between characters on the belt is greater than the spacing between hammers so that during one cycle in which all characters of a set have passed a given hammer, there are a number of scan cycles in which a number of different hammers, that is, one from each set, are aligned with characters a given number of successive subscan times where the number of scan cycles is equal to the number of characters in a set. The designation of a particular scan cycle for any given hammer defines the character which will be struck by that hammer during that subscan. The printing system detects the identities that can appear between the data originating from a unit to detect coincidence of characters and striking units and from a memory to record data concerning the characters to be printed and their positions and then control the striking units. The system also includes a reference memory containing data relating to the coincidences of characters and striking units for one of a series of characters, the coincidences appearing in the course of an initial scan period representing the time interval separating two successive coincidences of characters with a single striking unit.

SUMMARY OF THE INVENTION

The present invention relates to impact printers and more particularly to an impact printer which is capable of printing at 10 characters per inch or 15 characters per inch by merely changing the type character carrying member. The printer includes an endless band which is carried on a pair of pulleys and is caused to be driven in continuous manner along a line of printing and adjacent a plurality of time-shared hammers of the impact type which impact with paper or like record media and an ink ribbon traveling in a path between the face of the hammers and the type characters on the band. One band utilized on the printer is referred to as a standard pitch band and a second band is referred to as a compressed pitch band for purposes of dual-pitch character printing at 1/10 inch character spacing or at 1/15 inch character spacing. Each type band may be utilized for printing on the same machine with all of the bands being of the same length and having 384 characters on the periphery thereof with different character formats or font sets making up the total number of characters. For example, the band may carry either eight sets of 48 characters, six sets of 64 characters, four sets of 96 characters or three sets of 128 characters. The characters are etched or embossed on the band so as to present a raised type surface and are spaced on center lines of 4/30 inch.

There are two sets of markings on each band, a first set of marks or lines corresponding to each type character wherein each character has a raised mark or line adjacent thereto and associated therewith, for the purpose of providing to the printer controls an indication of the position of the band and each character thereon. The first set of marks on the band will hereafter be referred to as character marks and which, when sensed or detected by sensing or detecting means, will provide character pulses operable with control means. The character pulses are also utilized to provide feedback pulses for speed control of the band.

A second set of marks or lines is provided on the band at the start of each character set or font set to provide a home pulse to the control means on the printer controller. Such home pulses are utilized as boundary or starting means wherein the number of character pulses are counted to automatically determine the size of the character or font set on the band, i.e. 48, 64, 96, or 128 characters. Additionally, each home pulse provides a relationship of a specific character on the band to a first printable position or location on the paper or like record media, such relationship being utilized to track each type character on the band. An additional raised mark or line is provided adjacent the home mark for each character set or font set, such additional home mark indicating to the printer controls that a particular band (compressed pitch) is installed on the machine.

The print hammers and the drivers therefor are time shared wherein each hammer is displaced or moved a precise distance to cover at least two printable locations or positions on the record media for standard pitch printing and at least three printable positions for compressed pitch printing. Another way of stating the time sharing principle is that a one-to-one relationship between the number of imprinted columns on the paper and the hammers does not exist. The faces of the hammers are carried by a hammer bar assembly which is moved in precise increments of 1/30 inch in relation to the paper by horizontal advancement means.

Depending upon which type of character band (standard or compressed pitch) is installed on the printer, the hammer bank is displaced either 1/10 inch or 1/15 inch, the former being the amount of displacement for a standard pitch band wherein printing is spaced on 1/10 inch centers and the latter being the amount of displacement for a compressed pitch band wherein printing is spaced on 1/15 inch centers. Movement or displacement of the hammer bar assembly is sensed by means of a light source, a sensor and a grid arrangement wherein a sine wave or flat-topped sine wave signal, hereafter referred to as sine wave, is generatrd at precise intervals of 1/30 inch. During standard pitch operation, every third pulse signifies one complete horizontal shift of the hammer bar assembly while every second pulse signifies a complete shift of the hammer bar assembly during compressed pitch operation.

The printer accepts and stores a data line of 136 data characters plus a control code for the standard pitch mode or 204 data characters plus a control code for the compressed pitch mode. During data transfer, each data character is placed on data lines and is then stored in memory. When the printer detects a control code on the data lines, the data transfer is terminated, the control code is stored in a format register and option cycles are initiated.

During an option cycle, the memory is sequentially addressed and the contents of the memory are compared with the band codes which align with the printable position or column on the record media for a particular period of time. Such time is referred to as a scan and is defined as the time required to move or advance two adjacent characters on the band past print position or column one on the record media. Compares or no compares (the lack of compares) are transmitted or sent to a hammer driver shift register, with only such compares or lack of compares corresponding to the presence of hammers in the particular print positions being clocked into the hammer driver shift register. After completion of each option cycle, a print cycle is initiated if all other prerequisites are met, these including the timing cycle, hammer motion settle, and record media motion completion.

At the initiation of a print cycle, the contents of the hammer driver shift register are transferred to the hammer driver. If a comparison exists between the contents of the memory and the pulses from the band code, the particular hammers are fired at precise times within the scan period, while another option cycle is being performed or processed. The precise times at which the hammers are mated with or in front of printable type characters on the band in the particular print column positions are defined as subscans. The performing or processing of the option cycles continues until all characters which are printable in one position of the hammer bar assembly are stored in the hammer drivers and such drivers are fired. At the completion of all option cycles necessary to print all characters for a given hammer bar location, a horizontal shift command is given and the hammer bar assembly is moved or advanced to a new position, at which position printing of the next segment of the data line occurs. The firing of the hammers and horizontal movement of the hammer bar assembly is repeated until all segments of the data line are printed at which time the print cycle is terminated. The record media is then vertically advanced and a new line is printed.

In accordance with the above discussion, the principal object of the present invention is to provide a printer capable of printing at either 10 characters per inch or 15 characters per inch as determined by the type character carrying member placed on the printer.

An additional object of the present invention is to provide a printer capable of dual pitch printing and includes controls responsive to the format of the type character carrier on the printer.

Another object of the present invention is to provide a printer having time-sharing print hammers operable with associated controls responsive to the type carrying member on the printer.

A further object of the present invention is to provide a printer having a scan and subscan scheme operable with controls responsive to the type carrying member for different pitches of the imprinted characters thereon.

Still an additional object of the present invention is to provide a printer having means for sensing the presence of different type character carrying members on the printer and including controls responsive to the sensed character carrying members for printing at one or another character pitch dependent upon the type character carrying member on the printer.

Still another object of the present invention is to provide control means and print hammer drivers for a family of printers utilizing type character carrying members of different character pitch.

Still a further object of the present invention is to provide a printer utilizing type character carrying members of the same length for a plurality of different character pitches.

And, still an additional object of the present invention is to provide a printer utilizing type character carrying members having timing marks thereon and controls associated therewith for printing at different pitches dependent upon the character carrying member on the printer.

Additional advantages and features of the present invention will become apparent and fully understood from a reading of the following description taken with the annexed drawings.

DESCRIPTION OF THE PREFERRED EMBODIMENT

Figure 1:
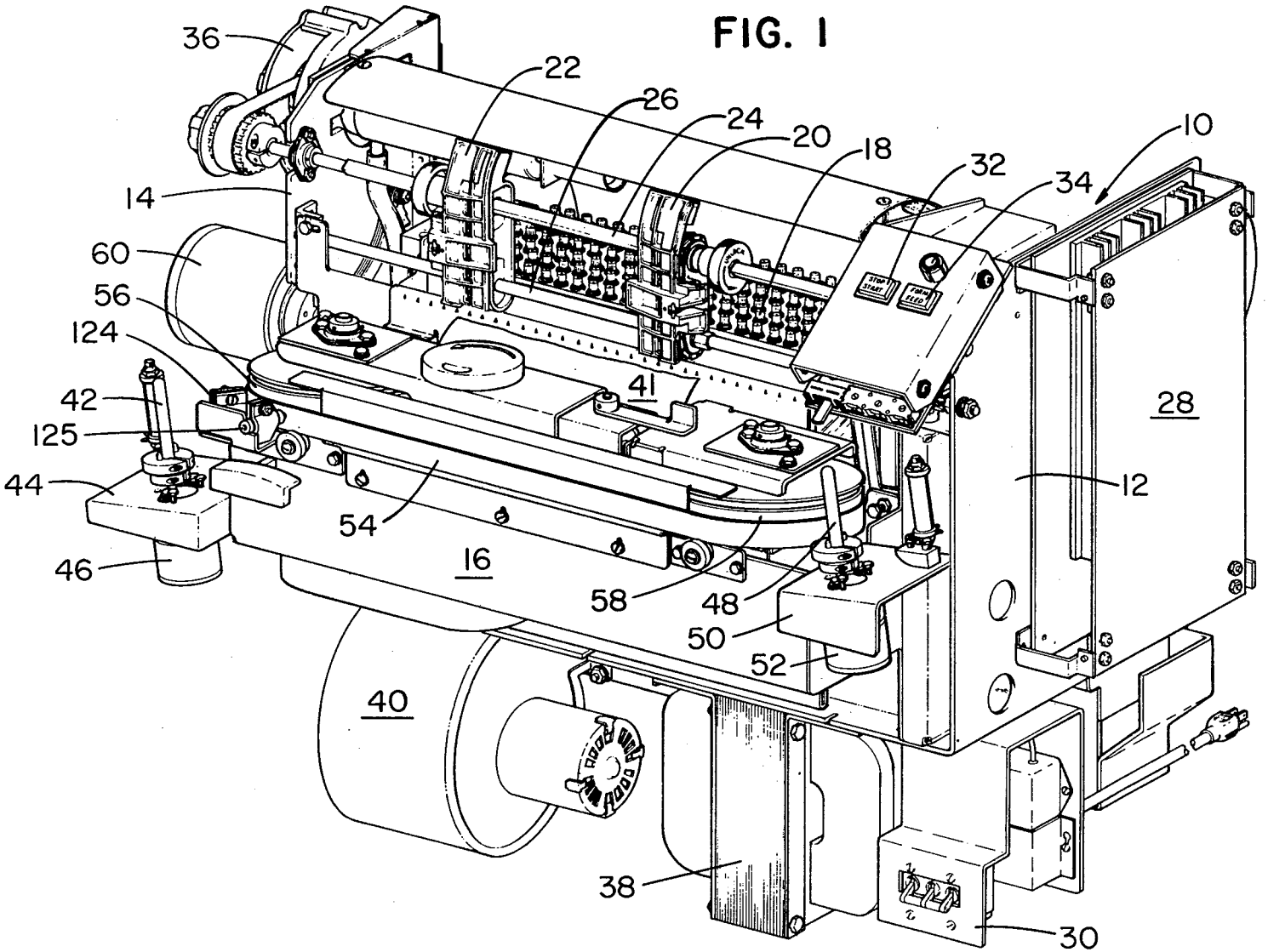
FIG. 1 is a perspective view of a portion of a printer incorporating the subject matter of the present invention.

As seen in FIG. 1, a printer 10 incorporating the subject matter of the present invention utilizes a band for carrying the type characters thereon, such band printer distinguishing from a drum printer in a number of areas and features, the most significant area being the type carrying structure. The printer 10, of course, includes the framework of vertical side plates 12 and 14 which support the print band gate structure 16, the hammer bank 18, the paper forms tractors 20 and 22 carried on shafts 24 and 26, the power supply and servo drive 28 and other major parts which will be explained in further detail hereinafter. An On/Off switch 30 is located at the lower right front of the printer, a Start/-Stop switch 32 and a forms feed switch 34 are positioned on the top right front of the printer, and forms handling mechanism 36 is located on the left side of the printer. A transformer 38 and a blower unit 40 are disposed under the gate structure 16, the blower unit providing cooling to the various areas and parts of the printer.

Form paper or like record media 41 is caused to be driven or pulled by the tractors 20, 22 from a forms stack below the gate structure 16, upwardly past the printing station between a type band 54 and the hammer bank 18, and out an exit slot at the rear of the printer. A ribbon, although not shown in FIG. 1, is caused to be driven from a ribbon spool rotatable on the spindle 42 which is supported on a frame member 44 and driven by a motor 46 located at the left side of the gate structure 16, the ribbon being guided in a path rearward of the gate structure and onto a ribbon spool rotatable on a further spindle 48 which is supported on a frame member 50 and driven by a motor 52 at the right side of the gate structure.

The print or type band 54 is caused to be driven in a counter-clockwise direction by the drive pulley 56, at the left side of the gate structure 16, and around a driven or idler pulley 58 located at the right side of the structure 16, the band 54 being directed in a path adjacent the platen (not shown in FIG. 1) and past a print station and positioned to be impacted by print hammers aligned in a horizontal manner forward of the hammer bank 18. A hammer bank drive motor 60 is provided for driving or moving the hammer bank or hammer bar in a horizontal direction for purposes which will be later fully described.

For purposes of information, the print band support mechanism, the forms handling control mechanism, the tracking mechanism for the inking ribbon, the paper forms clamping mechanism and the print band guide include structures which are the subject matter of copending applications assigned to the same assignee as the present application.

Figure 2:
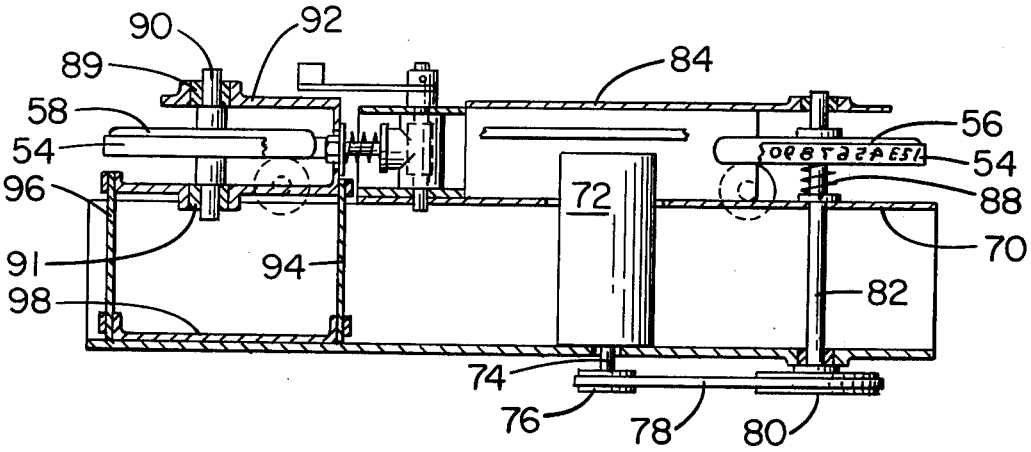
FIG. 2 is an elevational view of the print band gate structure with portions removed therefrom and showing the print band drive mechanism.

In FIG. 2 is shown an elevational view of the gate structure 16, partly in cross section to better show the various parts, such structure including an enclosed framework 70 supporting a motor 72 having a drive shaft 74 for rotating a pulley 76 about which a belt 78 is trained for driving a pulley 80 on a shaft 82 supported from and journaled in suitable bearings in the framework 70 and in an upper frame member 84 and causing rotation of the drive pulley 56 about which the print band 54 is trained. Such print band 54 is of the endless belt type and, as mentioned above, follows a path adjacent the platen and past the print station where the print hammers impact against type characters on the band. The drive pulley 56 is fixed in location, but the ribbon driven or idler pulley 58 is supported in a manner to be movable in a direction toward and away from the drive pulley 56 as explained hereinafter. As illustrated in FIG. 2, pulley 56 is supported on a light spring 88 so as to assume a floating position axially with respect to the shaft 82, such pulley being also crowned to provide proper tracking of the band in relation to the supports and guiding devices therefor.

The idler pulley 58 is carried on a shaft 90 which is journaled in suitable bearings 89 and 91 in a U-shaped frame member or cradle 92 which is secured to a pair of spring-like or flexible leaf spring supporting members 94 and 96 which extend upwardly from a lower portion of the gate structure framework 70, such upwardly extending supporting members 94 and 96 being joined by suitable means to a base member 98 secured to such lower portion of the structure 70 and the upper ends of the members 94 and 96 being secured to opposite ends of the cradle 92. Such spring-like members 94 and 96 are spaced from each other and provide the sole support for the cradle 92 and hence the idler pulley 58, and allow the cradle 92 to move in a direction toward and away from the drive pulley 56. The U shaped member or cradle 92 is open at one side thereof to permit loading and unloading of the print band 54. The leaf springs 94 and 96 provide the first portion of structure which permits or enables the idler pulley 58 to move toward and from the drive pulley 56. The axis of the idler pulley shaft 90 remains parallel to its original position while being subjected to horizontal motion or displaced from such original position. The small vertical displacement of the cradle 92 resulting from the horizontal motion has no vertical effect on the pulley system since the pulley 56 is, in effect, floating and is dependent on certain guide means for retaining the band 54 in a vertical position during its travel past the print hammers. In this manner, the idler pulley 58 remains aligned with the drive pulley 56.

Figure 3:
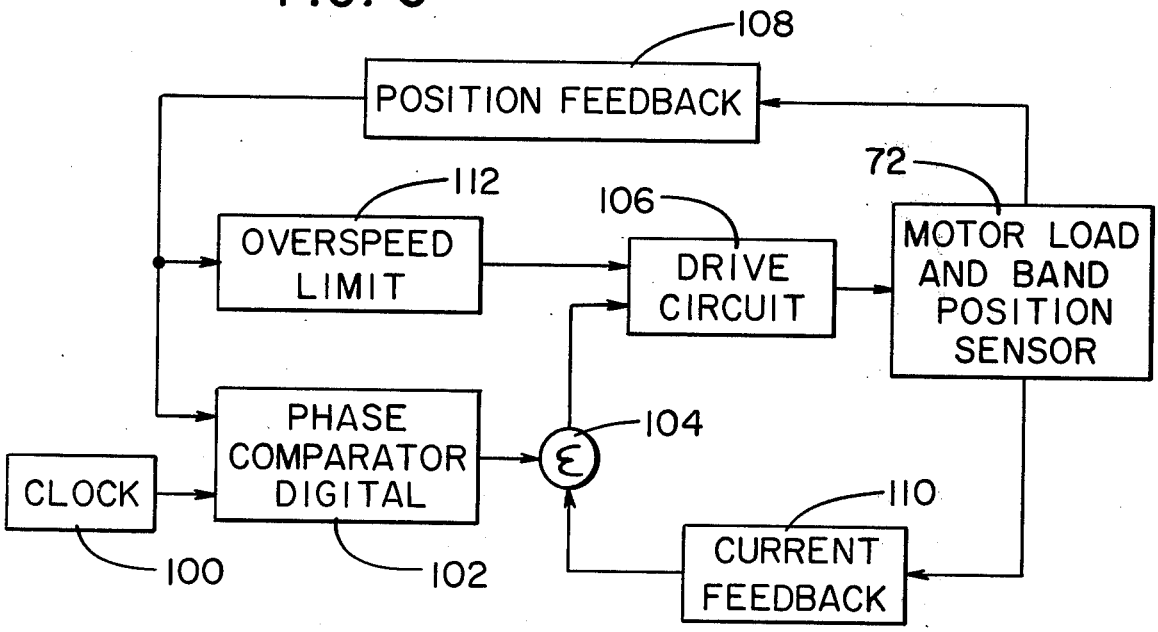
FIG. 3 is a block diagram of essential components of the print band driver control system.

FIG. 3 shows a simplified block diagram of the major components of the band speed control system wherein a clock 100 provides pulses to a phase comparator 102, the output of which is connected to a summation device 104. The output of device 104 is connected to a drive circuit 106, in turn connected to the motor 72 and associated apparatus. Outputs from the motor 72 and associated apparatus include position feedback circuitry 108 and current feedback circuitry 110, the latter being input to the summation device 104. The position feedback circuitry provides an input to an overspeed limiting device 112 and an input to the phase comparator 102.

In general and broad terms, the clock 100 produces a square wave signal with a fixed frequency which is compared with the position feedback signal at the phase comparator 102, the phase difference between the two signals being a determination of the conduction time, the time that current flows through the motor 72. Consequently, when the motor 72 starts from the rest position, the frequencies of the clock signal or pulse and of the position feedback signals are different and the conduction time varies, such time having an average of a half period. This conduction time provides sufficient current to flow to the motor 72 for acceleration thereof to the desired speed or to a speed above such desired speed.

The overspeed limiting device 112 is designed to protect against overspeeding, such device comparing the period of the position feedback signal to a signal of predetermined fixed duration which corresponds to the speed limiting frequency, such limiting frequency being slightly above the clock frequency. As long as the speed of the motor 72 is below the limit or the desired speed, the overspeed limiting circuit is not effective however, if the speed of the motor is above the permitted limit, the current to the motor is turned off for one period of position feedback thus allowing the motor to decelerate to a speed below the desired limit. It is seen that by limiting the motor speed from above, and by providing acceleration when the speed is too low, it is possible to maintain the band 54 in continuous rotation at a velocity within a desirable range.

In the development of the standard/compressed pitch system, both the centerline distances of the type characters on the band and the centerline distances of the imprinted characters on the paper or record media are used to define a scan and subscan scheme in tracking of the band and in the printing operation. The basic formula is given as:

$$\frac{P_C}{P_I} = \frac{X}{Y} \qquad \text{Equation 1}$$

where $P_C$ is the distance between the center lines of adjacent type characters on the band 54, $P_I$ is the distance between imprinted character center lines on the paper or like record media 41 assuming all characters on a line are printed.

In the formula, X is referred to as a subscan scheme, a subscan being defined as the number of distinct groups of imprinted column positions which are aligned with the characters on the band during specific intervals within a scan, and a scan being defined as the time period required for two successive characters on the type character carrying member, or the band 54 in the instant application, to pass the print column number one position. Each of the print bands 54 contains 384 type characters wherein the distance between center lines of the type characters on the band is 4/30 inch for both standard and compressed pitch bands, it being noted that the width of the characters on the compressed pitch band is not as wide as the characters on the standard pitch band. The X to Y relationship in the above formula determines the numerical weights required to track the character positions on the band in relationship to the print column positions, and hence the print line buffer or memory system. For a standard pitch machine, i.e. a machine which has a standard pitch character band installed thereon, $P_I$ is 1/10 inch (0.10) and as stated above, $P_C$ is 4/30 inch. The present invention covers two different imprinted character pitches, one at 1/10 inch and the other at 1/15 inch—one for the standard pitch band and one for the compressed pitch band, respectively.

In further developing the present dual pitch system and using the subscript letter S to denote standard pitch and the subscript letter C to denote compressed pitch, and by including the subscript letters in Equation 1, it is seen that $$\frac{P_{cs}}{P_{is}} = \frac{X_s}{Y_s} \qquad \text{Equation 2}$$

and $$\frac{P_{cc}}{P_{ic}} = \frac{X_c}{Y_c} \qquad \text{Equation 3}$$

where $P_{is}$ is 1/10 inch for standard pitch and $P_{ic}$ is 1/15 inch for compressed pitch Other design criteria include the use of type character bands of the same length and the same number of characters on each band for both the standard and compressed pitch bands. Therefore the distance between centerlines of successive characters is identical for both type bands. It is thus seen that $$P_{cc} = P_{cs} = P_c$$

Equation 4 and substitution of Equation 4 into Equation 2 results in $$\frac{P_c}{P_{is}} = \frac{X_s}{Y_s} \qquad \text{Equation 5}$$

and $$\frac{P_c}{P_{ic}} = \frac{X_c}{Y_c} \qquad \text{Equation 6}$$

As stated above, the centerline distance between successive characters on both the standard and the compressed pitch bands is identical and $$P_c = 4/30 \text{ inch}$$

Equation 7

Since $P_{is}$ and $P_{ic}$ were previously stated to be 1/10 inch and 1/15 inch, respectively, the ratios in equations 5 and 6 can be solved as $$\frac{X_s}{Y_s} = 4/3 \qquad \text{Equation 8}$$

and $$\frac{X_c}{Y_c} = 2/1 \qquad \text{Equation 9}$$

As will be readily seen, every fourth print position is aligned with every third character on the band for the standard pitch band and every second print position is aligned with every character on the band for compressed pitch. As mentioned above, the value of X is frequently referred to as the subscan scheme of the printer and it is seen that the subscan scheme is 4 and 2, respectively, for the standard pitch and the compressed pitch machines. The ratios of 4/3 and 2/1 are important in the development of the printer control system wherein the band character to print column relationship is shown in the proportions for equations 8 and 9 in tables following this discussion.

There are two interesting things to note from the above formulas, one being that the standard pitch equals 4 subscans and the compressed pitch equals 2 subscans so that a compressed pitch subscan scheme equals ½ the standard pitch subscan scheme and the difference between X and Y equals 1 for either machine. This relationship and difference allows for easy implementation of the band tracking scheme as seen in the following table which refers to a standard pitch mahine and wherein the table follows Equation 8 as $(X_s/Y_s)=4/3$.

It is thus seen that each successive scan results in the next character on the band being in front of print column one. There are four distinct times when characters on the band align with the print columns and only one-quarter of the print columns are aligned at a given instant within the scan—one-quarter of the print columns at time t0, one-quarter at time t1, one-quarter at time t2, and one-quarter at time t3. The particular time periods are designated as subscan 1, 2, 3, and 4, respectively. It is noted that for a given print column to band character alignment in a given subscan, that every fourth print column aligns with every third character on the band, and that such relationship is identical to the ratio given in Equation 8. It is also noted that the value of X, referred to as the subscan scheme, is 4 and that there are four subscans in one scan. It can also be seen that if the print columns are sequentially addressed (1, 2, 3, 4, 5, etc.), that the characters on the band which are aligned with the print columns may be incremented as Z+0, Z+1, Z+2, Z+3, Z+3. The character in front of the first print column is tracked by means of a band character counter (BCC) and the print column to band character relationship during the scan is tracked by means of a band code generator (BCG)—see Table A.

TABLE A

STANDARD PITCH

| PRT. COL. | 1 | 2 | 3 | 4 | 5 | 6 | 7 | 8 | 9 | 10 | 11 | 12 | 13 | 14 | 15 | 16–136 |
|---|---|---|---|---|---|---|---|---|---|---|---|---|---|---|---|---|
| | $\frac{1''}{30}$ | | | | | | | | | | | | | | | |
| BAND | Z+0 | Z+1 | Z+2 | Z+3 | Z+4 | Z+5 | Z+6 | Z+7 | Z+8 | Z+9 | Z+10 | Z+11 | | | | |
| $V_b$ | t0 | t1 | t2 | t3 | | | | | | | | | | | | |
| | t4 | $t1 = \frac{1/30''}{V_b}$ | | | | $t2 = \frac{2/30''}{V_b}$ | | | | | $t3 = \frac{3/30''}{V_b}$ | | | | | |

X = + 4

Y = + 3

| PRT. COL. | 1 | 2 | 3 | 4 | 5 | 6 | 7 | 8 | 9 | 10 | 11 | 12–136 | Scan (BBC) | Sub-scan |
|---|---|---|---|---|---|---|---|---|---|---|---|---|---|---|
| t0 | Z+0 | | | | Z+3 | | | | Z+6 | | | | Z0 | 1 |
| t1 | | Z+1 | | | | Z+4 | | | | Z+7 | | | | 2 |
| t2 | | | Z+2 | | | | Z+5 | | | | Z+8 | | | 3 |
| t3 | | | | Z+3 | | | | Z+6 | | | | Z+9 | | 4 |
| | Band Code Generator | | | | | | | | | | | | | |
| t4 | Z+1 | | | | Z+4 | | | | Z+7 | | | | Z1 | 1 |
| t5 | | Z+2 | | | | Z+5 | | | | Z+8 | | | | 2 |
| t6 | | | Z+3 | | | | Z+6 | | | | Z+9 | | | 3 |
| t7 | | | | Z+4 | | | | Z+7 | | | | Z+10 | | 4 |
| t8 | Z+2 | | | | | | | | | | | | Z2 | 1 |

As mentioned previously, the time required for two successive characters on the band to pass print column one position is called a scan. For the print column/band character relationship shown in Table A, the time required to move character Z+1 on the band to the position in front of print column one is given as $(P_c/V_b)=t_4=1$ scan where $V_b$ is the band velocity.

This contrasts with the compressed pitch arrangement shown in the following table, as determined by Equation 9 as $$\frac{X_c}{Y_c} = 2/1$$

for a compressed pitch machine.

TABLE B

COMPRESSED PITCH

PRT.

TABLE B-continued

COMPRESSED PITCH

| | | | | | | | | | | | | | | | | | | | | | | |
|---|---|---|---|---|---|---|---|---|---|---|---|---|---|---|---|---|---|---|---|---|---|---|
| COL. | 1 | 2 | 3 | 4 | 5 | 6 | 7 | 8 | 9 | 10 | 11 | 12 | 13 | 14 | 15 | 16 | 17 | 18 | 19 | 20–204 | | |
| | $\frac{1''}{30}$ | | | | | | | | | | | | | | | | | | | | | |
| BAND | Z+0 | Z+1 | | Z+2 | | Z+3 | | Z+4 | | Z+5 | | Z+6 | | Z+7 | | Z+8 | | Z+9 | | | | |
| $V_b$ | t0 | t1 | | t2 | | t3 | | | | | | | | | | | | | | | | |
| | t4 | | | | | | | | | | | | | | | | | | | | | |
| | X = + 2 | | | | | | | | | | | | | | | | | | | | | |
| PRT. COL. | 1 | 2 | 3 | 4 | 5 | 6 | 7 | 8 | 9 | 10 | 11 | 12 | 13 | 14 | 15–204 | | | | | | Scan (BBC) | Sub-scan |
| | Y = + 1 | | | | | | | | | | | | | | | | | | | | | |
| t0 | Z+0 | | Z+1 | | Z+2 | | Z+3 | | Z+4 | | Z+5 | | Z+6 | | Z+7 | | | | | | Z0 | 1 |
| t1 | | | | | | | | | | | | | | | | | | | | | | 2 |
| t2 | | Z+1 | | Z+2 | | Z+3 | | Z+4 | | Z+5 | | Z+6 | | Z+7 | | | | | | | | 3 |
| t3 | | | | | | | | | | | | | | | | | | | | | | 4 |
| | Band Code Generator | | | | | | | | | | | | | | | | | | | | | |
| t4 | Z+1 | | Z+2 | | Z+3 | | Z+4 | | Z+5 | | Z+6 | | Z+7 | | Z+8 | | | | | | Z1 | 1 |
| t5 | | | | | | | | | | | | | | | | | | | | | | 2 |
| t6 | | Z+2 | | Z+3 | | Z+4 | | Z+5 | | Z+6 | | Z+7 | | Z+8 | | | | | | | | 3 |
| t7 | | | | | | | | | | | | | | | | | | | | | | 4 |
| t8 | Z+2 | | | | | | | | | | | | | | | | | | | | Z2 | 1 |

In Table B, which is a similar development for the compressed pitch, it is noted that for a given print column to band character alignment in a given subscan, that every second print column aligns with every successive character on the band, and that such relationship is identical to the ratio given in Equation 9. It is also noted that the value of X, referred to as the subscan scheme, is 2 and that in Table B there are only two subscans, subscan 1 and 3, utilized in one scan.

Notice that the subscan scheme, wherein in the standard pitch (Table A) the subscan scheme is 4 and in the compressed pitch (Table B) the subscan scheme is 2.

As mentioned above, the present invention requires that the print hammers be time shared for the printer to be able to print in standard pitch and in compressed pitch by only changing the type character band. The faces of the hammers are caused to be displaced or moved in increments of 1/30 inch. In order to develop a shifting mechanism for the hammer faces, the basic values of the centerline distances between the imprinted characters for both standard pitch ($P_{is}$) and compressed pitch ($P_{ic}$) are taken into account wherein $P_{is}$ is 1/10 inch and $P_{ic}$ is 1/15 inch. Since the lowest common denominator of these two pitch values is 30, a shifting mechanism is developed which is controlled in increments of 1/30 inch, so that in the standard pitch machine, the hammer faces are shifted at 3/30 inch or 1/10 inch, and in the compressed pitch machine, the hammer faces are shifted at 2/30 inch or 1/15 inch.

In a standard pitch machine, the characters are printed at 1/10 inch and the compressed pitch characters are printed at 1/15 inch, so for a time shared hammer bank, the hammer bank or hammer bar movement must be at one of these two displacements. The two position standard pitch corresponds to a three position compressed pitch and a four position standard pitch compares with a six position compressed pitch, as seen in the following tables.

TABLE C

2 POS. STD. PITCH/3 POS. COMP. PITCH

| | | | | | | | | | | | | | |
|---|---|---|---|---|---|---|---|---|---|---|---|---|---|
| HMR. | 1 | X | 2 | X | 3 | X | 4 | X | | | | | 2 POSITION |
| PRT. POS. | 1 | 2 | 3 | 4 | 5 | 6 | 7 | 8 | | | | | STD. PITCH (1/10") |
| | $\frac{1''}{30}$ | | $\frac{1''}{10}$ | | | | | | | | | | |
| HMR. | 1 | X | X | 2 | X | X | 3 | X | X | 4 | X | X | 3 POSITION |
| PRT. POS. | 1 | 2 | 3 | 4 | 5 | 6 | 7 | 8 | 9 | 10 | 11 | 12 | COMP. PITCH (1/15") |
| | $\frac{1''}{30}$ | | | $\frac{1''}{15}$ | | | | | | | | | |

TABLE D

4 POS. STD. PITCH/6 POS. COMP. PITCH

| | | | | | | | | |
|---|---|---|---|---|---|---|---|---|
| HMR. | 1 | X | X | X | 2 | X | X | X 4 POSITION |

TABLE D-continued

| 4 POS. STD. PITCH/6 POS. COMP. PITCH | | | | | | | | | | | | | |
|---|---|---|---|---|---|---|---|---|---|---|---|---|---|
| PRT. POS. | 1 | 2 | 3 | 4 | 5 | 6 | 7 | 8 | STD. PITCH (1/10") | | | | |
| | | 1"/30 | | 1"/10 | | | | | | | | | |
| HMR. | 1 | X | X | X | X | X | 2 | X | X | X | X | X | 6 POSITION |
| PRT. POS. | 1 | 2 | 3 | 4 | 5 | 6 | 7 | 8 | 9 | 10 | 11 | 12 | COMP. PITCH (1/15") |
| | | 1"/30 | | | 1"/15 | | | | | | | | |

For the standard pitch machines, that is for one, (no hammer shift), two or four positions of the hammer bar, the hammers are on 1/10 inch, 2/10 inch and 4/10 inch, respectively. For the compressed pitch machine, that is for three and six positions, the hammers are on 2/10 and 4/10 inch, respectively, the same as a two or four position standard pitch machine. For the standard pitch machine, the hammers are moved in three increments of displacement, each 1/30 inch, for a movable character center line displacement of 1/10 inch. For the compressed pitch machine, the hammers are moved in two increments of displacement, each 1/30 inch for a printable character center line displacement of 1/15 inch, it being noted that the increments of displacement are 1/30 inch for both the standard and the compressed pitch machines, the standard pitch machine being required to be displaced a total of 1/10 inch of the hammer bar and the compressed pitch machine being required to be displaced a total of 1/15 inch. The horizontal motion system has been designed with strobe marks at 1/30 inch intervals and it is only a matter of moving the horizontal system three marks to achieve 1/10 inch displacement of the hammer bank or hammer bar for a standard pitch machine, or two marks to achieve 1/15 inch displacement of the hammer bar for a compressed pitch machine. It can be seen from Table C that by time sharing the hammers for a standard pitch machine with every two print columns, that three print columns can be shared with one hammer for a compressed pitch machine. Table D shows that a four position standard pitch machine becomes a six position compressed machine.

Table E is merely an extension of Table A and applies to a two position standard pitch machine. Two terms are introduced in this table which are the horizontal position counter (HPC) and the shift register step counter (SR STEP Counter). The HPC is utilized to track the position of the hammer bar. When the hammer bar is in the home position, (HPC=0) i.e., hammer 1 aligned with Prt. Col. 1, all hammer faces are aligned with the odd print columns. When the horizontal position counter equals 1, (HPC=1), the hammer faces are aligned with all the even columns.

TABLE E

| TWO POSITION- STANDARD PITCH | | | | | | | | | | | | | | |
|---|---|---|---|---|---|---|---|---|---|---|---|---|---|---|
| Prt. Col. | 1 | 2 | 3 | 4 | 5 | 6 | 7 | 8 | 9 | 10 | 11 | 12 | 13 | 14-136 |
| Hmrs. at HPC=0 | 1 | | 2 | | 3 | | 4 | | 5 | | 6 | | 7 | |
| HPC=1 | | 1 | | 2 | | 3 | | 4 | | 5 | | 6 | | 7 |
| Sub-Scan | | X=4 | | | | | | | | | | | | |
| 1 | Z+0 | | | | Z+3 | | | | Z+6 | | | | Z+9 | |
| 2 | | Z+1 | Y=3 | | | Z+4 | | | | Z+7 | | | | Z+10 |
| 3 | | | Z+2 | | | | Z+5 | | | | Z+8 | | | |
| 4 | | | | Z+3 | | | | Z+6 | | | | Z+9 | | |
| | Band Code Generator | | | | | | | | | | | | | |
| SR Step Counter | 0 | 1 | 0 | 1 | 0 | 1 | 0 | 1 | 0 | 1 | 0 | 1 | 0 | 1 |

In the existing design, a band character counter (BCC) tracks the character on the band which will be in front of print column number 1 on the succeeding scan. This is shown in Table A as Z+0 for scan Z0, Z+1 for the next scan Z1, Z+2 for the next scan Z2 and Z+3 for the next scan Z3. The contents of the band character counter are deposited into a band code generator (BCG) prior to the start of comparing the BCG with the print line buffer (PLB). The print line buffer (PLB) is sequentially addressed starting with print column number 1, the band code generator being incremented every three times (see Table E, Y=3) that the print line buffer is incremented four times (see Table E, X=4). The comparisons or lack of comparisons are transmitted to the hammer driver circuit (specifically in a temporary shift register memory) but are only clocked into the shift register memory when the shift register step counter (SR STEP CNTR) matches the horizontal position counter. This allows such comparisons or lack of comparisons to be stored only when a hammer exists for the particular print column under consideration. At the end of a scan and after all print columns are compared with the band characters, the contents of the hammer driver register are shifted into a second storage element so that the hammers may be fired at the appropriate time within the subscan. While the hammers are being fired, the hammer driver shift register is again being loaded so that the compares or lack thereof always occur one scan ahead of the hammer firing. This process is repeated until all characters in a given font of the type band have appeared in front of each print position. After this time period, the hammer faces are shifted and the horizontal position counter is adjusted. The compares are again made and the appropriate hammers fired. Again after all the characters have been in front of all print column positions, the process is complete and preparation is made to process a new line of data into the print line buffer (PLB) and includes advancing the paper.

Table E denotes the major bookkeeping required by the control electronics for a two position, standard pitch machine, whereas Table F denotes the major bookkeeping for a three position, compressed pitch machine. The printer control selects either the bookkeeping in Table E or in Table F by detecting the type band installed on the printer (standard or compressed pitch), respectively. Table G and Table H show the bookkeeping for a four position, standard pitch machine, and for a six position, compressed pitch machine, respectively.

TABLE F

THREE POSITION - COMPRESSED PITCH

| Prt. Col. | 1 | 2 | 3 | 4 | 5 | 6 | 7 | 8 | 9 | 10 | 11 | 12 | 13 | 14-204 |
|---|---|---|---|---|---|---|---|---|---|---|---|---|---|---|
| Hmrs. at HPC=0 | 1 | | | 2 | | | 3 | | | 4 | | | 5 | |
| HPC=1 | | 1 | | | 2 | | | 3 | | | 4 | | | 5 |
| HPC=2 | | | 1 | | | 2 | | | 3 | | | 4 | | |
| Sub-Scan | | X=2 | | | | | | | | | | | | |
| 1 | Z+0 | | Z+1 | | Z+2 | | Z+3 | | Z+4 | | Z+5 | | Z+6 | |
| | | Y=1 | | | | | | | | | | | | |
| 3 | | Z+1 | | Z+2 | | Z+3 | | Z+4 | | Z+5 | | Z+6 | | Z+7 |
| | Band Code Generator | | | | | | | | | | | | | |
| SR Step Counter | 0 | 1 | 2 | 0 | 1 | 2 | 0 | 1 | 2 | 0 | 1 | 2 | 0 | 1 |

TABLE G

FOUR POSITION - STANDARD PITCH

| Prt. Col. | 1 | 2 | 3 | 4 | 5 | 6 | 7 | 8 | 9 | 10 | 11 | 12 | 13 | 14-136 |
|---|---|---|---|---|---|---|---|---|---|---|---|---|---|---|
| Hmrs. at HPC=0 | 1 | | | | 2 | | | | 3 | | | | 4 | |
| HPC=1 | | 1 | | | | 2 | | | | 3 | | | | 4 |
| HPC=2 | | | 1 | | | | 2 | | | | 3 | | | |
| HPC=3 | | | | 1 | | | | 2 | | | | 3 | | |
| Sub-Scan | | X=4 | | | | | | | | | | | | |
| 1 | Z+0 | | | | Z+3 | | | | Z+6 | | | | Z+9 | |
| 2 | | Z+1 | Y=3 | | | Z+4 | | | | Z+7 | | | | Z+10 |
| 3 | | | Z+2 | | | | Z+5 | | | | Z+8 | | | |
| 4 | | | | Z+3 | | | | Z+6 | | | | Z+9 | | |
| | Band Code Generator | | | | | | | | | | | | | |
| SR Step Counter | 0 | 1 | 2 | 3 | 0 | 1 | 2 | 3 | 0 | 1 | 2 | 3 | 0 | 1 |

TABLE H

SIX POSITION - COMPRESSED PITCH

| Prt. Col. Hmrs. | 1 | 2 | 3 | 4 | 5 | 6 | 7 | 8 | 9 | 10 | 11 | 12 | 13 | 14-204 |
|---|---|---|---|---|---|---|---|---|---|---|---|---|---|---|
| HPC=0 | 1 | | | | | | 2 | | | | | | 3 | |
| HPC=1 | | 1 | | | | | | 2 | | | | | | 3 |
| HPC=2 | | | 1 | | | | | | 2 | | | | | |
| HPC=3 | | | | 1 | | | | | | 2 | | | | |
| HPC=4 | | | | | 1 | | | | | | 2 | | | |
| HPC=5 | | | | | | 1 | | | | | | 2 | | |
| Sub-Scan | | X=2 | | | | | | | | | | | | |
| 1 | Z+0 | | Z+1 | | Z+2 | | Z+3 | | Z+4 | | Z+5 | | Z+6 | |
| 3 | | Z+1 | | Z+2 | | Z+3 | | Z+4 | | Z+5 | | Z+6 | | Z+7 |
| | | Y=1 | | | | | | | | | | | | |
| SR Step Counter | 0 | 1 | 2 | 3 | 4 | 5 | 0 | 1 | 2 | 3 | 4 | 5 | 0 | 1 |

It is to be noted that the present invention utilizes identical control electronics for three different printers, as seen in the table below.

TABLE I

| Printer No. | No. of Pos. | LPM at 48 Char. | Pitch (Inch) | Prt. Col. (Max.) | No. of Hmr. Dr. |
|---|---|---|---|---|---|
| 1 | 1 | 1130 | 1/10 | 136 | 136 |
| 2 | 2 | 720 | 1/10 | 136 | 68 |
| | 3 | 480 | 1/15 | 204 | 68 |
| 3 | 4 | 360 | 1/10 | 136 | 34 |
| | 6 | 240 | 1/15 | 204 | 34 |

It should also be clear that Printer No. 1 utilizes Table A to develop portions of the control logic realizing that there is no hammer shifting, i.e., HPC and SR step counter always equal zero. Printer No. 2 utilizes Tables E and F, and Printer No. 3 utilizes Tables G and H.

An additional function of the controller is for positioning or controlling the horizontal motion of the hammer bar assembly for a standard pitch machine wherein the characters are imprinted on the paper at 1/10 inch spacing and in the compressed pitch machine wherein the characters are imprinted at 1/15 inch, this being the printing of 10 characters per inch or 15 characters per inch. The horizontal motion system is designed with stopping points at 1/30 inch and for a standard pitch machine, three of such marks are sensed between stops to provide 1/10 inch. For a compressed pitch machine, 2 of such marks are sensed between the stops to provide 1/15 inch. All the characters are printed for a given position and the controller allows a horizontal motion of either 1/10 or 1/15 inch in increments of 1/30 inch. When all characters have been optioned to all horizontal positions of the particular type machine, the print cycle is complete.

Referring now to the hammer drivers for the several printers, a set of equations can be developed which show the relationships for firing the hammers for all three machines. The following table is for the standard pitch printer.

TABLE J

| Prt. Col. | 1 | 2 | 3 | 4 | 5 | 6 | 7 | 8 | 9 | 10 | 11 | 12 |
|---|---|---|---|---|---|---|---|---|---|---|---|---|
| Sub-Scan | | | | | | | | | | | | |
| 1 | Z+0 | | | | Z+3 | | | | Z+6 | | | |
| 2 | | Z+1 | | | | Z+4 | | | | Z+7 | | |
| 3 | | | Z+2 | | | | Z+5 | | | | Z+8 | |
| 4 | | | | Z+3 | | | | Z+6 | | | | Z+9 |
| Printer No. 1 | (ONE POSITION - STANDARD PITCH) | | | | | | | | | | | |
| Hmrs. | 1 | 2 | 3 | 4 | 5 | 6 | 7 | 8 | 9 | 10 | 11 | 12 |
| HPC | 0 | 0 | 0 | 0 | 0 | 0 | 0 | 0 | 0 | 0 | 0 | 0 |
| Printer No. 2 | (TWO POSITION - STANDARD PITCH) | | | | | | | | | | | |
| Hmrs. | 1 | X | 2 | X | 3 | X | 4 | X | 5 | X | 6 | X |
| HPC | 0 | 1 | 0 | 1 | 0 | 1 | 0 | 1 | 0 | 1 | 0 | 1 |
| Printer No. 3 | (FOUR POSITION - STANDARD PITCH) | | | | | | | | | | | |
| Hmrs. | 1 | X | X | X | 2 | X | X | X | 3 | X | X | X |
| HPC | 0 | 1 | 2 | 3 | 0 | 1 | 2 | 3 | 0 | 1 | 2 | 3 |

Note:
The above table depicts the hammers at HPC=0.

For Printer No. 1 (one hammer per print column), the four distinct times within a scan when the hammer groups may be fired are defined as HEP 1, HEP 2, HEP 3, and HEP 4, that is when the hammer faces match the band characters. These occurrences are as follows:

When HEP 1=SSR1 and HPC=0
When HEP 2=SSR2 and HPC=0
When HEP 3=SSR3 and HPC=0
When HEP 4=SSR4 and HPC=0
HEP 1 can fire hammers 1, 5, 9, 13, etc.
HEP 2 can fire hammers 2, 6, 10, 14, etc.
HEP 3 can fire hammers 3, 7, 11, 15, etc.
HEP 4 can fire hammers 4, 8, 12, 16, etc.

For Printer No. 2, (one hammer per two print columns), there are two distinct times when the hammer groups may be fired in a given scan for a given hammer face position (HPC). These times are as follows:

When HEP 1=SSR1 and HPC=0 or
SSR2 and HPC=1
When HEP 2=SSR3 and HPC=0 or
SSR4 and HPC=1

It is seen that in Machine 2, HEP1 can fire all the odd numbered hammers, and HEP2 can fire all the even numbered hammers.

For Printer No. 3, (one hammer per four print positions), there is one distinct time when the hammer groups may be fired in a given scan for a given hammer face position (HPC). This time is as follows:

When HEP1=SSR1 and HPC=0 or
SSR2 and HPC=1 or
SSR3 and HPC=2 or
SSR4 and HPC=3

It is thus seen that HEP1 can fire all the hammers.

A similar relationship is developed for the compressed pitch machine as seen from the following table.

TABLE K

| Prt. Col. | 1 | 2 | 3 | 4 | 5 | 6 | 7 | 8 | 9 | 10 | 11 | 12 |
|---|---|---|---|---|---|---|---|---|---|---|---|---|
| Sub-Scan | | | | | | | | | | | | |
| 1 | Z+0 | | Z+1 | | Z+2 | | Z+3 | | Z+4 | | Z+5 | |
| 2 | | | | | | | | | | | | |
| 3 | | Z+1 | | Z+2 | | Z+3 | | Z+4 | | Z+5 | | Z+6 |
| 4 | | | | | | | | | | | | |
| Printer No. 2 | (THREE POSITION - COMPRESSED PITCH) | | | | | | | | | | | |
| Hmrs. | [1] | X | X | [2] | X | X | [3] | X | X | [4] | X | X |
| HPC | 0 | 1 | 2 | 0 | 1 | 2 | 0 | 1 | 2 | 0 | 1 | 2 |
| Printer No. 3 | (SIX POSITION - COMPRESSED PITCH) | | | | | | | | | | | |
| Hmrs. | [1] | X | X | X | X | X | [2] | X | X | X | X | X |
| HPC | 0 | 1 | 2 | 3 | 4 | 5 | 0 | 1 | 2 | 3 | 4 | 5 |

Note
The above table depicts the hammers at HPC=0.

In compressed pitch, Printer No. 2 (one hammer per three pitch columns), there are two distinct times within a scan when the hammer groups may be fired for a given hammer face position (HPC) as follows:

When HEP1=SSR1 and HPC=0 or
SSR3 and HPC=1 or
SSR1 and HPC=2
When HEP2=SSR3 and HPC=0 or
SSR1 and HPC=1 or
SSR3 and HPC=2

For Printer No. 3, (one hammer per six print columns), there is one distinct time when a hammer group may be fired in a given scan for a given hammer face position (HPC) as follows:

When HEP1=SSR1 and HPC=0 or
SSR3 and HPC=1 or
SSR1 and HPC=2 or
SSR3 and HPC=3 or
SSR1 and HPC=4 or
SSR3 and HPC=5

As can be seen, the HEP equations in Tables J and K are a function of the following parameters:

1. The printer number (1, 2, or 3)
2. The imprinted character pitch (standard or compressed)
3. The subscan (1, 2, 3, or 4)
4. The hammer face position (HPC)

Additionally, it should be noted that the above HEP equations may be combined by conventional minimization techniques and hammer driver circuits may be subdivided so that one set of control electronics may be designed to service the several machines.

It is therefore seen and the following are the main points of the controller and mechanism which allows for implementation of and permits the choice of printing at 10 or 15 characters per inch. The first point is that the horizontal motion is done in 1/30 inch displacement strokes or increments and that three increments are used for 10 characters per inch whereas two increments are used for 15 characters per inch. The second point is that the 4 subscan scheme at 10 characters per inch converts to a 2 subscan scheme at 15 characters per inch. A third important point is that the controller is designed to take care of the family of printers as shown in Table I above wherein the printer and number of positions is shown for different character sets for the different pitch modes.

The choice of using either 1/10 inch or 1/15 inch character spacing requires only for changing the band on Printer No. 2 and 3 and no other change in the mechanism or the controller is required.

Figure 4A:
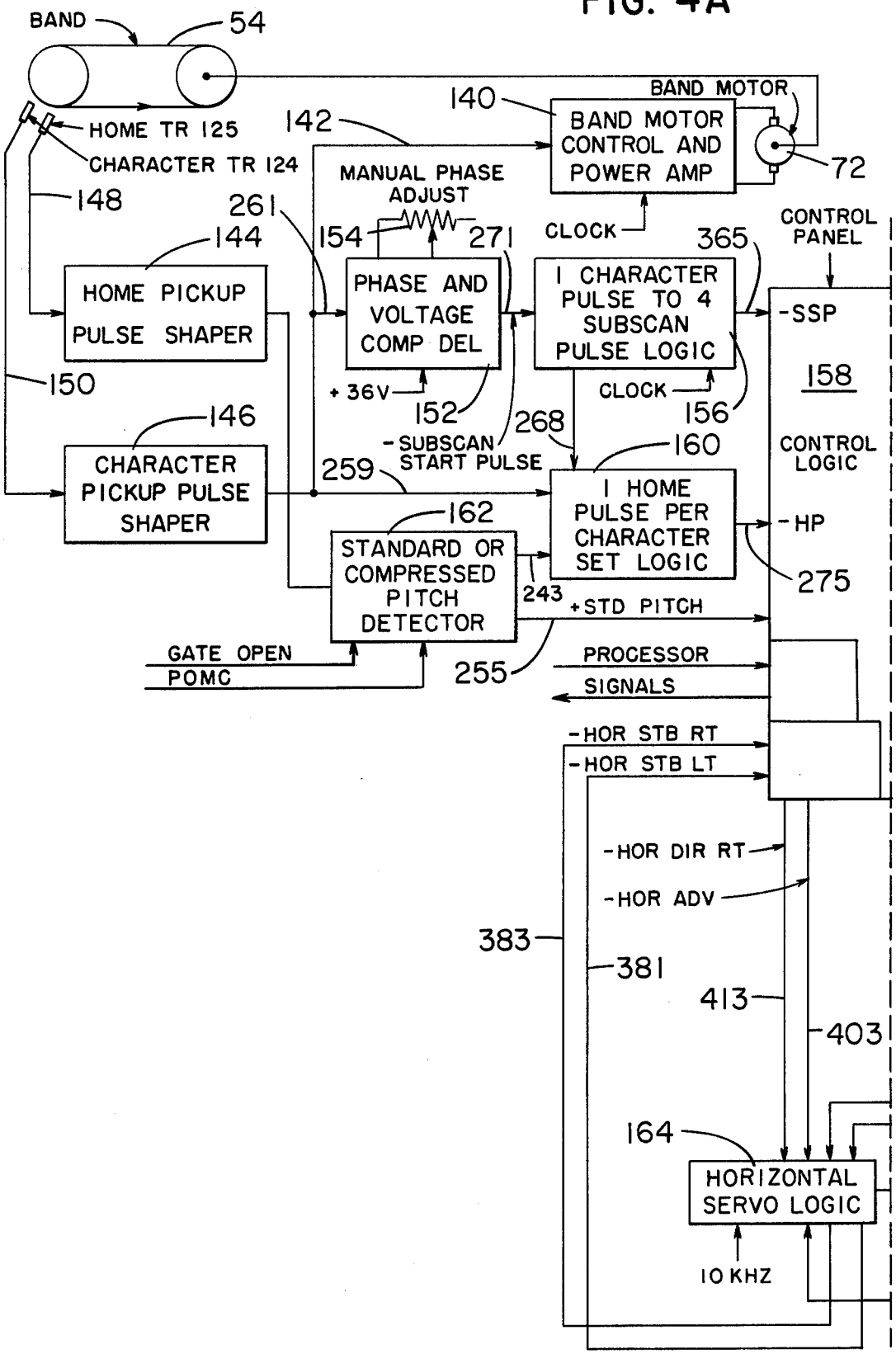
FIGS. 4A and 4B constitute a block diagram of the essential components of the printer system.
Figure 4B:
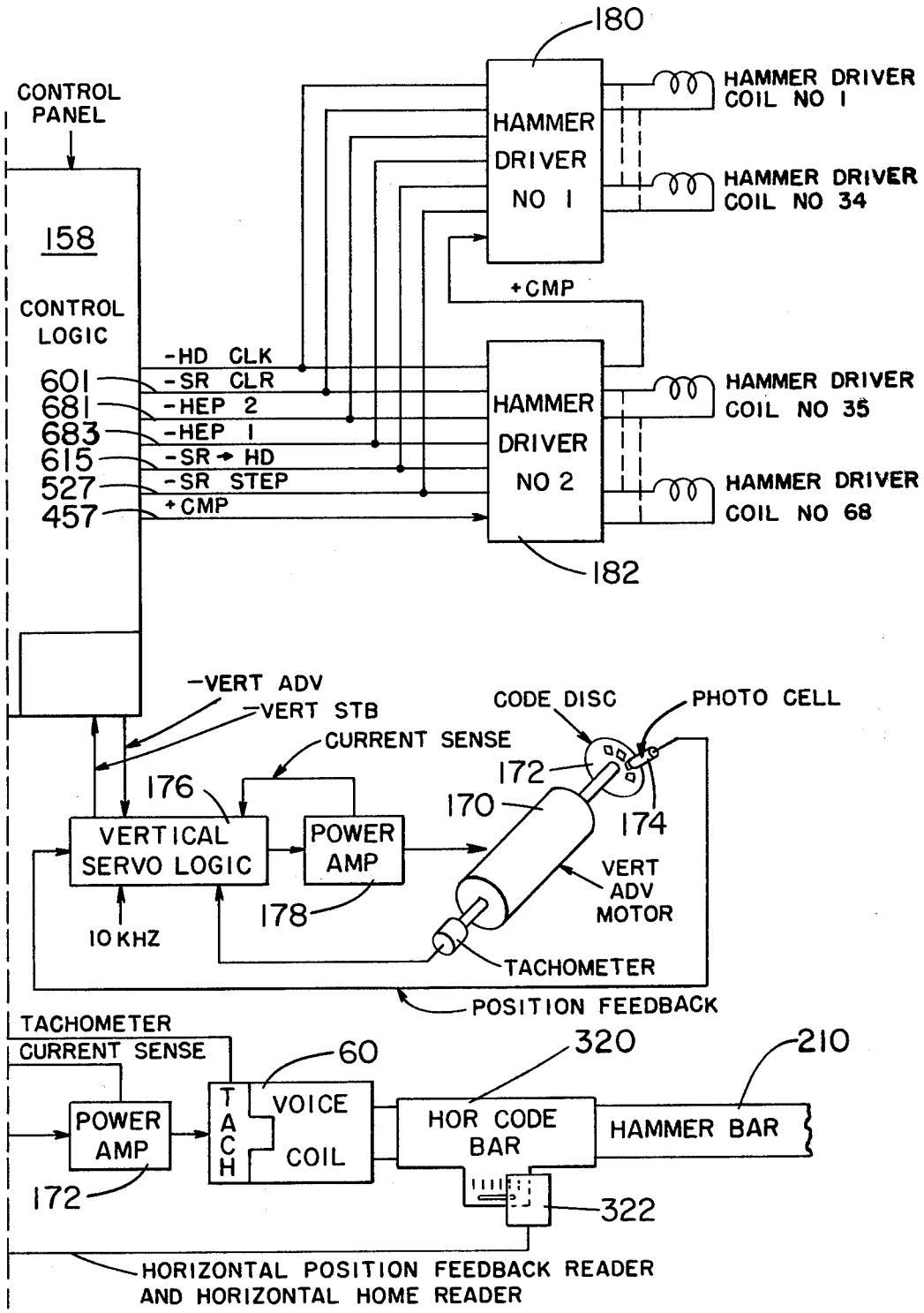

FIGS. 4A and 4B constitute a block diagram of the various elements and components of the dual pitch printing system wherein the band 54 is driven by the band motor 72 under the direction of a band motor control and power amplifier 140 and a line or signal 142 as feedback input to the band motor control and power amplifier along with a clock pulse. Generally, the band 54, whether it is of the standard pitch type or the compressed pitch type, is installed on the machine with the selected font of the 48 character, the 64 character, the 96 character or the 128 character and the transducers 124 and 125 pick up or sense the character and the home marks on the band. There are two groups of timing marks on each type band, one group of timing marks being for the type characters with one timing mark for each character, and the other group of timing marks being for the type character sets or fonts with one timing mark of the second group for each character set or font on the standard pitch band and an additional timing or home mark for each set or font on the compressed pitch band to identify the characters in relation to the first print column and to distinguish between the standard and the compressed pitch bands. The character transducer senses the pulse mark for each character of every font on the band, whereas the home pulse pickup or sensor senses a single mark for each font on the standard pitch band and senses an additional mark on the compressed pitch band and depending upon whether the home pulse transducer senses the second pulse mark within a predetermined period of time indicates to the control system that a standard pitch or a compressed pitch band is on the machine. A home pickup pulse shaper 144 and a character pickup pulse shaper 146 obtain signals or pulses through leads 148 and 150 respectively from the home pulse transducer 125 and the character pulse transducer 124 adjacent the band 54, the character pulses and the home pulses being generated as sine wave shaped signals and digitized by shapers 144 and 146, the purpose of which will be further shown and described. A phase and voltage compensation delay 152 receives a signal 261 from the character pickup pulse shaper 146, such delay logic circuit 152 being utilized to adjust the start of the subscan pulses according to the voltage level of the +36 volt supply by either increasing or decreasing the time delay between the time of sensing the character from the character pulse pickup until a subscan start pulse 271 is generated, for the purpose of adjusting firing time of the hammers. The centering or positioning of the band characters and the hammers are manually adjusted by means of a manual phase adjust device 154. The subscan start pulses are input to a one character pulse to four subscan pulse logic circuit 156, also having a clock input, the logic circuit 156 generating four subscan pulses 365 from each character pulse derived from the character marks on the band 54, such subscan pulses being consistent with the four subscan scheme, as shown in Table A. One output of the logic circuit 156 is the subscan pulse signal 365 to the control logic 158 and a second output 268 from such logic circuit 156 is sent to a one home pulse per character set logic circuit 160 which has one input 259 from the character pickup pulse shaper 146 and a second input 243 from a standard or compressed pitch detector 162, such detector 162 having a gate open input signal, a power-on master clear input signal and an input from the home pickup pulse shaper 144. The standard or compressed pitch detector 162 senses the presence of either 1 or 2 home pickup pulses per character set or font from the home pickup pulse shaper 144 and produces a standard pitch signal, active high if one pulse per font or active low if two pulses per font, are detected. This is accomplished only after initial power on or gate closure and after the band is up to speed. The 1 home pulse to character set logic 160 electrically compensates for any misalignment between the character pulse transducer 124 and the home pulse transducer 125. The output of this logic 160 generates 1 home pulse 275 per character set to the control logic 158, such home pulse 275 being synchronized to the subscan pulses 365. The output from the detector 162 is sent to the control logic 158 as a standard pitch signal 255 with the second output 243 of the detector 162 being sent to the one home pulse character set logic circuit 160. The output of the home pulse character set logic circuit 160 is sent as a home pulse signal 275 to the control logic 158. The control logic includes an input section for receiving and sending processor signals, which signals will be further described in the operation of the invention.

The time sharing of the hammers on the printer is accomplished by means of horizontal servo logic circuitry 164, which receives as an input a clock signal and a feedback signal from a horizontal encoder bar 320 secured to a hammer bar assembly 210 which carries the hammers in a horizontal direction as driven by the voice coil 60 connected to a power amplifier 172, the amplifier receiving its input signal from the horizontal servo logic circuit 164, and having its output signal fed to the voice coil 60. A horizontal code bar reader 322 sends the feedback signal to the horizontal servo logic 164. A tachometer signal and a current sensing signal are fed from the voice coil 60 and the power amplifier, respectively, to the horizontal servo logic circuit 164. A horizontal directional right signal 413 and a horizontal advance signal 403 are input from the control logic to the horizontal servo logic circuit 164, with output signals comprising a horizontal strobe right 383 and a horizontal strobe left 381 being fed into the control logic 158. A vertical advance motor 170 having a code disc 172 and a photocell sensing unit 174 connected to feed back a positional signal to a vertical servo logic circuit 176 provides the vertical advancement of record media after the printing of each line is completed. The vertical advance motor 170 is driven by a power amplifier 178 which has a signal relating to current sensing sent back to the vertical servo logic circuit 176 which sends a vertical strobe signal to the control logic 158 and receives a vertical advance signal from such logic.

A number of output signals are directed from the control logic 158 to the drivers for the respective hammers to provide proper actuation of the hammers, at the precise time the band characters are presented in front of such hammers. In the case of the two-position standard pitch or a three-position compressed pitch machine which has a total of 68 hammers, a hammer driver 180 is responsible for energizing the coils of hammer drivers 1 to 34 and a hammer driver assembly No. 2, such as 182, is responsible for energizing the coils of hammers 35 to 68. The signals which are output from control logic 158 to the hammer drivers include a hammer driver clock signal, a shift register clear signal 601, a pair of hammer enable pulse signals 683 and 681, a transfer of the shift register contents to the hammer drivers signal 615, a shift register step line 527, and a compare signal 457, all of which are utilized in a manner which will be further described. The control logic 158 is the digital logic which controls the operation of the printer which includes the interface between the printer and the external processor, the operator's control panel circuitry, the printing cycles, the horizontal motion of the hammer faces, the tracking of the characters on the band, and movement of paper. While the various elements and components of the dual pitch system are generally shown in FIGS. 4A and 4B in block form, certain of the elements and components will be further described in detail as they relate to the invention.

As seen from Table A above, there are four subscans within one scan, a scan being defined as the time period for two successive characters to pass in front of print column one position. During this time period, there are four distinct times that certain hammer groups can be fired, such times being associated with subscan 1, subscan 2, subscan 3, or subscan 4. The subscan pulses 365 are shown in FIG. 4A as being sent to the control logic 158 for operation thereby to provide the respective firing pulses for the hammer groups. The controller then enables the particular circuits to send the respective signals to the appropriate hammer drivers for actuating the coils of the individual hammers to print in either standard or compressed pitch depending upon the band which is at that time installed on the printer.

FIGS. 4C, 4D, 4E and 4F represent the block diagrams for the control logic of the printer. As shown and described herein, the block diagrams and the associated detail logic diagrams only explain Printer No. 2, as defined in Table I.

Figure 4C:
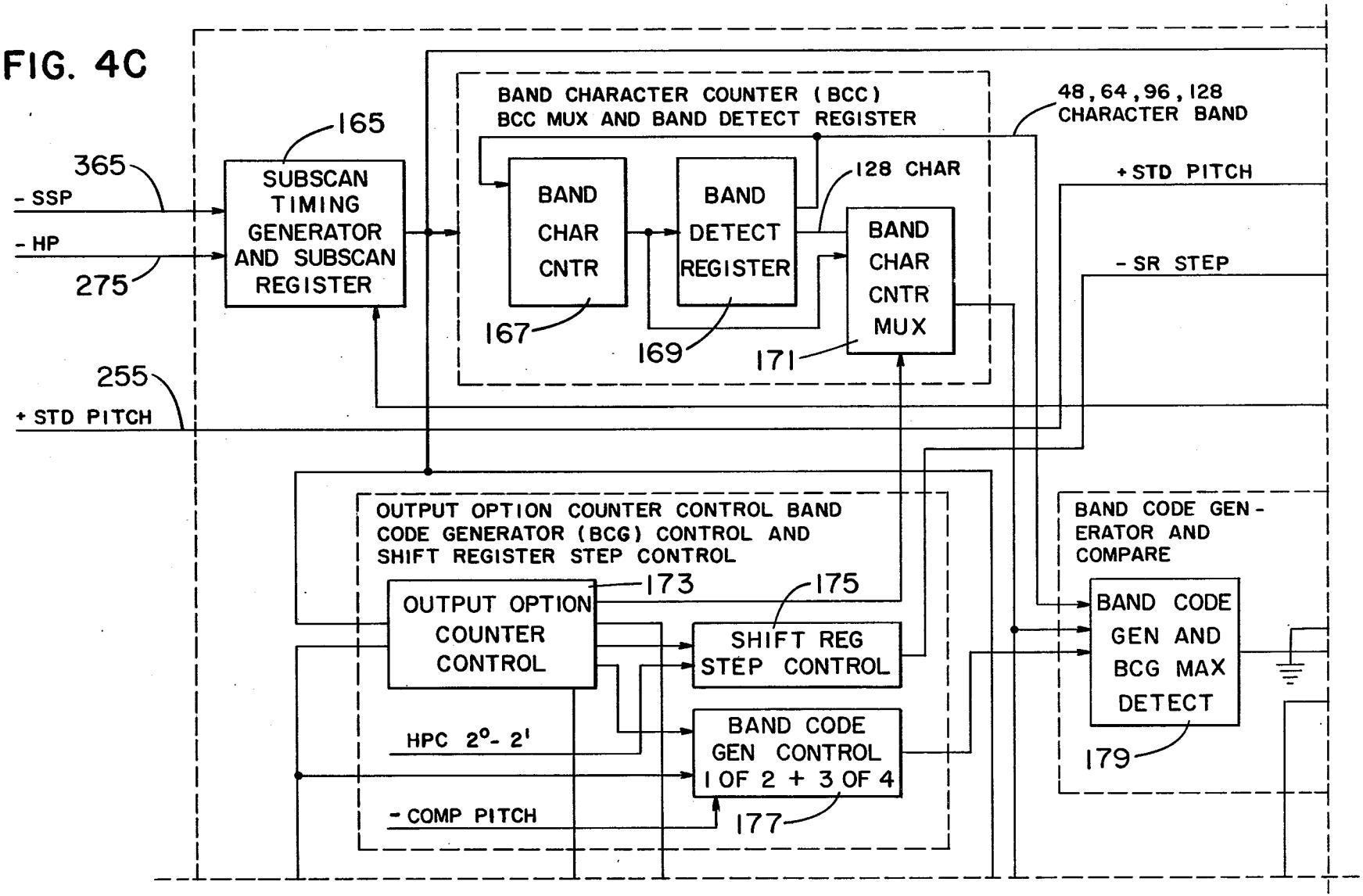
FIGS. 4C through 4F constitute a block diagram of the essential components of the printer control logic.

Referring now to FIG. 4C subscan timing generator and subscan register logic 165 receives a subscan pulse 365 and a home pulse 275 from the one character pulse to four subscan pulse logic 156 and the one home pulse per character set logic 160, respectively. The subscan timing generator transmits a group of eight timing pulses every time a subscan pulse is sent from the 1 character pulse to 4 subscan pulse logic 156. The subscan register in logic block 165 keeps track of the four subscan pulses to determine which of the four quadrants in a scan to which the subscan pulse is referring. The output of the subscan timing generator and subscan register is fed to a band character counter 167 with the output thereof going to a band detect register 169 and to a band character counter multiplexer 171. The output of the band detect register 169 is also sent to the multiplexer 171. Since several type font bands may be placed on the printer, means is provided to detect the type font. After a power on or gate closure and when the band is up to speed, the number of subscan pulses 365 (scans) are counted between home pulses 275 to determine the type font (48, 64, 96, 128) of the band. This is done utilizing signals 365 and 275 in conjunction with the logic blocks 165, 167 (band character counter) and 169 (band detect register). The type font information is stored in the band detect register 169. After the band font is detected, the band character counter 167 utilizes subscan and home pulse type information to track the character which will be in front of print position 1 or print column 1 at a given time. For example, if a 48 character band was on the machine, the band character counter would count between decimal 32 and decimal 79 which correspond to the 48 character positions on that type band. The output of the band character counter multiplexer 171 contains the code designated by the band character counter 167 or the starting code for the band (decimal 32 for the 48 character band). During an option cycle or the cycle which actually performs the compares of the characters on the band to the memory locations, the output of the multiplexer 171 is set to be the starting position of the code for the respective character on the band. This is done to provide a starting code of the band whenever the band code generator reaches the maximum count of the band. Referring to Table A, assume a 48 character set whose initial count is 32 and end count is 79, and that Z+1 for scan Z0 is to the count of 79, the next count for the band code generator must be decimal 32 and not decimal 80. This is accomplished by means of the BCG maximum detector in logic block 179 enabling the band code generator, also in block 179, to be loaded from the output of the band character counter multiplexer 171 which contains the code decimal 32. This code is zero for the 128 character band and is decimal 32 for the 48, 64 and 96 character bands. At the beginning of an option cycle or just prior to the actual comparisons, the code on the band character counter 167 is transmitted through the multiplexer 171 into the band code generator and band code generator maximum detect logic 179. This particular code is the character code which will be coming in front of print column 1 at the next scan period, it being remembered that an option cycle which performs all the comparisons is one scan ahead of the actual firing of the hammers.

The band code generator 179 provides the means for determining which character is in front of which column position for all column positions during that scan period. During an option cycle, the characters from the band code generator are compared with the contents of memory by means of the compare logic 181 which also receives an input from the memory 190. If a standard pitch band is present on the machine, 136 compares will be transmitted to the hammer drivers of which only 68 will be stored in the hammer driver shift registers for the hammer drivers, whereas if a compressed pitch band is present, 204 compares will be transmitted to the hammer drivers of which only 68 are stored, such compares being transmitted to the hammer driver shift registers by line 457.

Figure 4D:
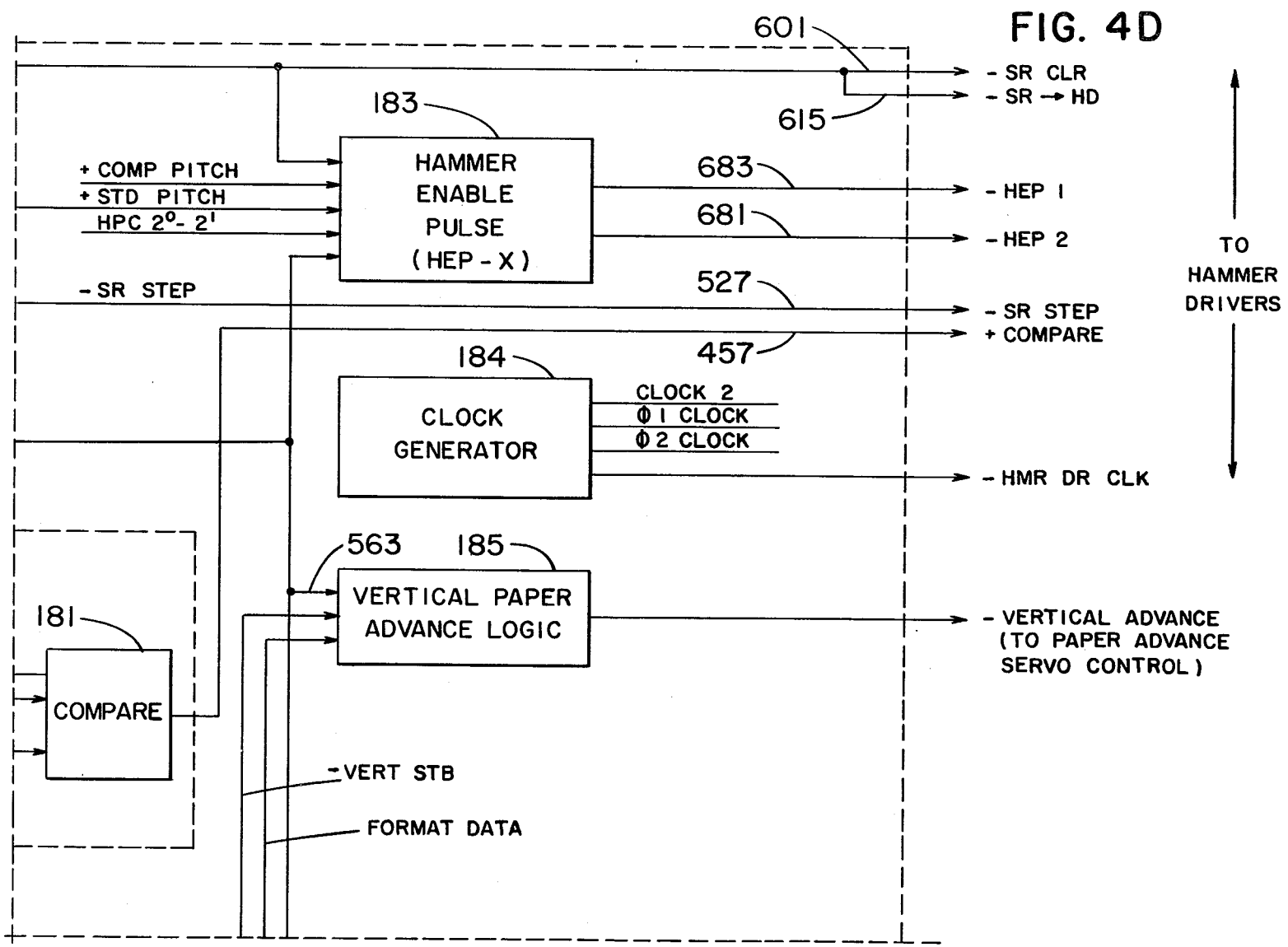
Figure 4E:
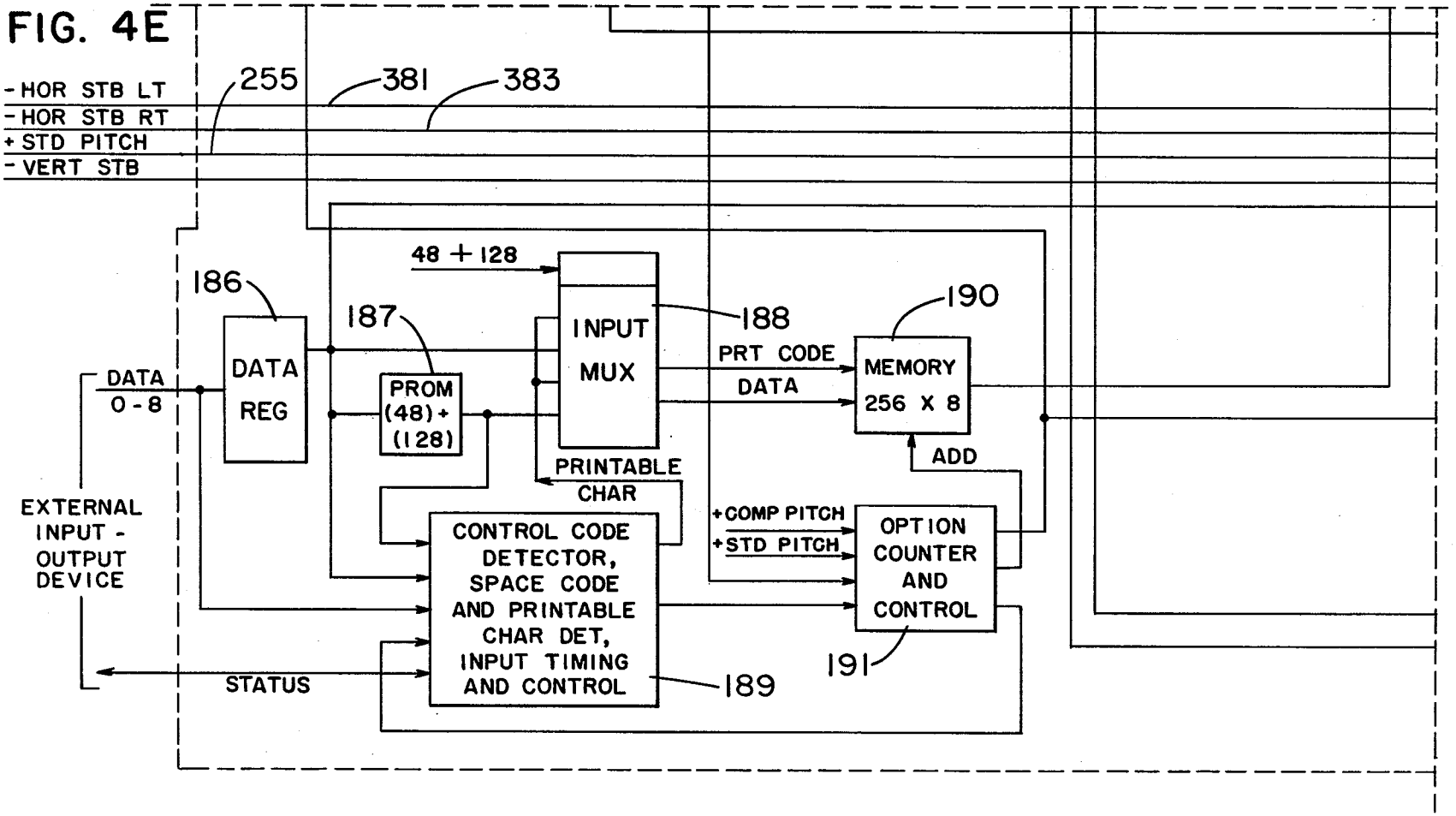

There is provided output option counter control 173, band code generator control 177, and shift register step control 175, which are associated with the print line buffer (PLB) or memory 190 such that when the print line buffer, shown in FIG. 4E, is filled as determined by the output option counter control 173, and when a subscan pulse occurs and the subscan 4 of the scan is present, the option cycle begins. At the beginning of an option cycle, the option counter 173 is preset to either decimal 52 (256−52=204 memory locations) or decimal 120 (256−120=136 memory locations depending upon whether a compressed pitch band or a standard pitch band, respectively, is on the machine. During the option cycle, each location in the print line buffer is compared to the contents of the band code generator 179 and a compare is transmitted to the hammer driver registers by the line 457, as mentioned above. The shift register step control 175 transmits the shift register steps to the hammer drivers by line 527. This signal is sent to the hammer drivers only when a particular hammer is in front of a particular print column. The shift register step control 175 contains a counter which is preset initially to zero at the beginning of the option cycle. As the print line buffer 190 is successively incremented, the shfit register step counter is incremented between zero and one (see Table E) for the two position standard pitch machine and between zero, one and two (see Table F) for the three position compressed pitch machine. The shift register step counter therefore repeats the counts zero and one for the standard pitch mode and zero, one and two for the compressed pitch mode. When the contents of the shift register step counter match the horizontal position counter, a shift register step signal 527 will be transmitted to the hammer drivers. In this manner, it is only when a hammer covers a particular print position that a compare or lack of compare is valid and the compare signal 457 is loaded into the hammer driver shift register via the shift register step signal 527. The band code generator control 177 controls the manner in which the band code generator is incremented during an option cycle. As can be seen from Table A for the standard pitch machines, as the Print Columns are successively incremented (this corresponds to incrementing the option counter in block 191 which addresses the print line buffer or memory 190 in FIG. 4E) every 4 times, the band code generator is incremented only 3 times; hence, when a standard pitch band is on the machine, 4 successive increments of the option counter requires only 3 increments of the band code generator. In like manner, by inspecting Table B, it can be seen that when a compressed pitch band is on the machine, two successive increments of the option counter requires only one increment of the band code generator. This represents the basic manner in which the band code generator control 177 controls the band code generator in logic block 179 in FIG. 4C. The band code generator, in logic block 179, which when incremented in the above manner, indicates which character on the band will be in front of the particular print columns during the next scan period.

After data is loaded, after the completion of the option cycle, after the paper motion has settled and at the beginning of a subscan pulse in which the subscan register count is equal to four, the print cycle may begin. In this respect, the print cycle is seen to be operated wherein the hammers are caused to be fired for which comparisons of the previous option cycle were made, and while these hammers are being fired, the hammer driver shift registers are being loaded through a new option cycle in preparation for the next scan period.

Figure 4F:
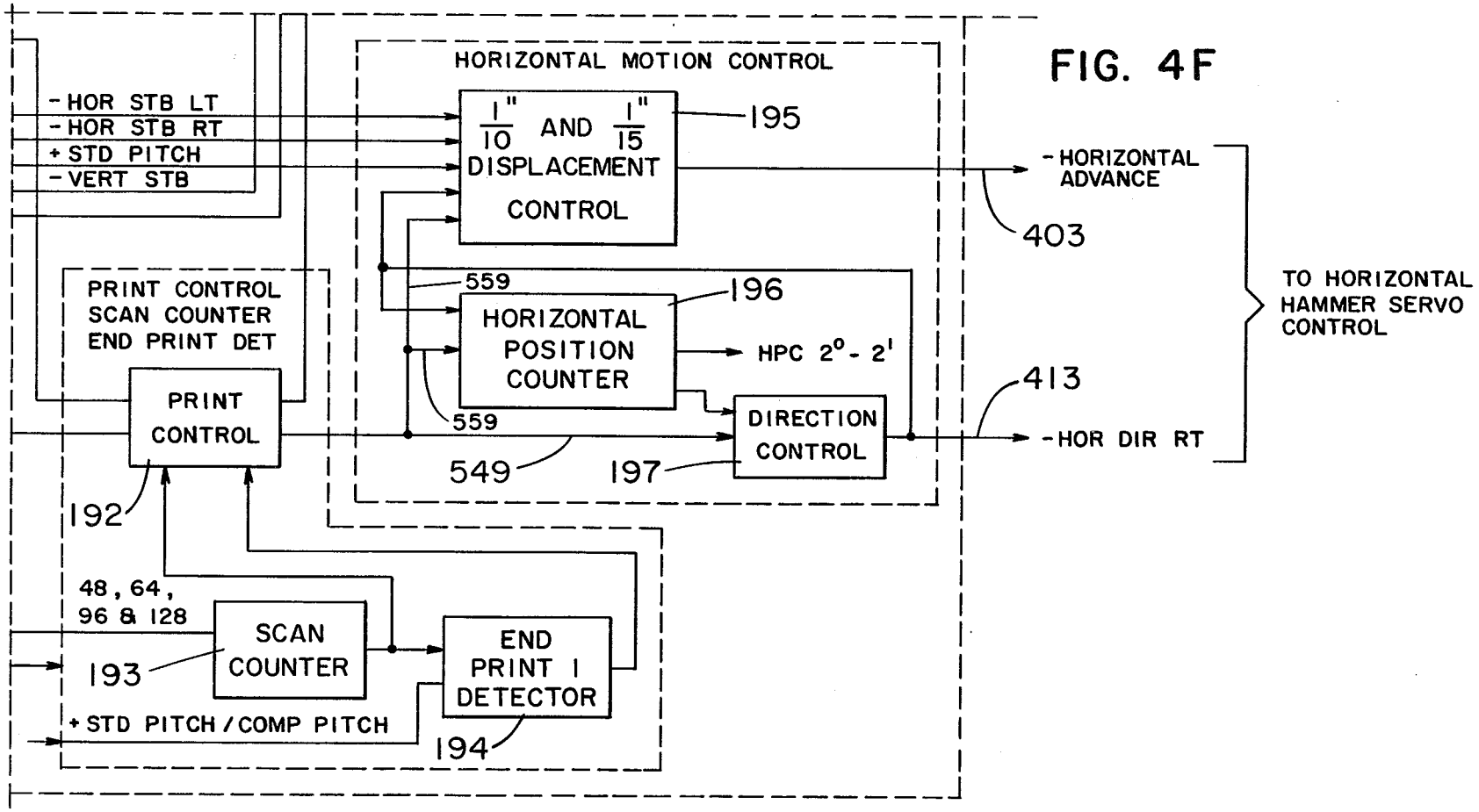
Figures 32A, 32B:
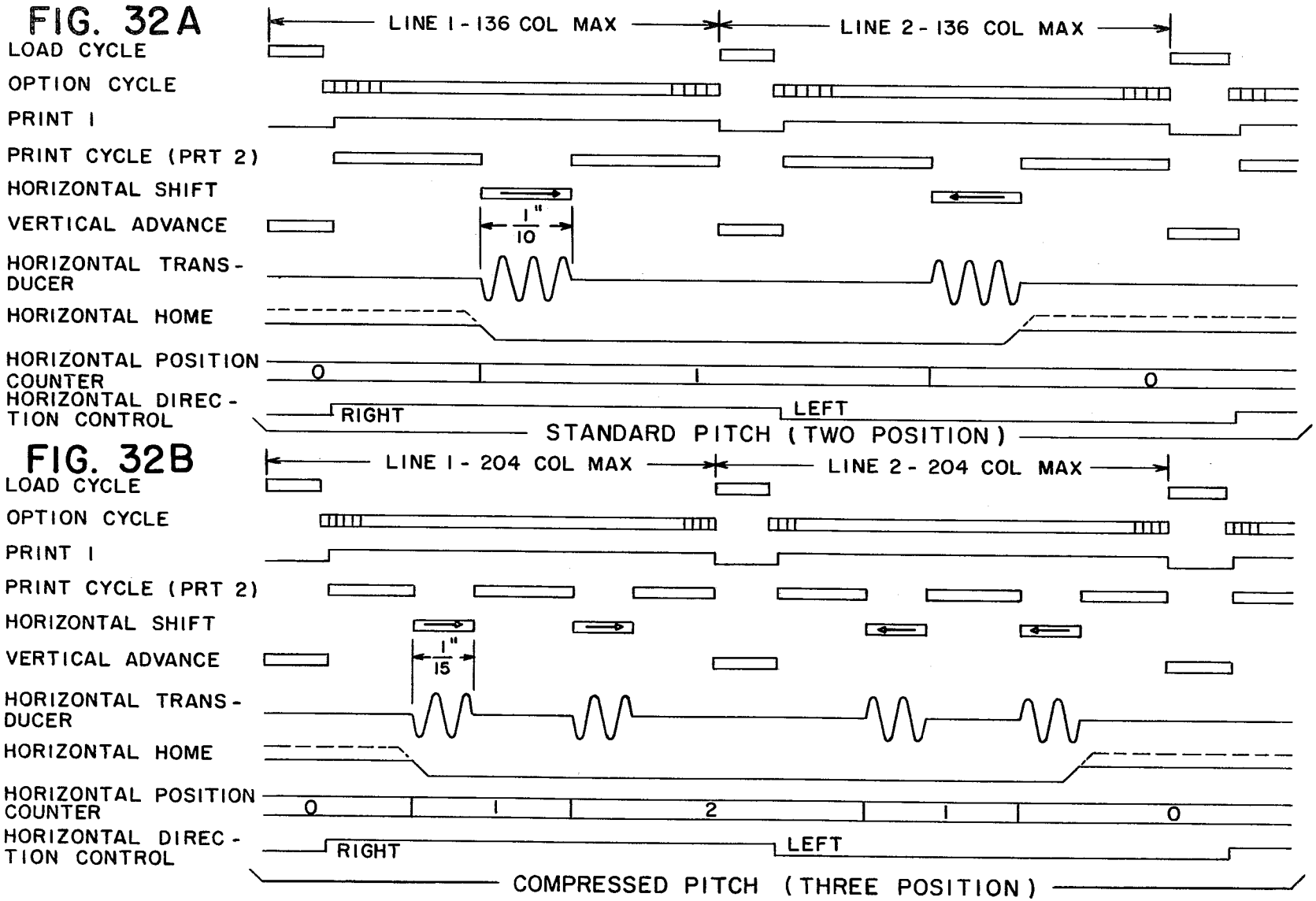
FIGS. 32A and 32B constitute timing diagrams of the major print cycles for standard pitch and compressed pitch, respectively.

The print control logic 192 shown in FIG. 4F provides a print one and a print two timing cycle (see later FIGS. 32A and 32B) wherein the scan counter 193 controls the number of scans for which hammers may be fired during the print 2 period. At the beginning of a print 2 period, the scan counter 193 is loaded to a count which is determined by the type band on the machine, the scan counter being used to count the number of scans during a print 2. The number of scans is determined by the character set length (48, 64, 96, 128) on the band. A standard pitch or a compressed pitch signal is input to an end print 1 detector 194 which also receives an input from the scan counter 193, the output of detector 194 being sent to the print control 192. The primary function of the end print 1 detector 194 is to reset print 1 only after the required number of print 2 periods are completed. See FIGS. 32A and 32B. As shown, two print 2 periods occur for every print 1 in a standard pitch two position machine (FIG. 32A) and three print 2 periods for every print 1 in a 3 position compressed pitch machine. The timing of the print control 192 is such that print 1 resets prior to a print 2 cycle when a print cycle is complete (all print positions optioned to all possible band characters). Therefore at the completion of each print 2 cycle, a horizontal shift occurs via a signal 559 to the 1/10 inch and 1/15 inch displacement control 195, FIG. 4F, if print 1 is set. If print 1 is not set, a paper advance may be initiated via a signal 563 to the vertical paper advance logic 185, FIG. 4D. These basic cycles are shown in FIGS. 32A and 32B. The standard and compressed pitch signals are brought into the end print 1 detector to allow two print 2's in the standard pitch or three print 2's in the compressed pitch. During the time of the print 2 cycle, the signals to the hammer drivers are transferred from the hammer driver shift register to the respective drivers for firing the hammers.

The hammer enable pulse logic 183, which is enabled during a print 2 cycle, receives timing signals from the subscan timing generator and subscan register 165, and generates the HEP 1 signal 683 and the HEP 2 signal 681, which signals actually fire the hammer groups for which compares have been transferred from the hammer driver shaft registers to the hammer driver latches. The hammer groups which respond to the hammer enable pulses (HEP) are a function of the type of band, the position that the hammer bar is presently located and the subscan period. The basic algorithm used in developing the variables controlling the HEP signal generation are given by the logic equations following Tables J and K. It should also be noted during every subscan pulse 365, FIG. 4C, which occurs during a subscan register 4 period, that the contents of the hammer driver shift register is cleared via the shift register clear signal 601, FIGS. 4D and 4B. In addition it is only during a print 2 cycle, but not in the last scan of a print 2 cycle, that the contents of the hammer driver shift registers are transferred to the hammer driver latches via the shift register transfer to hammer driver signal 615, FIGS. 4D and 4B. This signal 615 is transmitted just prior to the shift register clear signal 601, FIGS. 4D and 4B.

In FIG. 4E is shown the input data of eight bytes coming from the external input/output device and going into the data register 186. The output from data register 186 is fed to the input multiplexer 188 and to a programmed read only memory (PROM) 187. The input multiplexer 188 can be selected depending upon the type of band to either take the data register input or the PROM input and transmit that data to the print line buffer 190. It should be here noted that the PROM 187 is used for only the 48 character or the 128 character band and is not utilized with both bands. The status of the data is controlled by means of input timing and control logic 189 wherein the actual data is decoded for a control code and if a control code is found in the data stream, the transmission of such data is terminated and the remaining portions of memory are filled with space codes or unprintable characters. As mentioned above, the PROM 187 is utilized for a 48 character band or for a 128 character band, and the memory must be changed if both a 48 character and a 128 character band are utilized. The 64 and the 96 character bands use ASCII codes. Depending on the type band on the printer, the input multiplexer 188 selects either the data register 186 or PROM 187 outputs as input to the memory (Print Line Buffer) 190. If a 64 or 96 character band is on the printer, the data register 186 contents are passed through the input multiplexer 188 to the memory 190, otherwise the PROM 187 contents are passed to the memory. Only 7 data bits are passed directly between the data register 186 or PROM 187 to memory 190. The eighth bit stored in memory 190 is termed memory print code and will essentially only be active if legal data codes are transmitted into memory. It will not be active for space codes or illegal data codes transferred to memory 190. This primarily allows the transmission of a space code in memory which will compare to a position on the band but not be printed because the memory print code bit is not active.

The input timing and control also controls the option counter and control 191 which addresses the print line buffer 190. At the beginning of each load cycle, the option counter is preset to a finite number, this being 120 for a standard pitch band and 52 for a compressed pitch band. This provides the necessary addressing to either place 136 (256-120) characters in the buffer 190 for a standard pitch band or 204 (256-52) characters in the buffer for a compressed pitch band.

In FIG. 4F is shown the horizontal motion control which consists of displacement control 195, the horizontal position counter 196, and the direction control 197. Inputs shown to the displacement control are horizontal strobe left 381, horizontal strobe right 383, standard pitch 255, horizontal motion enable 559, and a direction signal from the direction control 197. The output of displacement control 195 is a horizontal advance signal 403 which commands the horizontal servo logic 164 (FIG. 4A) to move the hammer bar 210 (FIG. 4B) either 1/15 inch or 1/10 inch depending upon the state of the standard pitch signal 255. The direction which the hammer bar 210 moves is controlled by the horizontal direction right signal 413 which is connected to the horizontal servo logic 164. The horizontal motion enable signal 559 from the print control 192 is connected to the logic blocks 195 and 196. This signal causes the horizontal advance active signal 403 to become active and also increments or decrements the horizontal position counter 196 depending upon the direction specified by the direction control 197. Once initialized, the direction control 197 is maintained by checking the count of the horizontal position counter 196 when the print 1 signal 549 becomes active—right if the horizontal position counter is 0 and left if it is not 0. The output of the direction control 197 also selects either signal 381 or 383 as the clock input in the displacement control logic 195, 381 being selected if the direction control 197 is specifying left, otherwise 383 is selected.

In FIG. 4D is also shown a clock generator 184, the outputs of which are clock 2 pulses, phase 1 clock pulses, phase 2 clock pulses, and the hammer driver clock pulses which pulses go to the hammer drivers and which relationships will be further described in the overall system.

Prior to discussing the detailed logic diagrams, it should be stated that certain of the elements, components, and devices shown and described herein have been assigned identifying generic equivalent type numbers taken from The TTL Data Book, as published by Texas Instruments, Inc., Copyright 1973. The purpose of this is to provide specific and particular description of the various devices utilized in the present invention. Several of the devices used in the invention are a two input AND gate, type number 7408, a two input OR gate, type number 7432, an inverter, type number 7404, a two input NAND gate, type number 7400, and a two input NOR gate, type number 7402, and these devices will not be further described by reason of the common usage thereof. Additionally, it should be noted that when a pulse or signal is minus, such signal is at a logical zero and is active.

Figure 5:
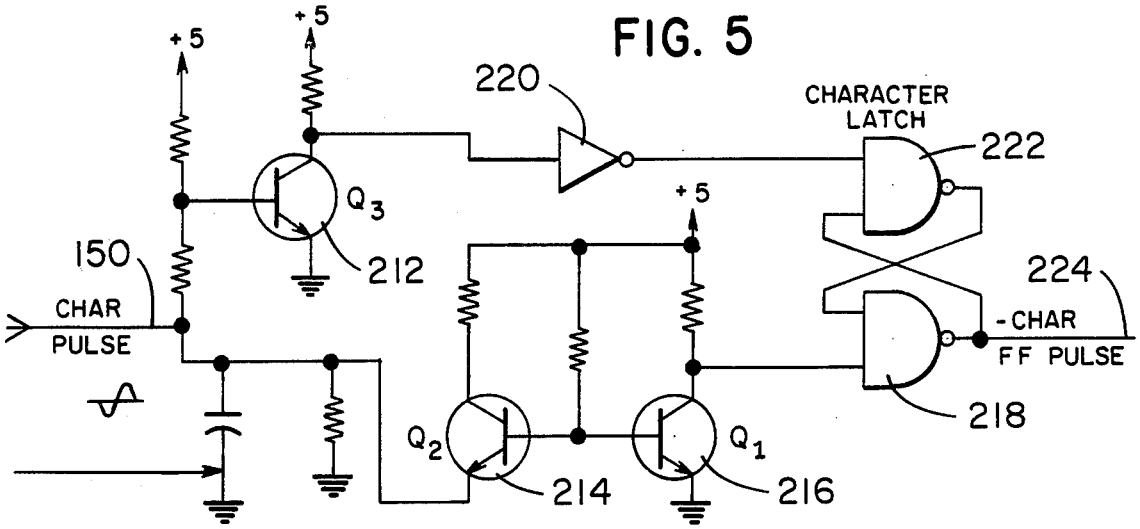
FIG. 5 is a schematic diagram of the circuitry and the logic for a portion of the character pickup pulse shaper.

FIG. 5 shows a circuit employed in the character pulse pick up wherein, upon sensing a character pulse or mark 204 (FIGS. 10 and 11) on the print band 54, such pulse is sent to the character pulse shaper which digitizes the sinusoidal input from the character mark pickup, as the pulse signal starts to swing negative, crosses 0 volts, the Q2 transistor 214 is turned on, causing the Q1 transistor 216 to be turned off, thus removing the reset input to NAND gate 218 of a cross-coupled latch. As the character pulse 150 swings further negative, approximately −1.2 volts, transistor 212 is turned off, a high signal is provided to the inverter 220 where the signal is inverted to provide the set input to NAND gate 222 of the cross-coupled latch, such quad two input NAND gates 218 and 222 making up the character latch. The negative or minus character flip-flop pulse signal 224 is generated until the sine wave swings from a negative value to approximately zero crossover or 0 volts. As the sine wave reaches approximately −1.2 volts, Q3 transistor turns on, a low signal is provided to inverter 220 when the signal is inverted to provide a high signal to the NAND gate 222 of the cross-coupled latch which removes the set signal to the latch. When the character pulse signal 150 reaches approximately 0 volts transistor 214 is turned off, transistor 216 turns on and a reset signal is applied to NAND gate 218 which resets the cross-coupled latch. The latch is then reset, the output thereof being sent by the lead 224 to a character trigger pulse one-shot device, shortly described, the output of which device is inverted by an inverter, the output of such inverter being a positional feedback signal to the band motor control circuitry.

Figure 6:
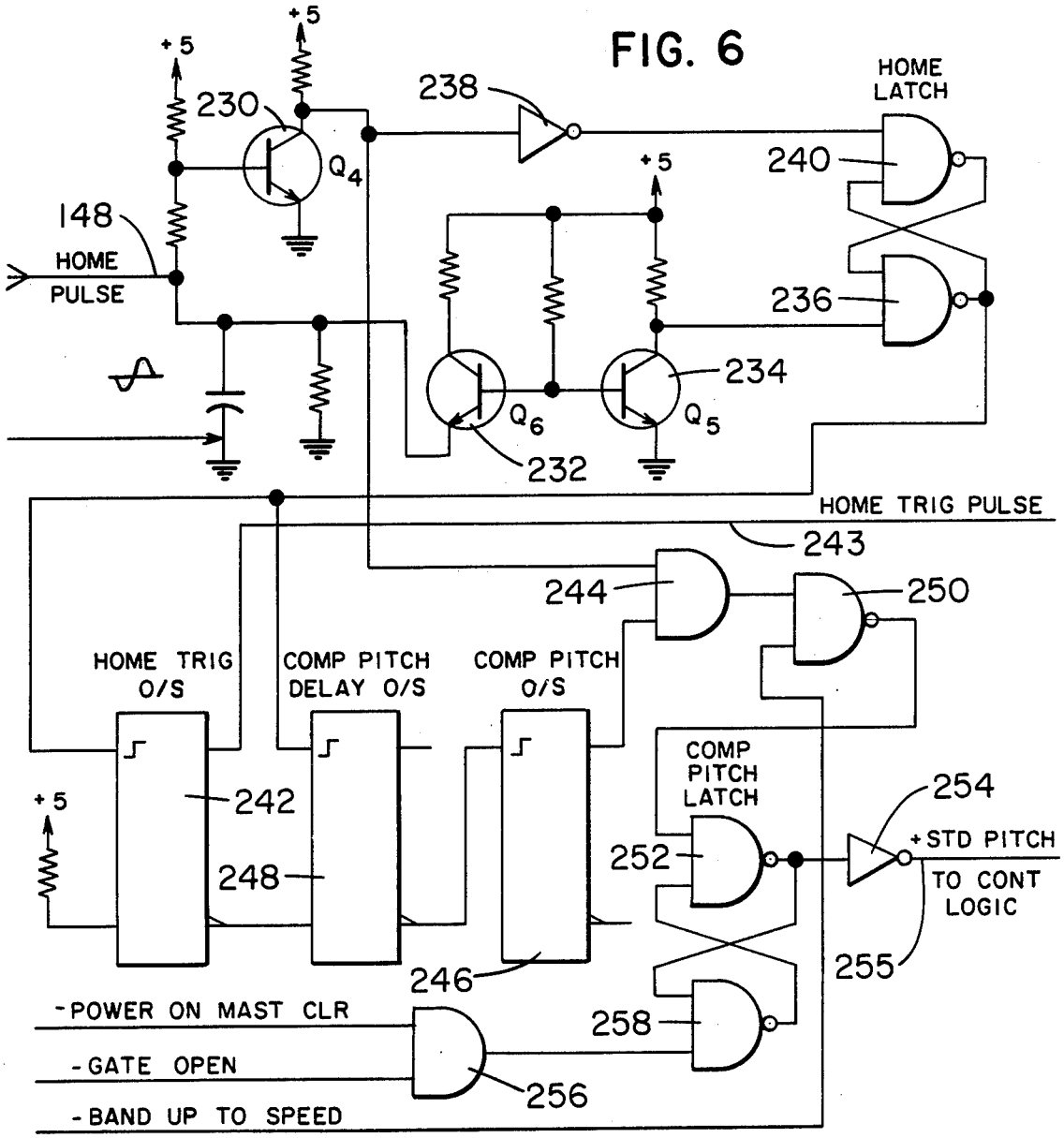
FIG. 6 is a schematic diagram of the circuitry and the logic for the home pickup pulse shaper and standard or compressed pitch detector.
Figure 31:
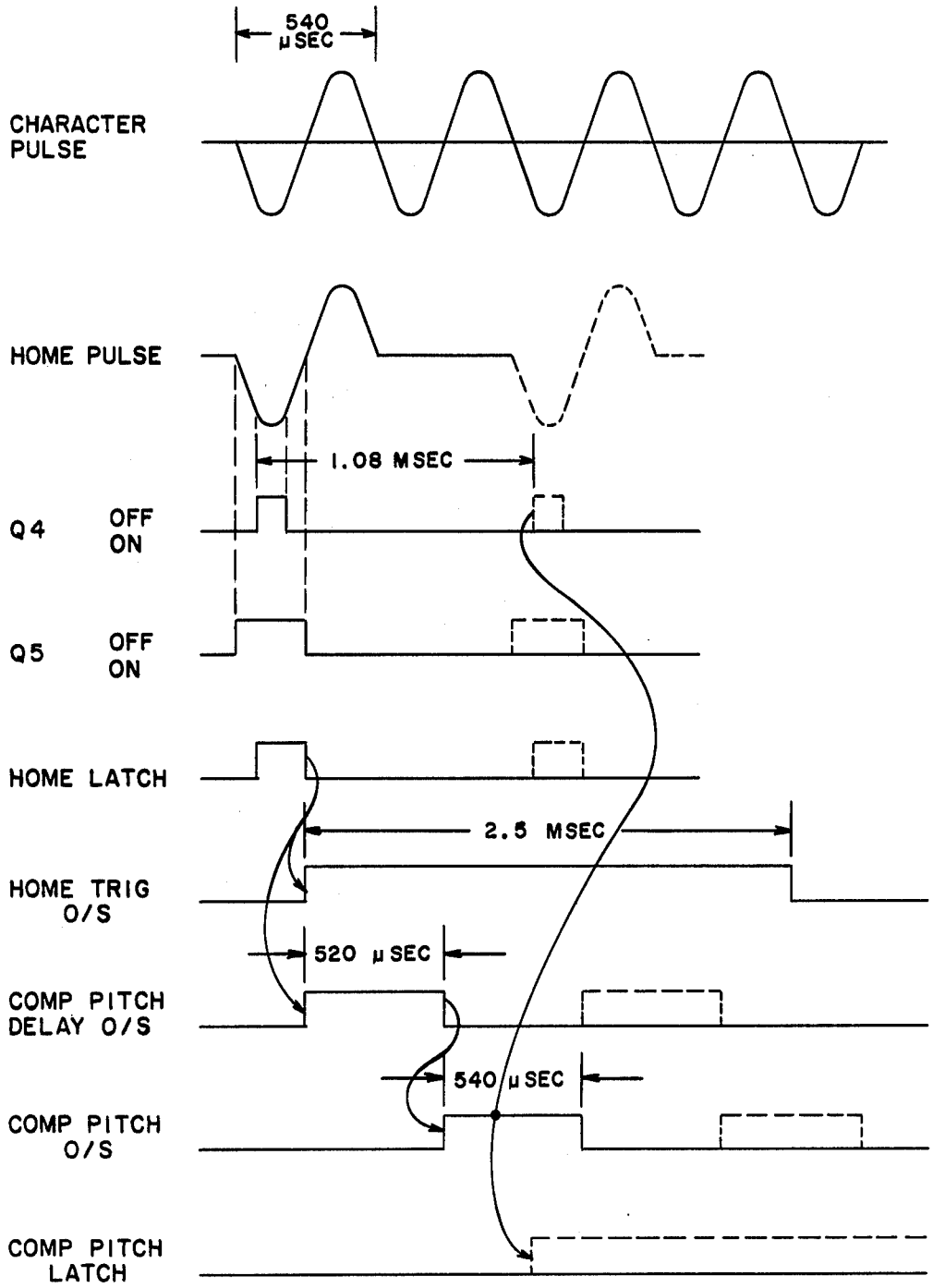
FIG. 31 is a showing of the wave shape and timing diagram for character pulse and home pulse operation with compressed pitch detection associated with FIGS. 5 and 6.

FIG. 6, the timing diagram of which is shown in FIG. 31, shows an identical circuit shown and described in FIG. 5 in the home pulse pick up wherein, upon sensing a home pulse or mark 202 or 203 on the print band 54, such pulse is sent to the home pulse shaper 144 which digitizes the sinusoidal input from the home mark pickup. The various elements or devices, i.e., transistors 230, 232, and 234, inverter 238, and NAND gates 236 and 240 comprise the above circuit. Additionally, in FIG. 6, circuitry is provided to detect or sense the presence of a second home pulse 203 on FIG. 11 and on FIG. 37 which indicates a compressed pitch band. The timing diagram for the circuit is shown on FIG. 31. Of course, if a second home pulse is not detected or sensed by the home pulse pickup, the cross-coupled latch, comprised of NAND gates 252 and 258, will remain reset for a standard pitch character band. The home pulse generated from the mark 202 and 203 on the band 54, as the output signal of NAND gate 236 is utilized to trigger a 2.5 millisecond home trigger one-shot device or dual monostable multivibrator 242, type number 74221, with the output of such device 242 being a home trigger pulse 243 to a home trigger pulse oneshot device, shortly described. The output signal from transistor 230 is one input to a quad two input AND gate 244, the other input to AND gate 244 being derived from the output of a 540 microsecond compressed pitch one-shot device or dual monostable multivibrator 246, type number 74221, which device receives an input from a 520 microsecond compressed pitch delay one-shot device or dual monostable multivibrator 248, type number 74221, the input to same being the output of NAND gate 236. The output of AND gate 244 serves as one input to NAND gate 250, the second input being the band up to speed level, which signal is available approximately 5 seconds (see FIG. 7) after the band motor is energized. The output of NAND gate 250 serves as an input to NAND gate 252 of a cross-coupled latch, there being an inverter 254 in the output of NAND gate 252 which signal is sent to the control logic by a lead 255 as a plus standard pitch signal. A power on master clear signal and a gate open signal are provided as inputs to AND gate 256, the output of which is one input of NAND gate 258 of the compressed pitch latch, such quad two input NAND gates 252 and 253 making up such compressed pitch latch. Any time the gate is opened, a band can be installed on the machine, therefore at this time the compressed pitch latch is reset. Once the band is up to speed, the compressed pitch latch comprising NAND gates 252 and 258 is set if a compressed pitch band is installed, or the latch will remain reset if a standard pitch band is installed.

Figure 7:
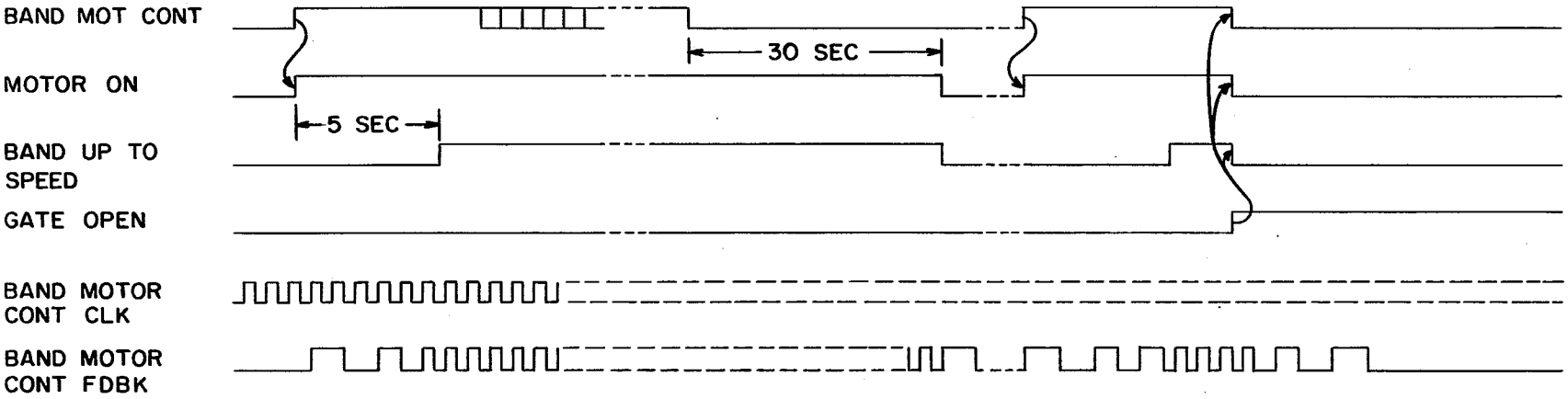
FIG. 7 is a timing diagram of the band motor control.

FIG. 7 shows the timing of the band motor control (BMC) wherein the motor speed reference signals (the character pulses) are compared with the clock pulses. A showing of the band motor control feedback pulses 142 (see FIG. 4A and FIG. 9) is made to indicate variations therein as compared to the clock pulses. At a given time after the band motor is turned on, (e.g. five seconds) the band is up to speed. Additionally, if no printing operation is performed for thirty seconds, the band motor turns off. The signal line 142 (FIG. 4A) is the feedback from the character pulse of the band. The character pulses are at a prescribed distance apart, so that the time duration between pulses can be monitored and the band motor control circuitry can adjust the voltage to maintain the band at a constant speed. The clock signal shown in FIG. 7 is compared to the signal line 142 to adjust the motor speed. When the band motor is turned on, the hammers are set in the home position.

Figure 8:
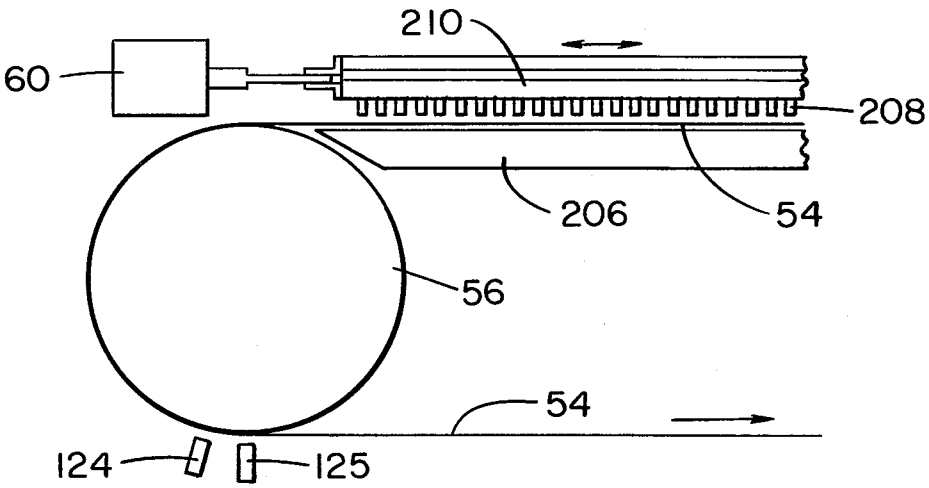
FIG. 8 is a plan view of a portion of the hammer bar assembly relative to the character band.

In FIG. 8 is shown a plan view of a portion of the print band 54 trained around the drive pulley 56 and directed in a path along a platen 206 and past the printing station and positioned to be impacted by the print hammers 208 supported from a hammer bar assembly 210 forward of the hammer bank 18 (FIG. 1), the bar assembly 210 being securely connected to a drive motor in the form of the voice coil 60. The voice coil 60 is controlled by a closed loop servo circuit to actuate the coil for driving or moving the hammer bar assembly 210 in a reciprocating motion horizontally along the platen 206 and the printing station in a time sharing of the hammers. The character mark transducer 124 and the home mark transducer 125 are shown adjacent the band 54.

The character and home pulses are generated from the moving print band 54 which is moving at a rate of 246 inches per second and wherein at this speed there is an approximate time of 540 microseconds between each character. It should be here noted that the distance between characters on the band 54 is 4/30 inch, such dimension playing an important part in the operation of the invention. The time for a complete character set to pass a given print column on the paper varies with the size of the character set, whether it is a 48, 64, 96 or 128 character font. During print 2 (see FIGS. 32A and 32B), the passage of one complete character set past print column 1 position is required for each horizontal position of the hammer bar. Two pulses are generated by the band 54 when the band is in motion, a character pulse being generated for each band character with a total of 384 character pulses for each band revolution, and one home pulse 150 being generated from mark 202 for each character font or set in a standard pitch band 54A and two home pulses from marks 202 and 203 for a compressed pitch band 54B, the number of home pulses per band revolution varying with the size of the character font. The home pulse for each character set or font is read or magnetically picked off by the transducer 125 mounted adjacent the transducer 124 and such pulse is used to synchronize the printer circuitry and control logic with the band. The control logic counts the number of character pulses between each home pulse 275 to automatically determine or detect the size of the character font.

Figure 10:
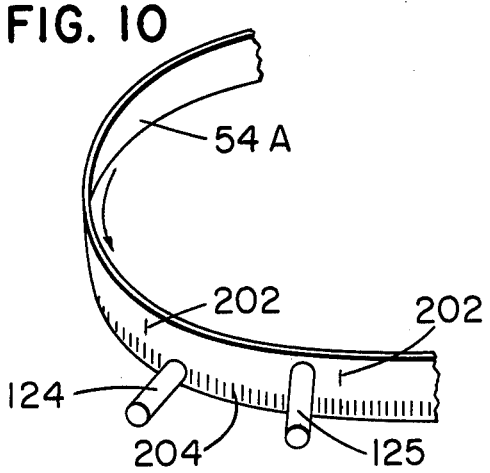
FIG. 10 is a view of a portion of a character band for standard pitch.
Figure 11:
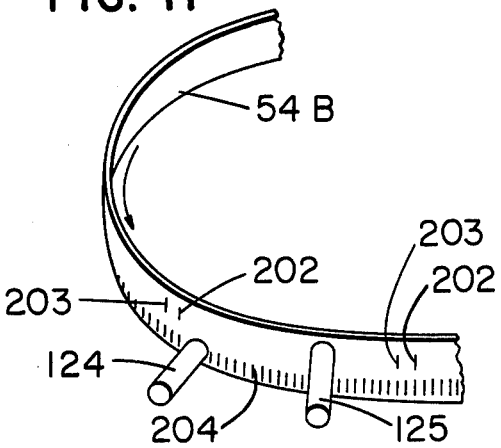
FIG. 11 is a view of a portion of a character band for compressed pitch.

The home pulse enable signal 268, (see FIGS. 4A and 20) which is generated once per character mark from the 1 character pulse to 4 subscan pulse logic 156, later described, is used as an input to a home to character pulse synchronization circuit, shown in FIG. 9, which electrically compensates for any mechanical misalignment between the character pulse transducer 124 and the home pulse transducer 125, also shown in FIGS. 10 and 11. The adjustment of a home pulse synchronization one-shot device 262 (FIG. 9) allows the home pulse 275 to be positioned relative to any one of five character pulses. The timing of this circuit is shown in the lower portion of FIG. 33. The character pulse, as 224 from FIG. 5, triggers a character trigger pulse one-shot device or dual monostable multivibrator 260, type number 74221, and the home trigger pulse 243 (FIG. 5) triggers a home pulse sync one-shot device or dual monostable multivibrator 262, type number 74221, whereupon a home enable flip-flop 264 or dual J-K master/slave flip-flop, type number 74107, is set on the trailing edge of the one-shot 262. When a home pulse enable signal 268 is generated during the fourth subscan for the character pulse, AND gate 270 is enabled and a home pulse 269 is generated. When the home pulse enable signal drops, the reset of a home pulse one-shot device or dual monostable multivibrator 272, type number 74221, is triggered and the pulse resets both flip-flops 264 and 266 to complete the synchronizing operation. The output of AND gate 270 is sent through an inverter 274 as a home pulse signal 275 to the controller, and the output of the character trigger pulse one-shot device 260 is sent through an inverter 276 as the band motor control feedback signal 142 to the band motor control. The output of the character trigger pulse one shot device 260 is sent to the phase and voltage compensation delay 152 (FIGS. 4A and 9), the output of which is a subscan start pulse to the one character pulse to four subscan pulse logic 156 and then to the control logic.

The home pulse 148 (FIGS. 4A and 6) also indicates to the print head electronic circuitry as to whether the band is a standard or a compressed pitch, the standard pitch band generating one home pulse at the beginning of each font, whereas on the compressed pitch band there are two home pulses generated at the beginning of each font. As see in the partial showing of the band 54 in FIG. 10, wherein the band is designated as 54A, a standard pitch band, such band contains two sets of raised lines or marks, the upper set of marks 202 being the home pulse lines for the character fonts and the lower set of marks 204 being the character pulse lines. Since each and every band is of identical length and contains 384 characters thereon consisting of one or another of the font sets as mentioned above, such band contains 384 of the marks 204 which are magnetically read by the transducer 124. A mark or pulse line 202 is provided for the first character of each font set to identify the number of sets on the particular band and gives the relationship between marks 202 and 204. In the case of standard pitch characters on the band 54A, one of such marks 202 is provided for the first character of each font whereas in the case of compressed pitch characters, as seen on the band 54B in FIG. 11, two of the marks, 202 and 203, are provided for the first and third characters of each font. As these lines pass the transducers 124 and 125 mounted on the latch end of the gate structure 16, the transducers or pulse pickup devices generate sine wave signals, as seen in FIGS. 5, 6, and 31 which have a negative swing of $-1.8$ volts followed by a positive swing of $+1.8$ volts. As mentioned earlier, the printer electronics automatically detects a standard pitch band 54A or a compressed pitch band 54B whichever is installed on the printer. The compressed pitch band has the two home pulse generating marks 202 and 203 instead of the one home mark 202 as on the standard pitch band. The first home pulse generated triggers the one-shot device 262 and if a second home pulse is generated within the one millisecond time out of the one-shot device, the device is enabled and the compressed pitch latch is set. The appearance of a second home pulse within one millisecond of the first home pulse can only occur when a compressed pitch band is installed on the machine. The circuitry shown in FIG. 5 plus the one-shot device 260 shown in FIG. 9 generally comprise the character pickup pulse shaper logic 146, as seen in FIG. 4A. Additionally, the circuitry shown in the upper portion of FIG. 6 generally comprises the home pickup pulse shaper logic 144, and the circuitry shown in the lower portion of FIG. 6 generally comprises the standard or compressed pitch detector logic 162, as seen in FIG. 4A.

Figure 9:
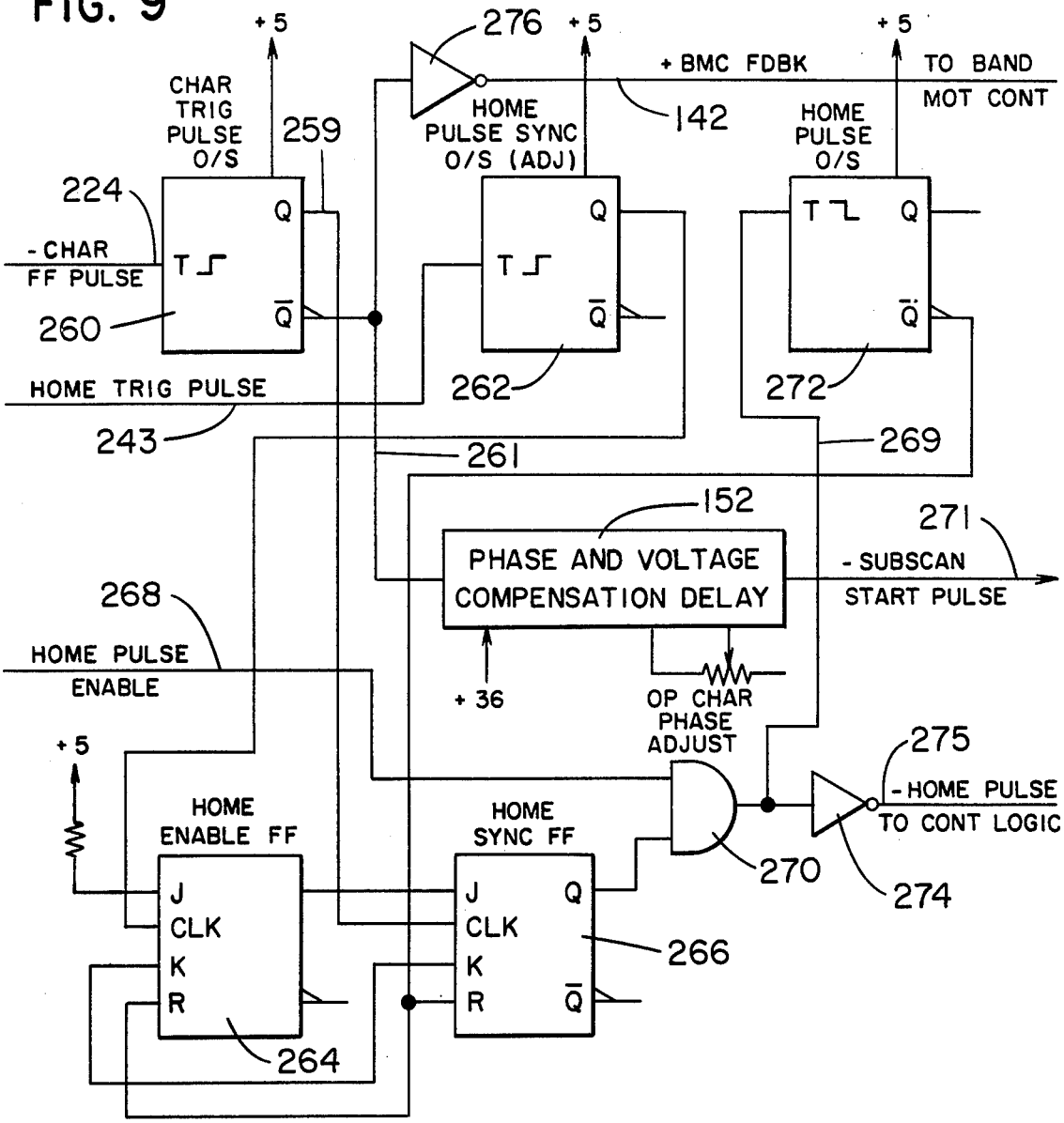
FIG. 9 is a logic diagram for a portion of the character pickup pulse generator, the one home pulse per character set logic, and the phase and voltage compensation delay.

The subscan compensation or phasing circuitry 152, as seen in FIG. 4A and FIG. 9, utilizes an analog network which electrically adjusts the start of the subscans corresponding to the voltage level of the +36 volt supply and the position of the phasing control potentiometer. By adjusting the start of the subscans, the firing time of the hammers is also adjusted accordingly wherein if the +36 volts is low or the phasing control is adjusted for single part forms, the hammers are fired early. Correspondingly, if the +36 volts is high or the phasing control is adjusted for multiple-part forms, the hammers are fired later. The analog compensation network automatically adjusts for the 36 volt condition or any combination of these conditions.

Since the hammers are time shared, the horizontal servo logic receives one signal from the control logic on when to operate the horizontal advance and another signal as to which direction to move the hammers. As briefly mentioned above, the horizontal shift of the hammer bar assembly is derived by means of the linear drive voice coil 60 that is closed loop servo controlled to position the hammer bar for printing. For standard pitch operation, the bar is moved in increments of 1/10 inch and when the compressed pitch is used, the bar is moved in increments of 1/15 inch. The movement of the bar is sensed through the use of a light source, a photoelectric sensor, and a grid mounted on the end of the hammer bar. As the grid moves between the light source and the sensor, a sign wave signal is generated every 1/30 inch. During standard pitch operation, every third pulse signifies one complete horizontal shift while every second pulse signifies a complete shift during compressed pitch operation. Depending upon the machine speed and the number of hammer positions, the number of shifts of the hammers necessary to print one complete line is covered by a standard machine wherein four shifts of the hammer bar are used as compared to a compressed machine where six shifts of the hammer bar are used. In the higher speed machine, the number of shifts is reduced to two shifts for a standard machine as compared to three shifts for a compressed pitch machine.

Figures 12A, 12B:
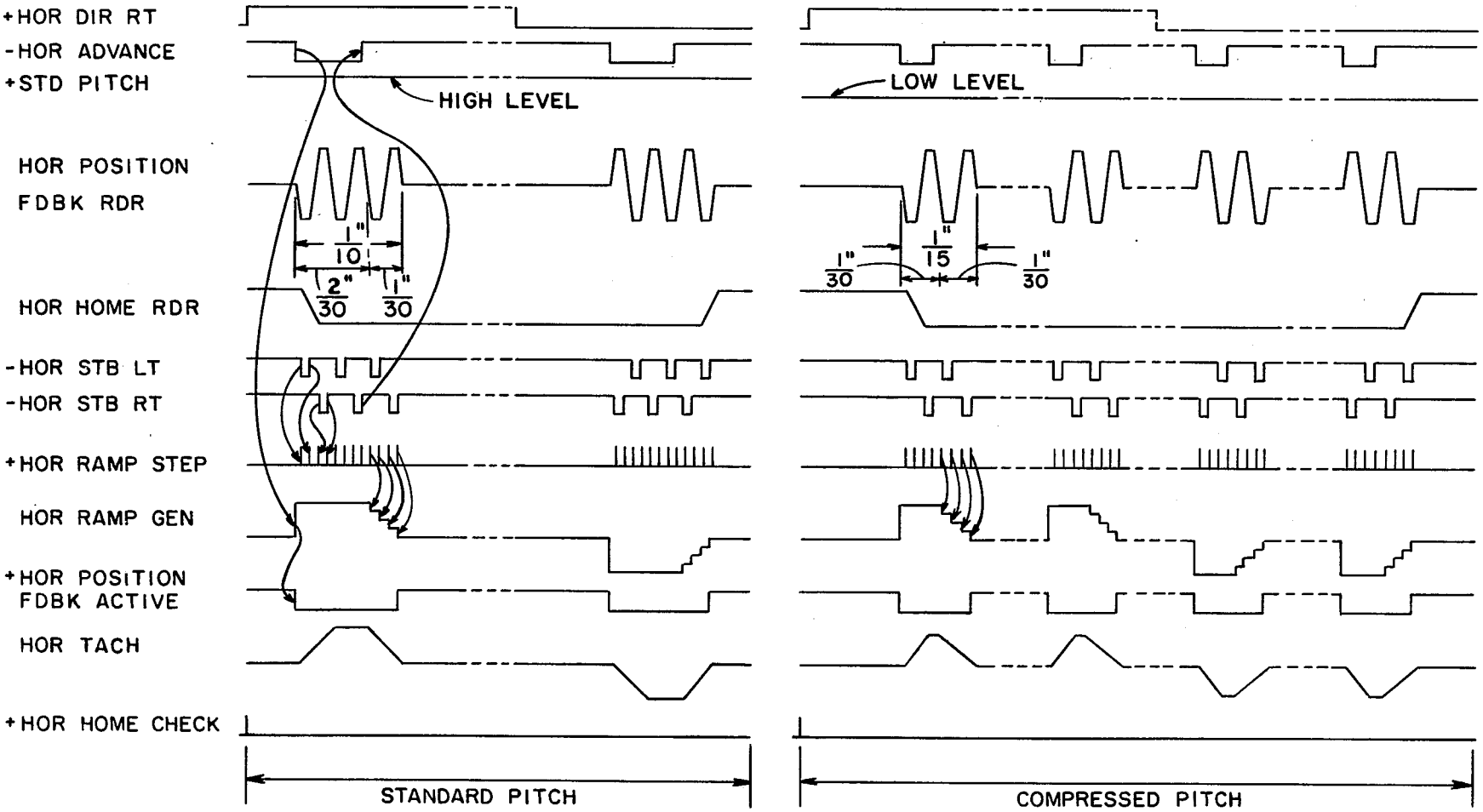
FIGS. 12A and 12B constitute timing diagrams of the horizontal shifting of the hammers for standard pitch and compressed pitch, respectively.

FIG. 12A shows a timing diagram of the shifting of the hammers for standard pitch and FIG. 12B shows a similar diagram for compressed pitch. In the case when a standard pitch band is on the printer, the horizontal motion operation is initiated when the horizontal advance signal goes low and the action clears a ramp step shift register wherein the most significant byte of the shift register goes low, a bilateral switch is closed and the reference voltage from a resistor network is fed to one of the inputs of a horizontal ramp generator, the selected input being dependent upon the horizontal direction right signal. If the signal is high, a shift to the right is required, the switch is closed and the reference signal is fed to the lower input of the ramp generator to produce a positive going ramp on the output thereof. If the horizontal direction right signal is low, a shift to the left is required, a switch is closed and the reference signal is fed to the upper input of the ramp generator to produce a negative going ramp at the output thereof. The output of the horizontal ramp generator is summed with a horizontal tachometer, such tachometer signal being opposite in polarity to the ramp signal and the sum of the tachometer and the ramp is inverted and fed to the summing network feeding a comparator device. The summing network sums the error signal with the horizontal current sense, a position feedback signal, and a modulating clock pulse. The comparator inverts the summed input as an output, the polarity of the output determining the direction of the drive of the hammer bar to the right or to the left. A negative going signal provides an active output from the left drive amplifier, while a positive going signal provides an active output from the right drive amplifier. The output of the amplifiers is fed to the horizontal drive switch, which is activated by either signal and provides the input to the voice coil 60 for driving thereof in one or the other direction. When the hammer bar assembly is in the fully left position, the control logic knows that the assembly is in the home or first print column position. A horizontal home check is also made upon initiation of a printing operation.

As further seen in FIGS. 12A and 12B, the distance of motion of the hammer bar is monitored by the horizontal position feedback reader which generates a sine wave signal for every increment of motion of 1/30 inch. When the voice coil 60 is caused to be moved to the right, the sine wave goes negative first, then positive, and when the voice coil is caused to be moved to the left, the sine wave goes positive first and then negative. During a negative swing of the signal, the horizontal strobe left pulse is generated and during the positive swing of the signal, the horizontal strobe right pulse is generated, there being a strobe left and a strobe right for each horizontal position signal. The number of horizontal position pulses necessary to terminate the horizontal motion is determined by the selection of either standard or compressed pitch, the standard pitch mode requiring three horizontal position pulses covering the distance of 1/10 inch, and the compressed pitch requiring two horizontal position pulses covering the distance of 1/15 inch. When moving to the right, on the trailing edges of the first pulse of the compressed pitch or the second pulse of the standard pitch horizontal strobe right pulse, the horizontal advance signal is terminated and when moving to the left, on the trailing edge of the first pulse of the compressed pitch or the second pulse of the standard pitch horizontal strobe left pulse, the horizontal advance signal is terminated. This is shown to be the point after two pulses or 2/30 inch of advance for the standard pitch and the point after one pulse or 1/30 inch of advance for the compressed pitch. When in standard pitch, the standard pitch signal is high and when in compressed pitch, the standard pitch signal is low. During the horizontal advance time, a horizontal ramp step signal is produced for each horizontal strobe left pulse and for each horizontal strobe right pulse. Upon termination of the horizontal advance signal, the reset is removed from the ramp step shift register and the output of the ramp generator is reduced in four steps by the horizontal ramp step signal to provide a controlled rate of deceleration, it being seen that after the second strobe right pulse or 2/30 inch for the standard pitch and after the first strobe right pulse or 1/30 inch for the compressed pitch. The voice coil 60 and the hammer bar assembly are then allowed to decelerate at a controlled rate the remaining 1/30 inch or the distance equivalent to the four steps down of the ramp generator. The contrast between the standard and compressed pitch is also shown for the horizontal tachometer signal as to the difference in time for the respective pulses. The shift register is clocked on the leading and trailing edges of both the horizontal strobe right and horizontal strobe left pulses. Each pulse generates two seven microsecond clock pulses for the register. When shifting to the right, the first two clock pulses are generated by the strobe left pulse and the last two are generated by the strobe right pulse. On the trailing edge of the strobe right pulse the final clock pulse shifts the register activating the most significant stage of the register. The most significant stage of the counter controls the bi-lateral switch and when the stage goes active, the switch opens and the ramp goes to 0 volts thus terminating the shift motion. When shifting to the left, the strobe left pulse generates the final clock pulse which terminates the shift. When the shift is complete, the horizontal position feedback active signal goes high and remains high until the next horizontal advance pulse. This signal prevents any printing from occurring during a shift operation.

Figure 13A:
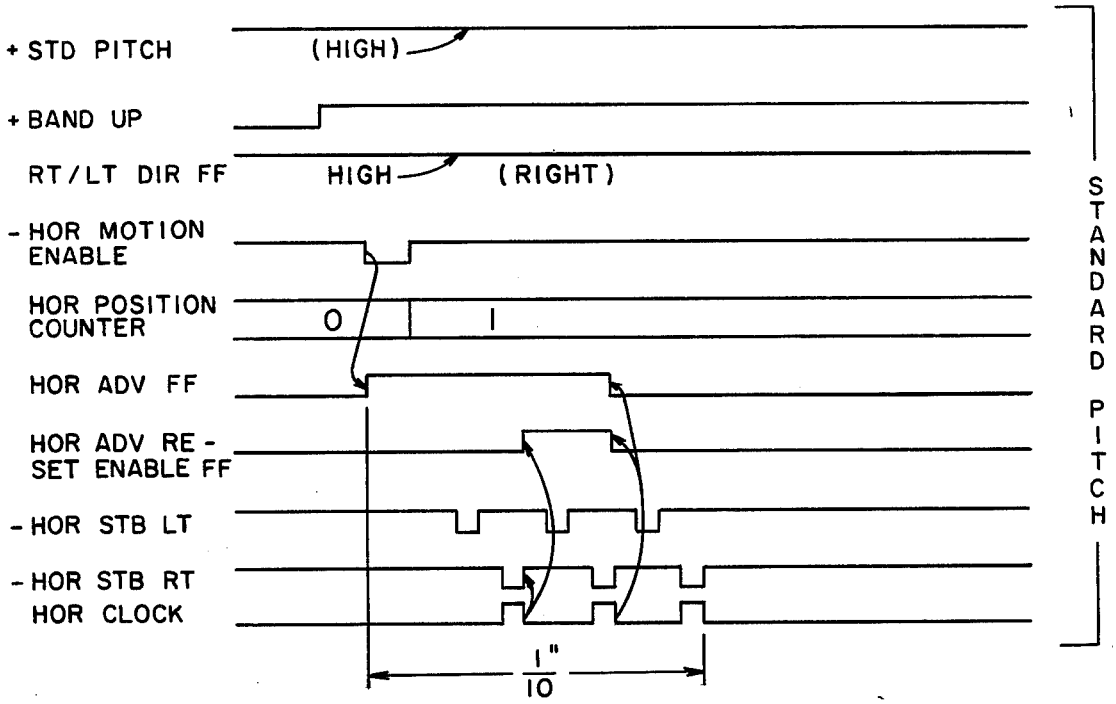
FIGS. 13A and 13B constitute timing diagrams of the horizontal motion cycle of the hammers for standard pitch and compressed pitch, respectively, for the logic shown in FIG. 21.
Figure 13B:
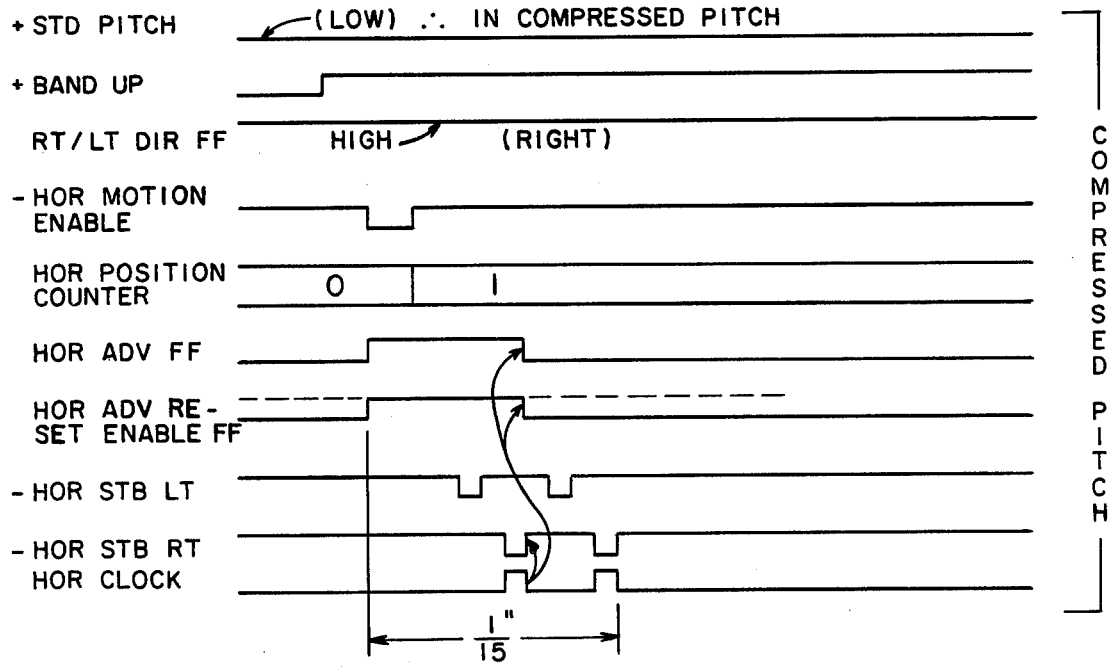
Figure 21:
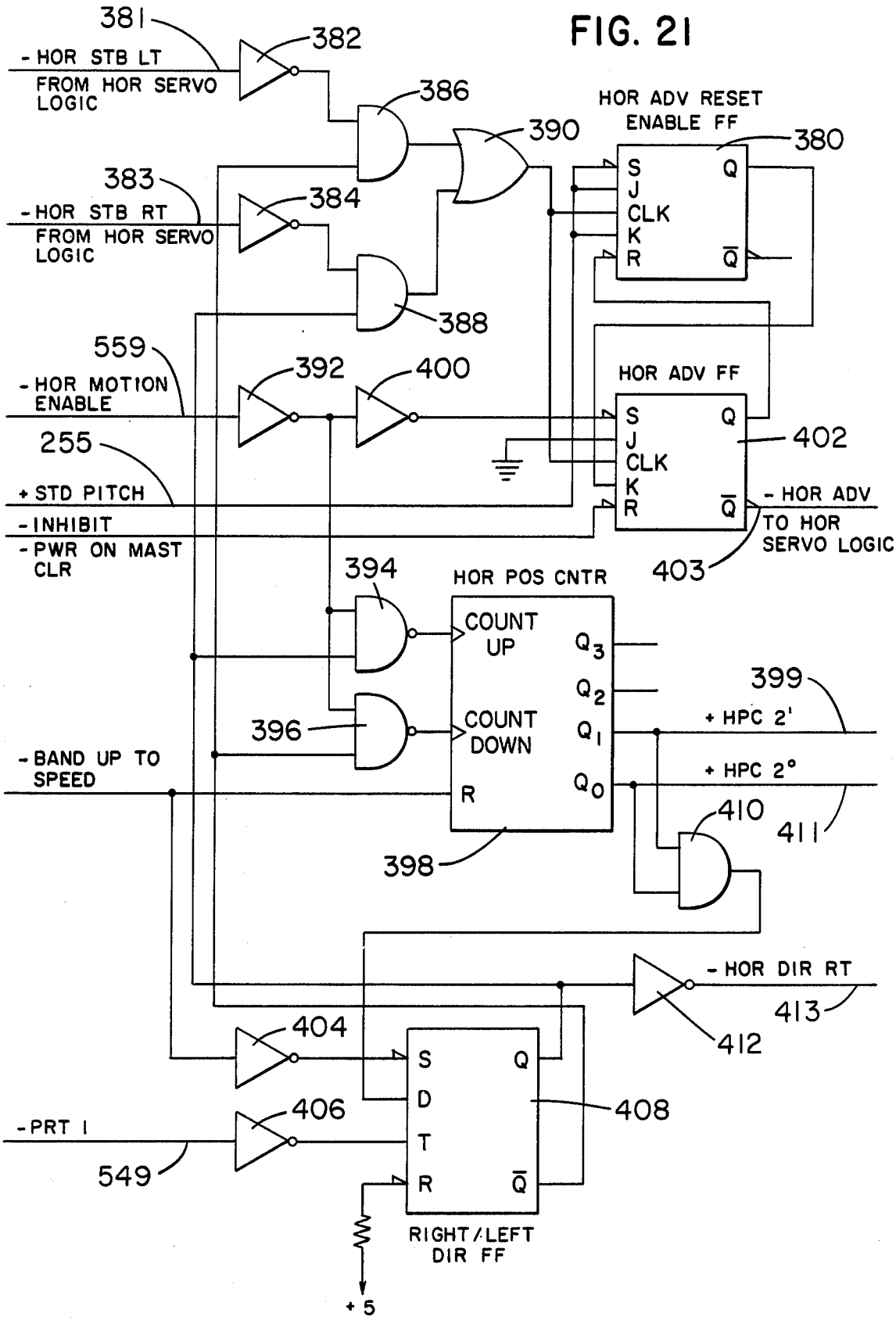
FIG. 21 is a diagram of the horizontal motion control logic.

FIGS. 13A and B further show the horizontal motion cycle for standard pitch and for compressed pitch, respectively, with the logic being shown in FIG. 21. As seen in FIGS. 13A and B, when a horizontal shift is required, the horizontal motion enable signal becomes active low. The leading edge of this signal sets the horizontal advance flip-flop and the trailing edge increments or decrements the horizontal position counter depending upon whether the right/left direction flip-flop is set or reset, respectively. The right/left direction flip-flop also provides a signal to the horizontal servo logic 164, (FIG. 4A) giving the direction that the hammer bar is to be moved. The setting of the horizontal advance flip-flop commands the horizontal servo to move the hammer bar. Through the movement of the hammer bar, horizontal strobe left pulses and horizontal strobe right pulses are produced. These pulses are gated with the right/left direction flip-flop to produce a horizontal clock signal which corresponds to the direction of the hammer bar movement. The horizontal clock pulses are used to maintain the horizontal advance flip-flop set for either two horizontal clock pulses (2/30 inch) or one horizontal clock pulse (1/30 inch) to correspond to either a standard or compressed pitch band, respectively. The ramp generator previously discussed causes the hammer bar to stop 1/30 inch after the horizontal advance flip-flop is reset. This results in a 1/10 inch or 1/15 inch displacement of the hammer bar corresponding to the required hammer movement for standard and compressed pitch band, respectively. The duration that the horizontal advance flip-flop is set is dependent upon the state of the standard pitch signal. This signal being high, indicating a standard pitch band on the printer, causes the horizontal advance reset enable flip-flop to be set upon sensing the trailing edge of the first horizontal clock signal. The horizontal motion being set allows the horizontal advance flip-flop to reset on the trailing edge of the next horizontal clock which in turn resets the horizontal advance reset enable flip-flop. In the case of a compressed pitch band, the standard pitch signal is active low. This allows either the Q output of the horizontal advance reset enable flip-flop to be permanently high or at least go high immediately upon setting the horizontal advance flip-flop. Therefore, the trailing edge of the first horizontal clock pulse will cause the horizontal advance flip-flop to reset. The remaining signal to be discussed is band up. Referring to FIG. 7, when the band up to speed and band motor control signals are low, the hammer bar is in an indeterminate position. When the band motor control signal becomes active, caused primarily by the sensing of data being transmitted to the printer, the hammer bar is moved to the home position which is defined as the first hammer aligned to the first print position. In addition, the band motor is energized. After approximately 5 seconds the band up to speed signal becomes active high. Referring to FIGS. 13A and 13B, the band up (band up to speed) signal when low causes the horizontal position counter to be set to zero and the right/left direction flip-flop to be set. This therefore defines the initialized modes of the horizontal position counter and right/left direction flip-flop.

Figure 14:
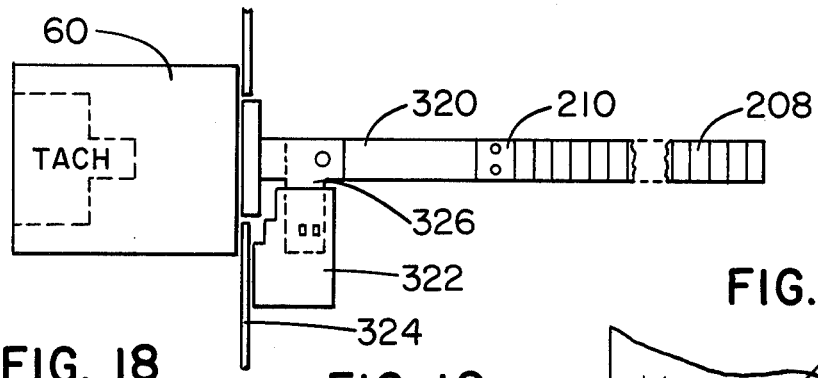
FIG. 14 is a view of the voice coil and associated parts for shifting the hammers.
Figure 15:
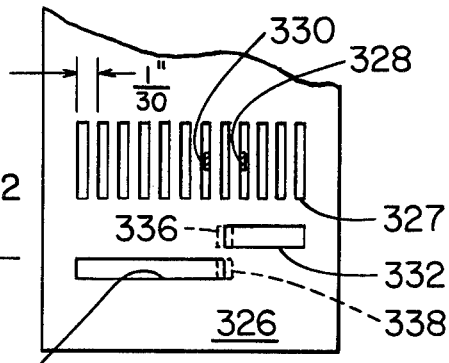
FIG. 15 is an enlarged view of a portion shown in FIG. 14.

FIG. 14 shows an elevational view of the voice coil 60 connected by means of a horizontal encoder apparatus 320 to a hammer bar assembly 210 which supports the plurality of hammers 208 adjacent the printing station. The hammers 208 are time shared and are caused to be moved laterally or back and forth along the printing station by action of the horizontal servo logic and the voice coil 60. A horizontal encode bar reader 322 is secured to a frame member 324 of the printer, the reader 322 having a slot therein for passage of a downwardly extending leg 326, (shown enlarged in FIG. 15) of the encoder element 320. The leg 326 of the encoder element 320 includes a plurality of slots or windows 327 therein, spaced at 1/30 inch, which are caused to be moved, upon movement of the hammer bar assembly 210 by the voice coil 60, past a pair of photovoltaic cells 328 and 330 supported in fixed position in the reader 322. A pair of horizontally disposed windows 332 and 334 (FIG. 15) are positioned below the windows 327 in the leg 326 and a pair of photovoltaic cells 336 and 338 are supported to read the home position of the hammer bar assembly 210 or the position of the hammer bar when such bar is in the fully left position, such position causing print hammer number one to be aligned with print column or position number one. Since the slots 327 in the code bar 320 are 1/30 inch on centers, the hammers 208 are moved in increments of 1/30 inch by the voice coil 60 as directed from the horizontal servo logic, as seen in FIG. 4A. The voice coil 60 includes a tachometer which feeds back information to the servo logic. It should be noted that by reason of the position of the cells 328 and 330, that a sine wave is generated.

Figure 16:
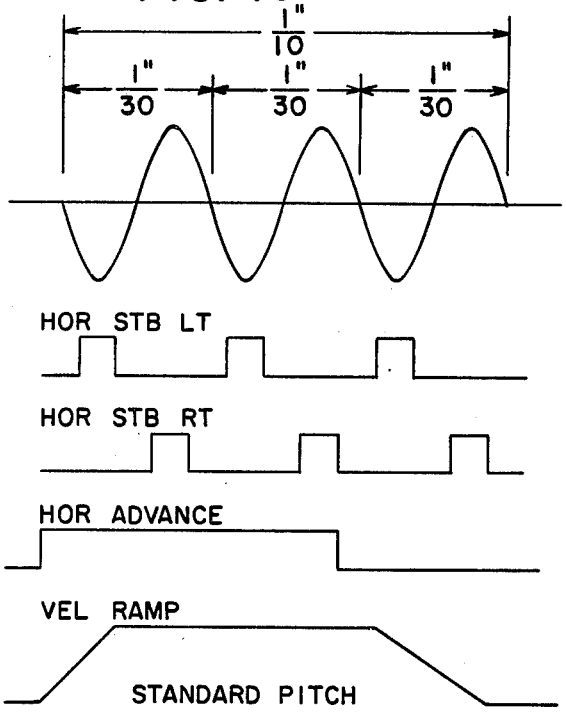
FIG. 16 is a showing of the wave shape and timing diagram of controls for hammer displacement in standard pitch.
Figure 17:
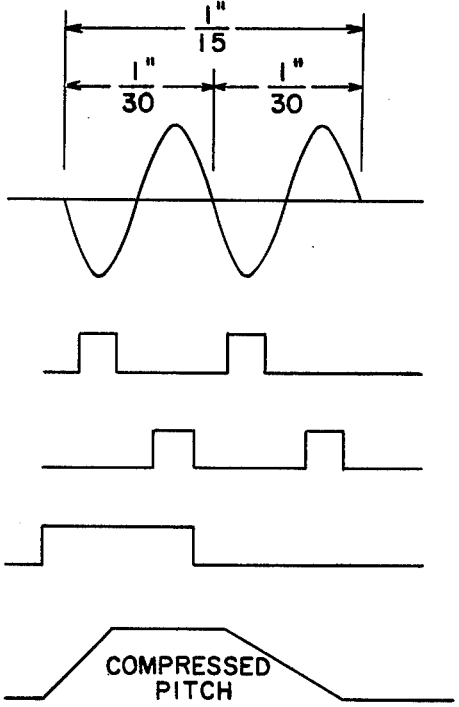
FIG. 17 is a showing of the wave shape and timing diagram of controls for hammer displacement in compressed pitch.

FIG. 16 shows the timing pattern relative to horizontal shifting of the hammers for the standard pitch machine wherein the hammer bar assembly 210 is moved in three equal increments of 1/30 inch for the 1/10 inch spacing of the characters. FIG. 17 shows the timing pattern relative to horizontal shifting of the hammers for the compressed pitch machine wherein the hammer bar assembly 210 is moved in two increments of 1/30 inch for the 1/15 inch spacing of the characters. When the hammer bar 210 is caused to be moved 1/30 inch, one sine wave is generated as a function of displacement. The horizontal strobe left and horizontal strobe right pulses are shown in relation to the position of the corresponding wave shape, wherein it is seen that for standard pitch and going in a right direction, the horizontal advance is dropped after two horizontal strobe right pulses are received from the code bar assembly 320. In standard pitch the velocity ramp shows driving of the bar for 2/30 inch and then decelerates at a controlled rate for the remaining 1/30 inch, whereas in compressed pitch, the hammer bar is driven for 1/30 inch and then decelerates at a controlled rate for the remaining 1/30 inch for a complete shift of the hammers. It should also be noted that in compressed pitch that the horizontal advance is dropped after one horizontal strobe right pulse is seen by the control logic.

Figure 18:
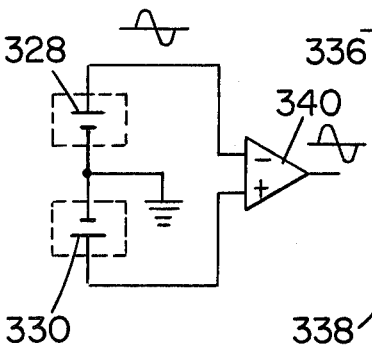
FIG. 18 is a circuit diagram of the sensing means for horizontal displacement of the hammers.
Figure 19:
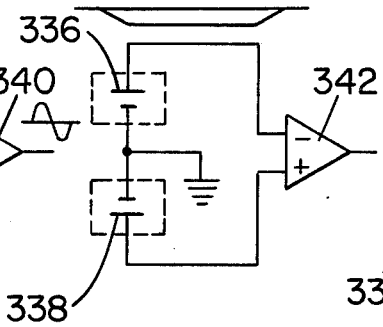
FIG. 19 is a circuit diagram of the sensing means for home position of the hammers.

FIG. 18 is a circuit diagram of the sensing means or the horizontal displacement transducer 328 and 330 connected to the inputs of an operational amplifier 340 in the manner for generating a sine wave of the displacement of the slots 327 past the photo cells 328 and 330. FIG. 19 is a circuit diagram of the sensing means or the horizontal home transducers 336 and 338 connected to the inputs of an operational amplifier 342 in the manner for generating a wave shape for the home position of the hammers. The wave shapes are shown above the diagrams in relationship as to the functions of the various elements in the positioning of the hammer bar assembly 210.

Referring back to FIG. 4A, the one character pulse to four subscan pulse logic 156 provides that for each and every character pulse received from the type character band 54, there are generated four subscan pulses, i.e., the time between each character pulse is evenly split into four subscans to provide the four subscan scheme. During each subscan every third print band character is aligned with every fourth print position and the subscan pulses correspond to the time at which a hammer may be fired. The subscan pulse generator is running continuously during the time the print band is moving and the operation of the circuit starts just before the generation of the subscan start pulse.

Figure 20:
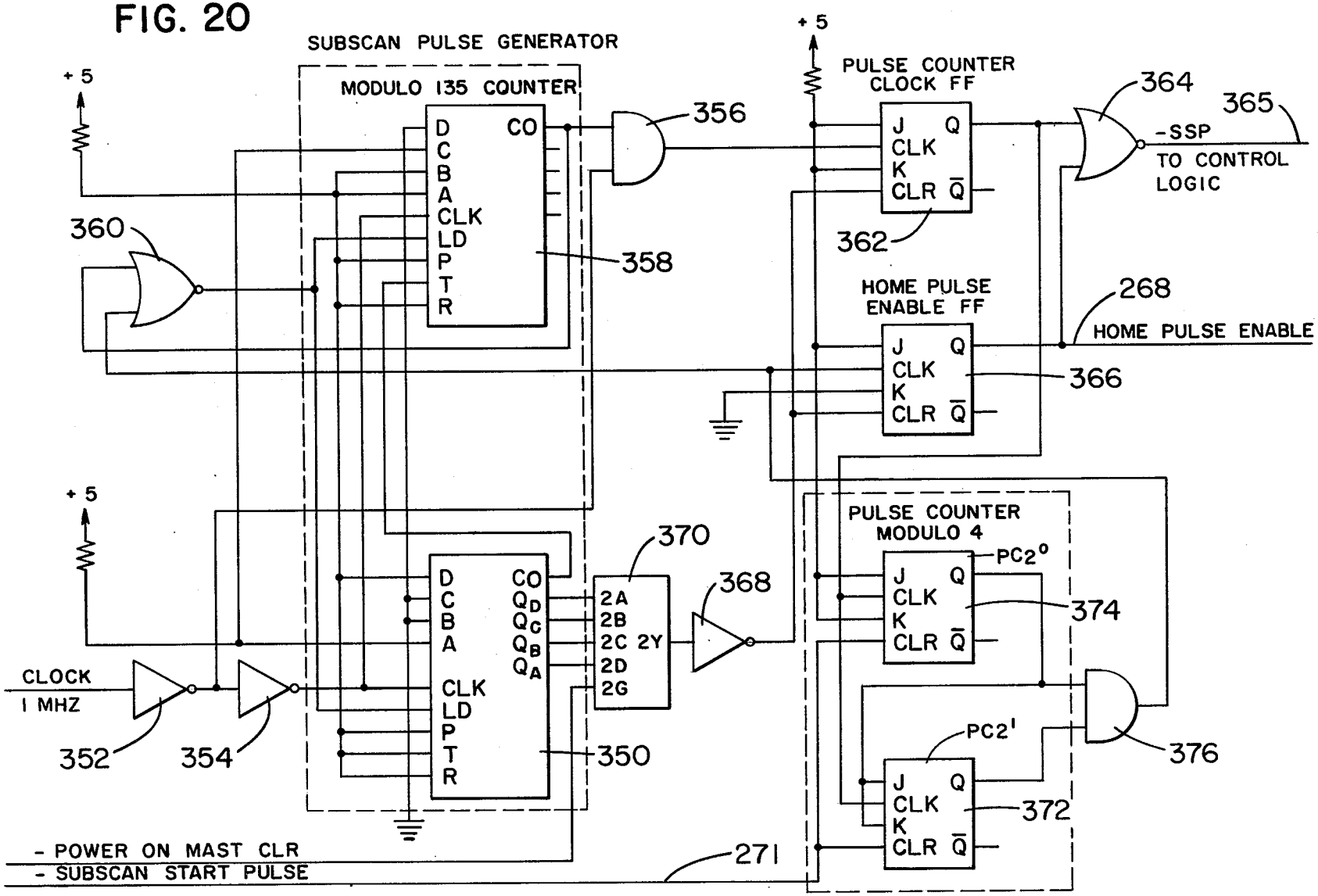
FIG. 20 is a diagram of the one character pulse to 4 subscan pulse logic.
Figure 33:
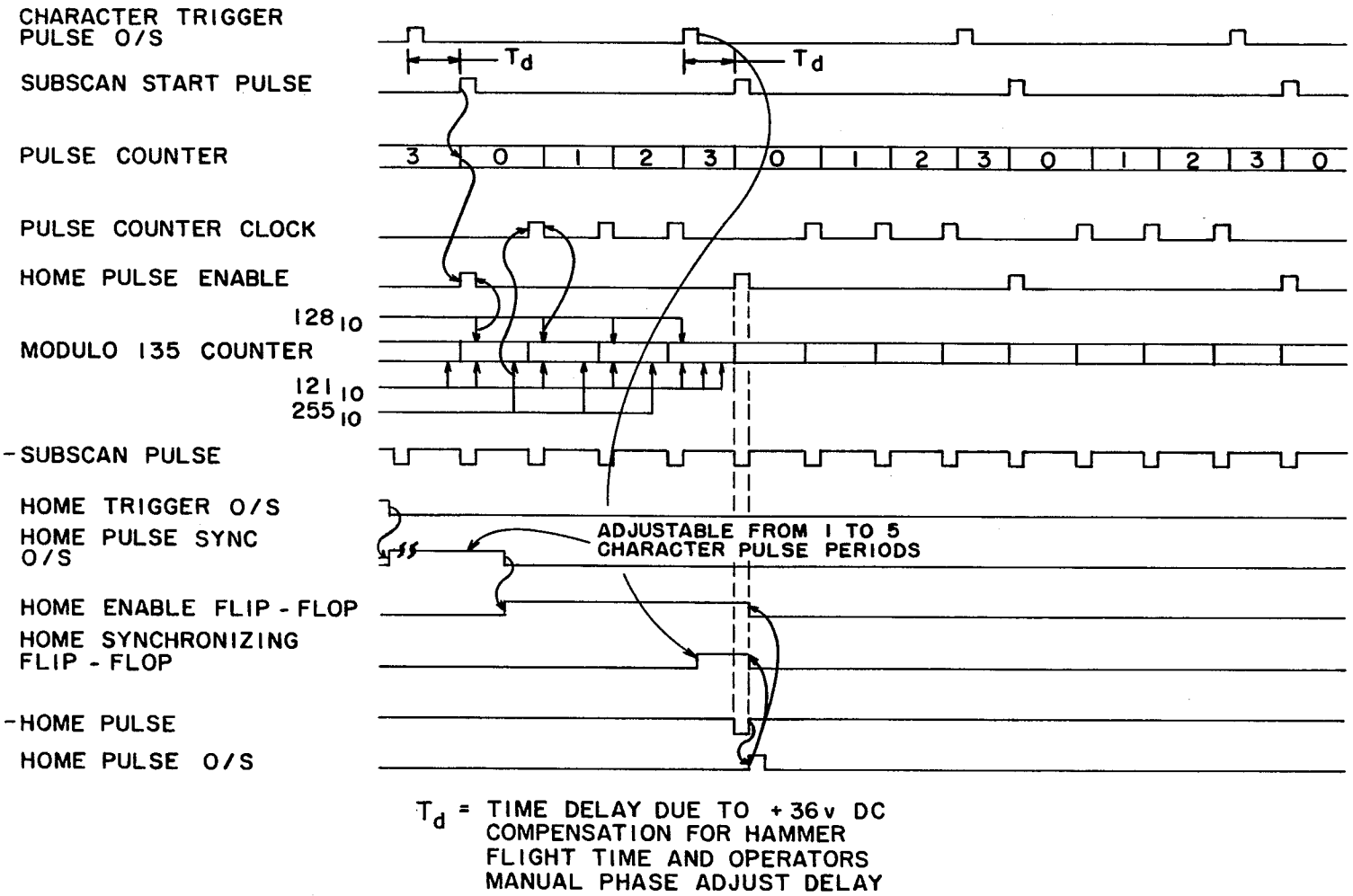
FIG. 33 is a timing diagram of the subscan pulse and home pulse generation associated with FIGS. 9 and 20.

FIG. 20 shows a schematic diagram of the means which is utilized in the present invention to generate the four subscan pulses for each character pulse, the timing for which is shown on FIG. 33. Such subscan pulse generating means includes a modulo 135 counter comprising two synchronous 4-bit binary counters 350 and 358, type number 74161, which receive 1 MHz clock signals through an inverter 352, the output of such inverter 352 being sent to AND gate 356 and also through a second inverter 354, the output of such inverter sent to the counters 350 and 358. The carry out signal of the 4-bit binary counter 358 is the second input to AND gate 356 and as an input to NOR gate 360, the output of such NOR gate being the load signal for the counters 350 and 358, which counters constitute the make up of the modulo 135 counter. Since the nominal time between character pulses is 540 microseconds, the modulo 135 counter generates three subscan pulses every 135 microseconds and a maximum of four subscan pulses are sent to the control logic through pulse line 365. The output of AND gate 356 is the clock signal for a pulse counter clock flip-flop 362, which is a dual J–K master/slave device with reset, type number 74107, the output of which serves as an input to NOR gate 364, the other input thereto being derived from the output of a home pulse enable flip-flop 366 of the same type as device 362. The clear signal for the two devices 362 and 366 is derived from the output of an inverter 368 which receives an input from a dual four input NOR gate 370 with strobe, type number 7425, which receives the power on master clear input signal.

The subscan start pulse 271 is input to a modulo four pulse counter comprised of flip-flop devices 372 and 374 which devices are also dual J–K master/slaves with reset of the same type as devices 362 and 366. The outputs of devices 372 and 374 serve as inputs to AND gate 376, the output of which is connected to the clock of device 366 and as an input to NOR gate 360.

Prior to the time a character start pulse 271 is received from the logic 152 (FIG. 4A), the pulse counter modulo 4 comprised of devices 372 and 374 are setting at the count of three, the clock to 366 device is high, and the modulo 135 counter is being held at decimal 121. The subscan start pulse 271 resets the pulse counter modulo 4 flip-flops 372 and 374, such resetting removing the clock of the home pulse enable flip-flop 366, this action generating the first subscan pulse 365. After the first subscan pulse, three additional subscan pulses are generated from the modulo 135 counter for automatically incrementing the pulse counter modulo 4 pulse counter 374. When the counter reaches the count of three, the modulo 135 counter is stopped from generating more output pulses.

FIG. 21 shows circuitry for the horizontal motion enable logic wherein a horizontal advance reset enable device 380, which is a dual J–K master/slave flip-flop with set and clear, type number 7476, receives signals from horizontal right or left strobe pulses 383 and 381 through inverters 382 and 384 and through AND gates 386 and 388 as the inputs to an OR gate 390, the output of which OR gate is a clock pulse to the flip-flop 380 and a horizontal advance flip-flop 402. The horizontal motion enable signal 559 is inverted at inverter 392 as an input to NAND gates 394 and 396, the outputs of which are fed to a horizontal position counter 398, which device is a synchronous four bit binary up/down counter, type number 74193. An inverter 400 is provided as the set input of a horizontal advance flip-flop 402, which device is a dual J–K master/slave flip-flop with reset and clear, type number 7476, the output of which is sent as a horizontal advance signal 403 to the horizontal servo logic. A band up to speed signal also provides a reset input to the horizontal position counter 398. The band up to speed signal also goes through an inverter 404, along with enable print 1 signal 549 through an inverter 406 as set inputs to a right/left directional or dual D-type flip-flop 408, type number 7474. The outputs of the horizontal position counter 398 are inputs to an AND gate 410, the output of gate 410 being directed to the right/left direction flip-flop 408, with the outputs of counter 398 also being sent as horizontal position counter signals HPC $2^0$ and HPC $2^1$ by lines 399 and 411. One output of the flip-flop 408 is connected as an input of AND gate 394 and 388 and is also sent through an inverter 412 to provide a horizontal direction right signal 413. The other output of flip-flop 408 is connected as an input to AND gates 396 and 386. It is also noted that the plus standard pitch signal 255 is input to the horizontal advance reset enable flip-flop 380. The horizontal advance reset enable flip-flop 380, the horizontal advance flip-flop 402 and the associated gated inputs thereto constitute the 1/10 inch or 1/15 inch displacement control logic 195, as seen in FIG. 4F. The horizontal position counter 398 and the right/left direction flip-flop 408 together with the gated inputs constitute the horizontal position logic 196 and the horizontal direction control logic 197 in FIG. 4F.

The horizontal motion enable logic provides the means to initiate movement or shifting of the hammer faces at 1/10 inch for standard pitch and at 1/15 inch for compressed pitch. A description of the logic operation shown in FIG. 21 is explained in the previous description of timing diagrams, FIGS. 13A and 13B, and of the logic blocks 195, 196, and 197 in FIG. 4F.

Figure 22:
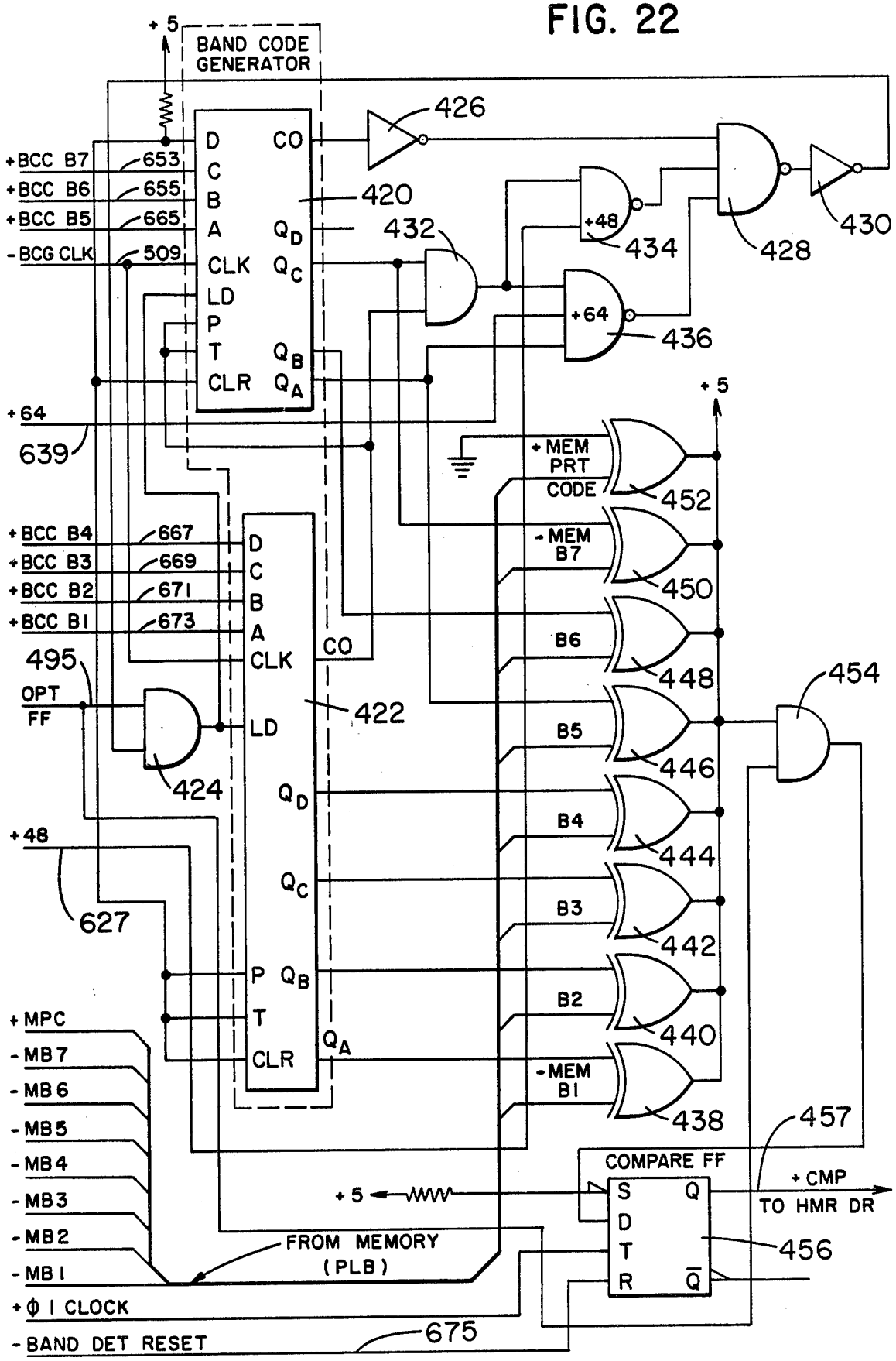
FIG. 22 is a diagram for the band code generator and the compare logic.

A band code generator is used during each option cycle to generate the codes of the print characters that will be aligned with each print position for the next scan, i.e., the generator keeps track of all the characters on the band with knowledge of the initial starting position when making compares or going through an option cycle. FIG. 22 represents the logic blocks in FIG. 4C termed Band Code Generator and BCG maximum detect 179, and the compare logic 181, in FIG. 4D. The band code generator is comprised of devices 420, 422, and 424. The BCG maximum detector comprises devices 426, 428, 430, 432, 434, and 436. The compare logic comprises devices 438, 440, 442, 446, 448, 450, 452, 454 and 456. The data inputs to the band code generator are from the band character counter multiplexer 171, FIG. 4C. Just prior to the beginning of an option cycle, the data code on the band character multiplexer is loaded into the band code generator, this code being the code of the character on the band which will be aligned with print column one on the following scan. For example, this code may be the code for Z+0 shown in Tables A and B for scan Z0. During the option cycle the band code generator clock 509 increments the band code generator per the band code generator incremental format shown in Tables A and B, such format being dependent on the type band—standard or compressed pitch, respectively, as the addresses to the print line buffer are being serially and successively incremented similar to the print column format shown. The contents of the band code generator are then compared with the contents of the print line buffer and the compare flip-flop 456 is either set or reset depending upon the compares or lack of compares, respectively. The compare signal 457 is transmitted to the hammer driver board 2, 182 in FIG. 4B. As previously explained, when describing the band code generator maximum detection, i.e., when the band code generator reaches the end code or count of the character on the band for the particular band in question, (48, 64, 96, 128), the band code generator maximum detect causes the band code generator to be loaded to the home code for the band which is on the output of the band character counter multiplexer 171, FIG. 4C. The home code and the end code for the 48, 64, 96, and 128 are, respectively, decimal 32 and 79, decimal 32 and 95, decimal 32 and 127, and decimal 0 and 127. The band detect reset 675 signal is active low thereby holding a reset on the compare flip-flop 456 whenever the gate is open or the type band is not yet detected as to being a 48, 64, 96 or 128 character band.

The band code generator logic includes the counters 420 and 422, shown in FIG. 22, which appropriately are synchronous four-bit binary counters, type number 74161, which receive band code counter signals 673, 671, 669, 667, 665, 655, and 653 (BCC B1 through BCC B7) and an option flip-flop signal 495 fed as an input to AND gate 424, the output of which is the load input to the counters 420 and 422. The carry out output of counter 420 is sent through an inverter 426 as as input of a triple 3 input NAND gate 428, type number 7410, the output of which is inverted by inverter 430 and sent as the second input to AND gate 424. The carry out output of counter 422 serves as an input to AND gate 432, the other input thereto being a Q output from counter 420. The output of AND gate 432 serves as an input to a 2 input NAND gate 434 and as an input to a 3 input NAND gate 436, type number 7410, the second input to NAND gate 434 being a signal 627, which is the 48 character set, with the outputs of gates 434 and 436 being sent to NAND gate 428. The NAND gate 436 also receives as an input a signal 639 which is the 64 character set, along with an input signal from the Q output of counter 420.

A plurality of signals from memory, MB1 through MB7 and memory print code MPC, are inputs to a plurality of 2 input exclusive OR gates 438, 440, 442, 444, 446, 448, 450 and 452, all of type number 74136, along with inputs from the Q outputs of the counters 420 and 422. The exclusive OR gates are of the quad two input exclusive OR type and the output of any one of the OR gates is an input to AND gate 454, such gate also receiving an option flip-flop signal 495 as an input, the output of gate 454 being an input to a dual D type compare flip-flop 456, type number 7474. A $\phi$1 clock pulse and a band detect reset signal 675 are input to the compare flip-flop 456 with the output compare signal going to the hammer drivers. The two counters 420 and 422 make up the band code generation logic whereas the circuitry comprising gates 432, 434, 436, 428 and inverters 426 and 430 constitute the band code generator maximum detector logic, with the exclusive OR gates 438 through 452, the AND gate 454 and the flip-flop 456 make up the compare logic for allowing those pulses to go to the hammer drivers for which a hammer is in front of the particular print column or position.

Figure 23A:
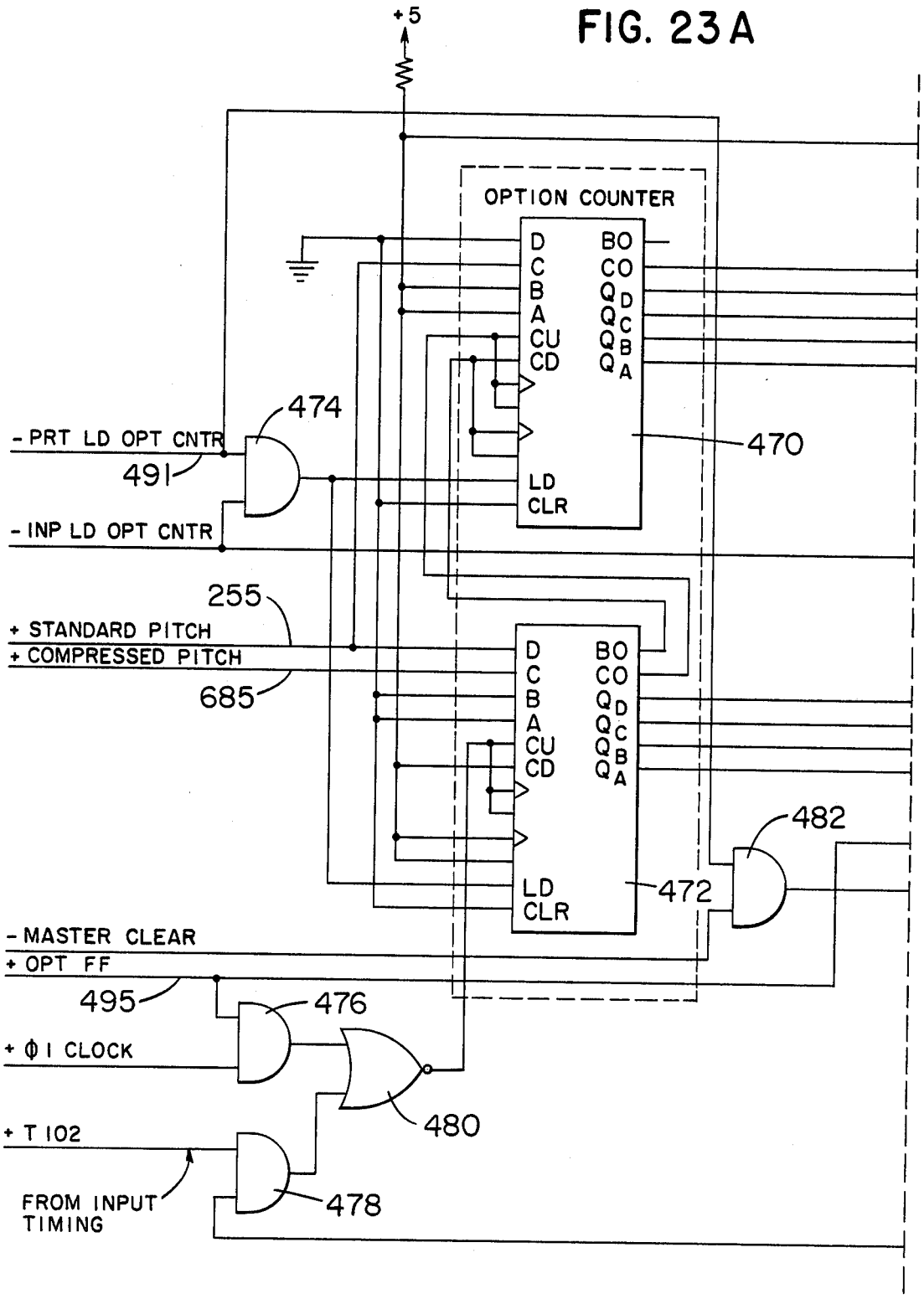
FIGS. 23A and 23B constitute a diagram for the option counter and end detect logic.
Figures 23B, 25A:
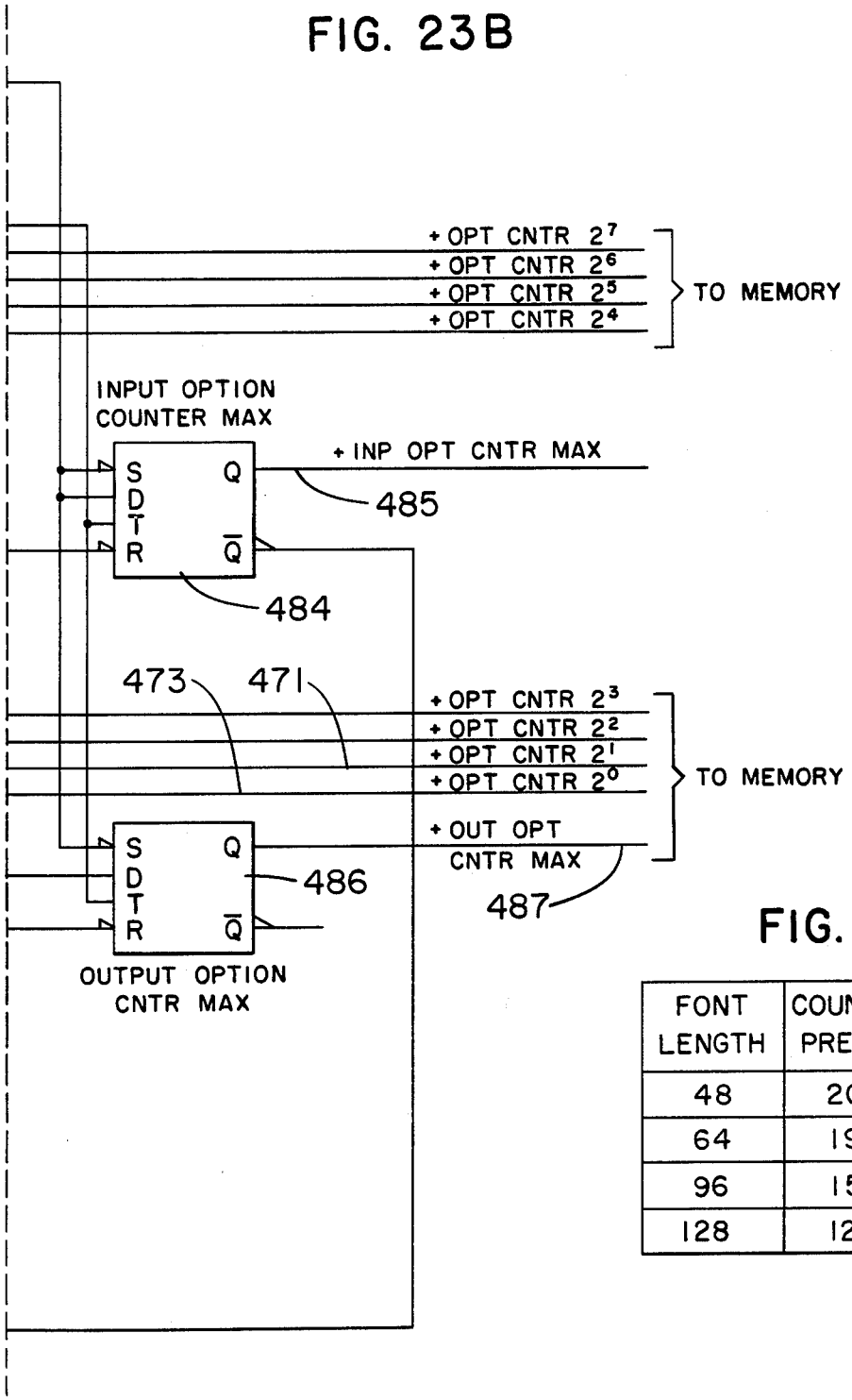
FIG. 25A, on the sheet with FIG. 23B, is a table showing the predetermined sets of the scan counter for the several font lengths.

An option counter, shown in FIGS. 23A and 23B, is used during both an input cycle and an option cycle to access the random access memory 190, FIG. 4E. During an input cycle the counter is loaded by an input load option counter signal which is generated by the first store data pulse at which time the counter is preloaded to the count of decimal 120 for the standard pitch and to decimal 52 for compressed pitch, for printing 136 (256-120) columns in standard pitch and for printing 204 (256-52) columns in compressed pitch. The first data character is stored in that location of the memory and for each succeeding character the option counter is incremented accessing a new memory location. When the option counter reaches the count of decimal 255, an input option counter maximum flip-flop 484 device is set, thus terminating the memory load cycle and indicating a memory full condition. The input option counter maximum flip-flop device 484 remains set until the next input load option counter signal is generated. An option cycle is the actual process of making compares between what is in the band code generator and what is in memory.

During the option cycle, the option counter is preloaded to the count of decimal 120 for standard pitch and to the count of decimal 52 for compressed pitch by a print load option counter signal 491 which is generated at the start of each option cycle. This signal also resets an output option counter maximum flip-flop 486. The option counter data load inputs are automatically controlled by the standard pitch level 255 and the compressed pitch level 685 as dictated by the type band on the printer. The option counter is incremented by each $\phi$1 clock pulse when the option flip-flop is set. When the count of decimal 255 is reached, all the memory characters have been optioned for the particular scan and the output option counter maximum flip-flop 486 is set, thus terminating the option cycle for that scan. The output option counter maximum flip-flop is reset when either the next print load option counter pulse 491 is generated indicating the start of another option cycle or when a master clear is generated.

As seen in FIG. 23A, the option counter logic comprises synchronous 4 bit binary up/down counters 470 and 472, type number 74193, with the incoming standard pitch signal 255 and the compressed pitch signal 685. An AND gate 474 receives as inputs the print load option counter pulse 491 and the input load option counter signal, the latter signal being sent to the input option counter maximum dual D-type flip-flop 484, type number 7474, and which signal presets the option counter to the count of decimal 120 or decimal 52. An option flip-flop signal 495 is sent to the output option counter maximum dual D-type flip-flop 486, type number 7474, and also input to AND gate 476. A master clear is an input to AND gate 482 along with the print load option counter signal 491. A T102 signal from the input timing, which signal increments the option counter for every byte placed into memory during an input cycle, is sent to AND gate 478, the second input thereto being an output from the flip-flop 484. The outputs of gates 476 and 478 are inputs to NOR gate 480 the output thereof sent to the count up input of counter 472. The output of AND gate 482 is input to the output option counter flip-flop 486. As seen in FIGS. 23A and 23B, the outputs of the option counters 470 and 472 are sent as address lines to memory as option counter signals to indicate the memory address. The output signal 485 of flip-flop 484 and the output signal 487 of flip-flop 486 are sent to the option cycle logic, to be shortly described. It is thus seen that during an option cycle, each location in the print line buffer is compared to the contents of the band code generator and compares or lack of compares are transmitted to the hammer drivers.

Figure 24:
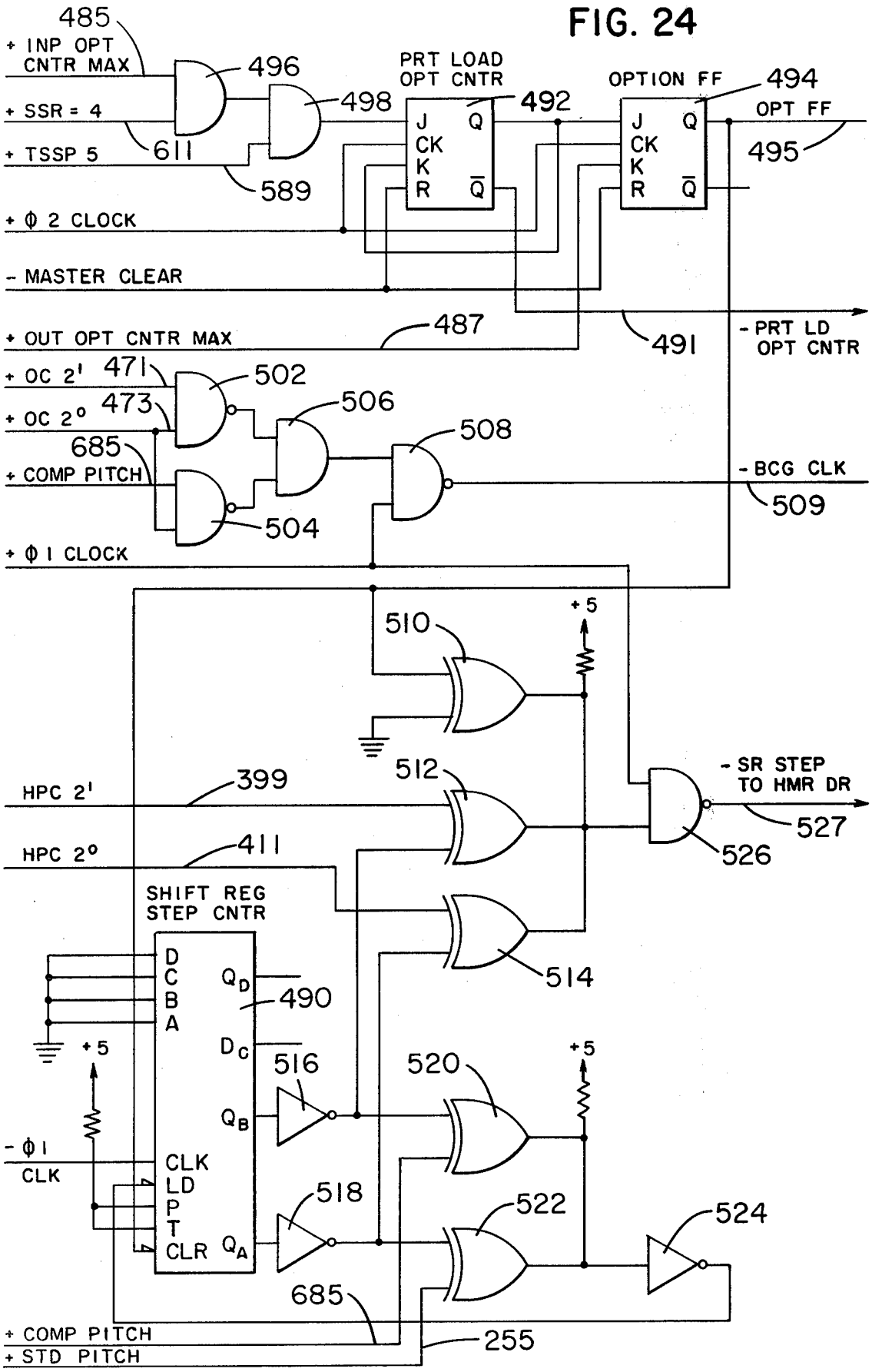
FIG. 24 is a diagram of the option cycle control logic.

Referring now to FIG. 24, there is shown the option logic which is comprised of the output option counter control 173, the shift register step control 175, and the band code generator control 177, (FIG. 4C). The output option counter control is comprised of devices 496, 498, 492, and 494. The band code generator clock control is comprised of devices 502, 504, 506, and 508. The shift register step control is comprised of devices 510, 512, 526, 514, 490, 516, 520, 518, 522, and 524. When the input option counter maximum signal 485, the subscan register equals 4 (SSR=4) signal 611 and the timing subscan pulse 5 (TSSP 5) signal 589 are active, the print load option counter flip-flop 492 is set which causes the input option counter, previously discussed, to be loaded either to a count of decimal 52 or 120. The setting of device 492 also causes the output option counter maximum to be reset. The next $\phi 2$ clock causes device 492 to be reset and the option flip-flop 494 to set. This is the start of an option cycle which allows comparisons between the characters in the print line buffer 190 (FIG. 4E) and the band code generator to be made. When the option flip-flop 494 is set, the option counter is incremented every $\phi 1$ clock. When the option counter reaches the terminal count of 255 decimal and a $\phi 1$ clock becomes active, the output option counter maximum flip-flop 486 (see FIG. 23B) sets. The output option counter maximum signal 487 is tied to the K input of device 494. Upon reception of the next $\phi 2$ clock, the option flip-flop 494 is reset, thus completing the option cycle for the particular scan under discussion. This technique allows the print line buffer or memory 190, (FIG. 4E), to be sequentially addressed through 136 or 204 locations corresponding to either standard or compressed pitch bands, respectively. The band code generator control sends a clock signal 509 to the band code generator so that only 3 such clocks are generated for every 4 $\phi$ clocks generated when the option flip-flop 494 is set when in the standard pitch mode, and only one band code generator clock signal is generated for every 2 $\phi 1$ clocks for the compressed pitch mode. The above causes the band code generator and memory addressing to follow the incremental format shown in Tables A and B. The shift register step control produces shift register step pulses 527 to be sent to the hammer drivers for the purpose of storing the comparisons or lack thereof in the hammer driver shift registers. These pulses 527 are only produced when a hammer is available at a given print column. This operation is accomplished by comparing the contents of the horizontal position counter, via the HPC $2^1$ signal 411 and the HPC $2^0$ signal 399, with the contents of the shift register step counter. This is graphically illustrated in Tables E ad F. The shift register step counter's modulus is a variable dependent upon the type band. The modulus is 2 for a standard pitch band and 3 for a compressed pitch band and is caused by the state of the standard pitch signal 255 and the compressed pitch signal 685.

The shift register step counter 490 is a synchronous 4 bit binary counter, type number 74161, which counts 0, 1 for standard pitch and 0, 1, 2 for compressed pitch. The input option counter maximum signal 485, and the subscan register=4 signal 611 are inputs to an AND gate 496, the output of which is sent to AND gate 498 along with the second input thereto which is the timing subscan pulse 5 signal 589. The output of AND gate 498 is sent to the print load option counter 492, which is a dual J–K master/slave flip-flop with reset, type number 74107. One output of the counter 492 is the print load option counter signal 491 and the second output is sent to the option flip-flop 494 which is a like device as counter 492, the output of flip-flop 494 being a signal 495 also being sent to the shift register step counter 490. A $\phi 2$ clock signal is fed into the flip-flops 492 and 494. A master clear signal is also input to the flip-flops 492 and 494. The output option counter maximum signal 487 from the option counter is input to the flip-flop 494.

Option counter $2^0$ and $2^1$ signals 473 and 471 are input to a quad 2 input NAND gate 502, the $OC2^0$ signal also being sent to a like NAND gate 504. The compressed pitch signal 685 is input to the NAND gate 504, with the outputs of gates 502 and 504 being the inputs of AND gate 506, the output of gate 506 being one input to a NAND gate 508, the other input being a $\phi 1$ clock pulse. The output of gate 508 is the band code generator clock signal 509 to the band code generator 420 and 422.

The horizontal position counter HPC $2^1$ and HPC $2^0$ signals 399 and 411 are inputs to exclusive OR gates 512 and 514, type number 74136, the outputs of which serve as inputs to a quad 2 input NAND buffer gate 526, type number 7437, the output of which is the shift register step to hammer driver signal 527. The option flip-flop signal 495 also is sent to a like exclusive OR gate 510.

The standard pitch signal 255 and the compressed pitch signal 685 are inputs to exclusive OR gates 522 and 520 with the second inputs thereto being the outputs of inverters 518 and 516 which receive signals from the output of the shift register step counter 490. The output of the exclusive OR gates 520 and 522 is sent through an inverter 524, the output of which is the load input for the counter 490.

It is thus seen that the print load option counter flip-flop 492 and the option flip-flop 494 with the associated gate circuitry make up the option counter control, the series of gates 502, 504, 506 and 508 comprise the band code generator clock control, and the shift register step counter along with the associated gates make up the shift register step control.

Figure 25:
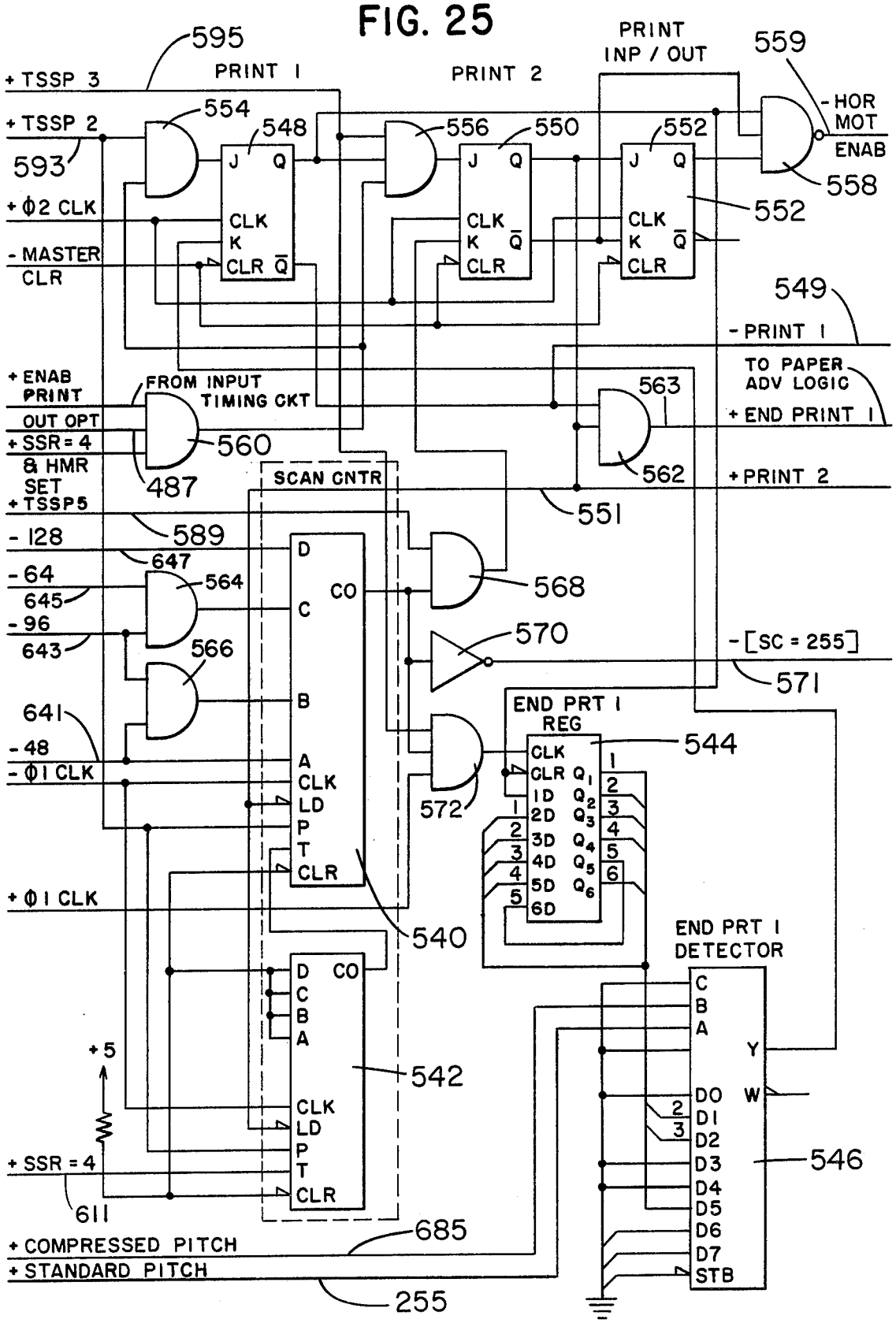
FIG. 25 is a diagram of print control logic.

A scan counter 540 and 542, shown in the print control logic of FIG. 25, is used to keep track of the number of print character positions optioned during the print 2 portion of a print cycle. When all possible characters have been optioned, the scan counter resets a print 2 flip-flop terminating the print operation for the horizontal position at which the hammer bar 210 is located at that particular time. The scan counter is pre-loaded when the print 2 flip-flop is not set. The preload count will vary with the band character set length which is different, of course, for a 48, 64, 96 or 128 character set band. When the print 2 flip-flop is set, the scan counter is allowed to count. The preload or preset count for a 48 character font is decimal 207, for a 64 character font is decimal 191, for a 96 character font is decimal 159, and for a 128 character font is decimal 127, as seen in the table of FIG. 25A, on the sheet with FIG. 23B. The counter is incremented by the $\phi$1 clock pulse at timing subscan pulse 2 time if the subscan register equals 4, thereby allowing the scan counter to increment only once per scan. The scan counter continues to be incremented until the counter reaches the count of decimal 255. When the count of 255 is reached and the timing subscan pulse 3 signal goes active, the end print 1 register is strobed at $\phi$1 clock time. At the following timing subscan pulse 5 time, the print 2 flip-flop is reset which activates the load input of the scan counter and the proper preload count is strobed into the counter by the $\phi$1 clock pulse.

An end print 1 register keeps track of the number of print 2 times that have been run for each print operation. The input to the end print 1 register 544 is taken from the print 1 flip-flop and when the flip-flop is reset, the register is held clear. As soon as the print 1 flip-flop sets, the reset input is deactivated and the shift register input goes high. Each time the scan counter reaches the count of decimal 255 the register is shifted. The outputs of the end print 1 register are fed to the end print 1 detector which is a multiplex device and wherein the input to be transferred to the output of the multiplex device is determined by the type of pitch on the band, standard or compressed, which corresponds to the number of shifts the hammer bar makes to print a complete line of data. When the selected input goes high, the print 1 flip-flop is reset by the $\phi$2 clock pulse which terminates the print cycle operation.

In a printing operation, the print 1 cycle is an envelope of time during which the print 2 cycles (the actual firing time of the hammers) can occur. In the standard pitch machine, there are two print 2 times for each print 1 time, and one horizontal motion, whereas in a compressed pitch machine, there are three print 2 times for each print 1 time, and two horizontal motions. The scan counter keeps track of the scans to go through in a print 2 time, the cycle time depending upon the length of the character set, i.e., the counter will take 48 scans for a 48 character font. The counter operates similarly for the 64, 96, and 128 character fonts, respectively. At the beginning of each print 1, the horizontal position counter is checked to see if the count is 0 which indicates that the hammer bar is fully left. If so, the direction control is set to move right and a print 1 cycle is initiated at SSR=4, after which a print 2 cycle is set. The print 2 cycle time is for as many scans as the length of the character font. The print 2 time will remain until the counter reaches the count of decimal 255, at which time the print 2 cycle is terminated. Each time the scan counter reaches the count of 255 and resets the print 2, the end print 1 register is incremented. The end print 1 register and the end print 1 detector are used to indicate the number of print 2 times during a print 1 cycle. It is therefore seen that the scan counter logic implements the number of print 2 times during a print 1 cycle and also the number of scans to go through during a print 2 time. In standard pitch, there is one print 1 and two print 2 times, with a horizontal motion between the two print 2 times, whereas in compressed pitch, there is one print 1 and three print 2 times, with a horizontal motion between each print 2 time.

Referring again to FIG. 25, there are shown a print 1 dual J–K master/slave flip-flop with reset 548, type number 74107, a like print 2 flip-flop 550, and a print input/output flip-flop 552. A timing subscan pulse 2 signal 593 is input to AND gate 554, the output of which is an input to the flip-flop 548, the signal 593 also being an input to the synchronous 4 bit binary counter 540, type number 74161, and to the like counter 542. The master clear signal and the $\phi$2 clock signal are brought as inputs to the print 1 flip-flop 548, the print 2 flip-flop 550 and the print input/output flip-flop 552. A timing subscan pulse 3 signal 595 is input to a 3 input AND gate 556, type number 7411, and to a like AND gate 572. An enable print signal, indicating that a control code has been received and that paper motion is settled, is input from the input timing circuit to a 3 input AND gate 560, type number 7411. The output option signal 487 (indicating at least one option cycle has been performed) and a subscan register=4 AND hammer settle signal (indicating that the hammer time out is complete and the subscan register is at 4) are input to the AND gate 560, the output of which is an input to the AND gate 554 and to the gate 556. One output of flip-flop 548 is an input to the AND gate 556, the output going to the flip-flop 550. The other output of flip-flop 548 is sent as an input to AND gate 562 and as a print 1 signal 549. The output of flip-flop 550 is an input to flip-flop 552 and is also sent as an input to AND gate 562, as a load signal to the counters 540 and 542, and as a print 2 signal, the output of AND gate 562 being sent as signal 563 to the paper advance logic. The output of flip-flop 552 is an input to a 3 input NAND gate 558, type number 7410, a second input thereto being from the second output of flip-flop 550, and the third input thereto being from the first output of flip-flop 548, the output of AND gate 558 being a horizontal motion enable signal 559.

A timing subscan pulse 5 signal 589 is an input to AND gate 568, the other input thereto being the carry output of counter 540, the output of AND gate 568 being an input to the flip-flop 550. A 128 character signal 647 is sent to the counter 540 along with a 48 character signal 641, the signal 641 being an input to an AND gate 566. A 64 character signal 645 and a 96 character signal 643 are input to AND gate 564, the signal 643 also being an input to the gate 566. The outputs of AND gates are sent to the counter 540. A $\phi$1 clock signal is input to the counter 540 and to the counter 542. The carry out signal of counter 540 serves as an input to an inverter 570 and as an input to the AND gate 572, the second input thereto being the timing subscan pulse 3 signal 595, and the third input being a $\phi 1$ clock pulse. The output of inverter 570 is a subscan=255 signal 571, and the output of AND gate 572 is the clock input of an end print 1 register 544, which is a monolithic D type flip-flop, type number 74174. One output of flip-flop 548 also serves as an input to the flip-flop 544. A subscan register=4 signal 611 is input to counter 542 with the carry output therefrom being an input to the counter 540. The standard pitch signal 255 and the compressed pitch signal are inputs to an end print detector 546, which is an 8 line to 1 line data selector multiplexer with strobe, type number 74151, the output of which is an input to the flip-flop 548.

Referring back to FIG. 4C, the subscan pulse signal 365 and the home pulse signal 275 are input to the subscan timing generator and subscan register logic 165. As mentioned earlier, the standard pitch is a 4 subscan scheme and the compressed pitch is a 2 subscan scheme, and that the option cycles are always one scan ahead of the actual hammer firing, i.e., the contents of the shift register are not transferred to the hammer drivers until all compares have been made. The subscan timing generator develops or provides a series of eight distinct timing pulses for every subscan pulse, and the subscan register is synchronized by the home pulses and keeps track of the subscans or identifies the particular subscan quadrant. While the standard pitch machine is a 4 subscan scheme and while the compressed pitch machine only utilizes 2 subscans, there are always 4 subscans generated by the print head electronics. The subscans generated are propagated down the subscan register in repeated manner as subscan 1, 2, 3, and 4, and at the time of receipt of the home pulse, the subscan will be 4.

Figure 26A:
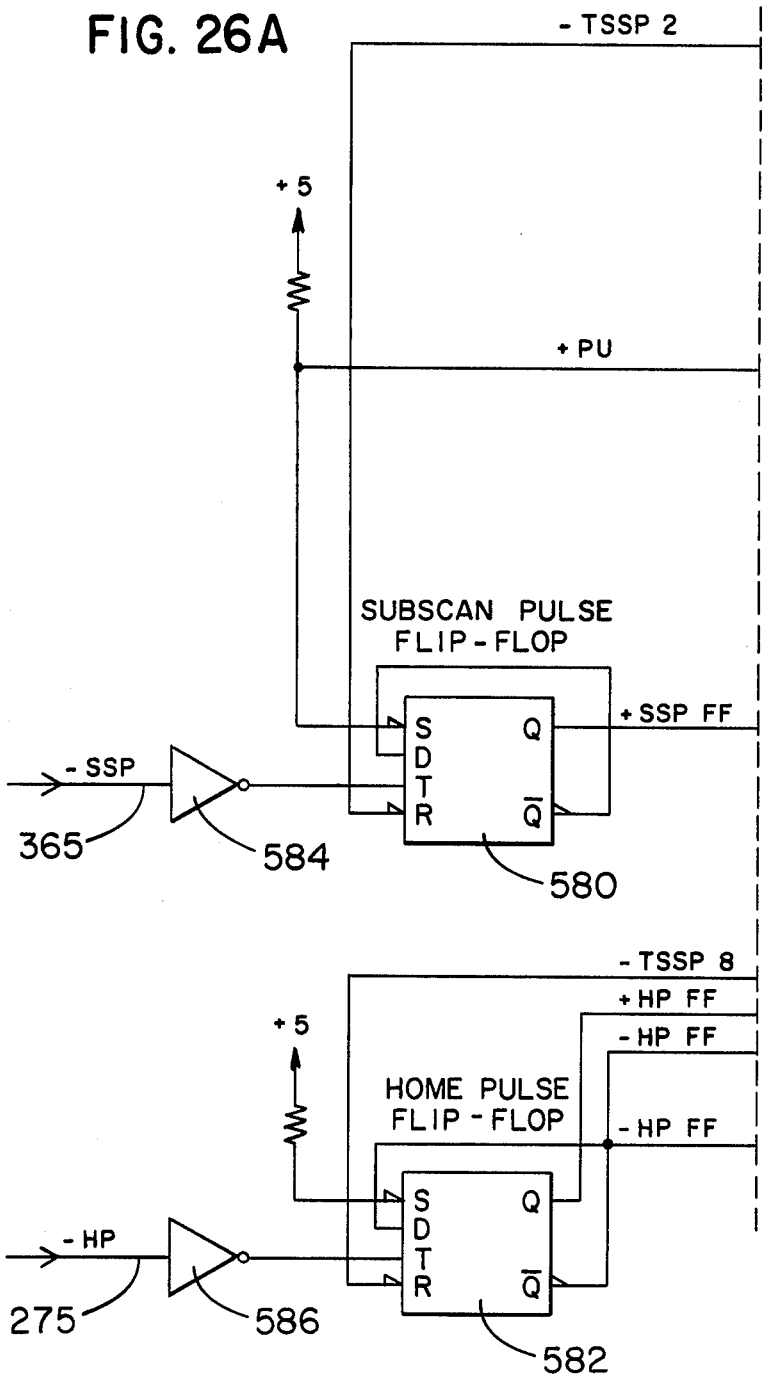
FIGS. 26A and 26B constitute a diagram for the subscan register and the subscan timing generator logic.
Figure 26B:
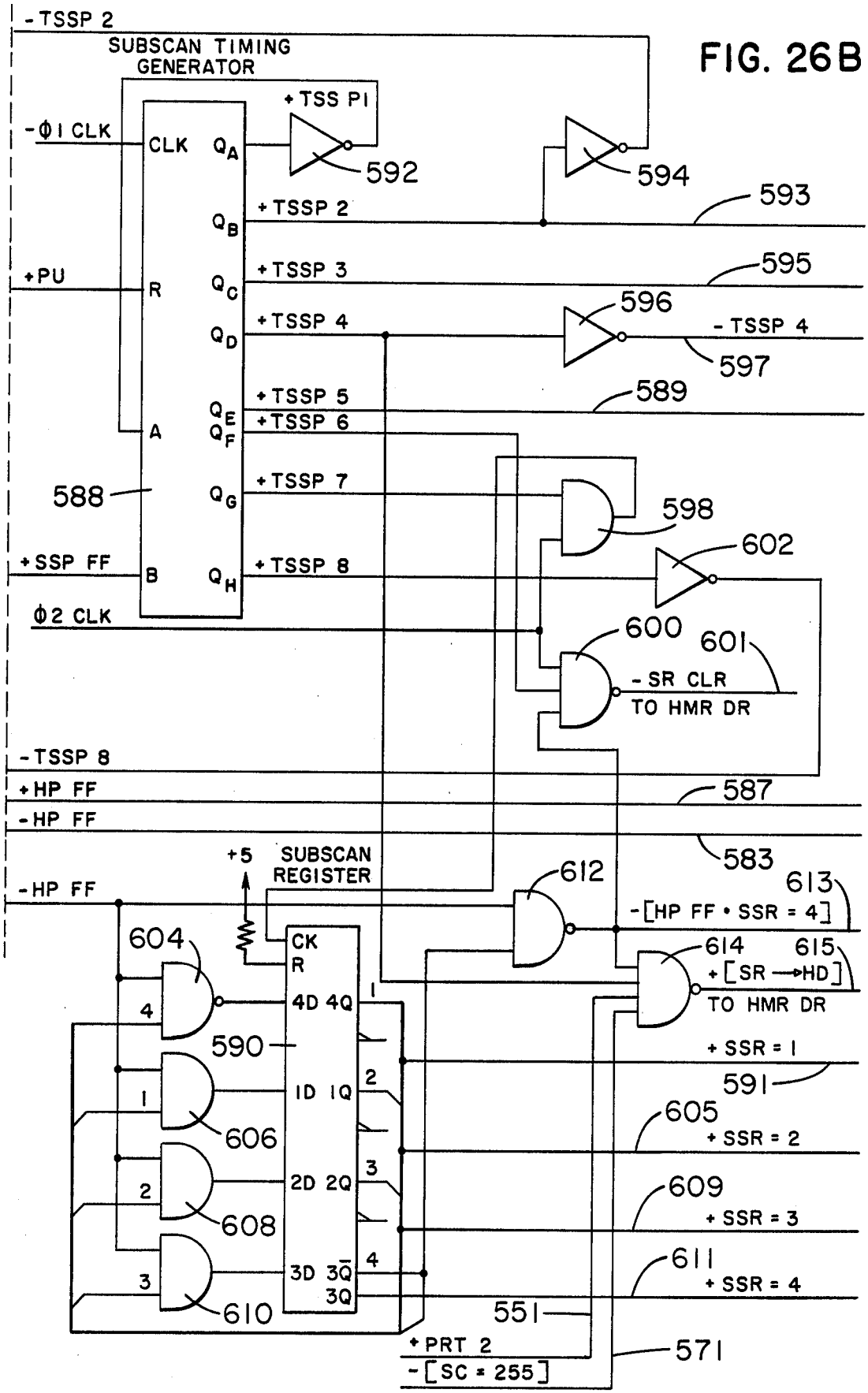

Referring now to FIGS. 26A and 26B, the subscan pulse 365 is sent through an inverter 584 and to a subscan pulse dual D type flip-flop 580, type number 7474, the output thereof being input to the subscan timing generator 588, which is an 8 bit serial in, parallel out shift register, type number 74164. The first output timing subscan pulse 1 signal of such register goes through an inverter 592, the second output TSSP2 signal 593 is sent through an inverter 594 and back to the flip-flop 580. The TSSP3 and TSSP5 signals 595 and 589 are sent to the other logic. The TSSP4 signal is an input to an inverter 596 and the output thereof is sent as signal 597. The TSSP6 signal is one input to a 3 input NAND gate 600, type number 7410, with the $\phi 2$ clock as a second input thereto. The TSSP7 signal is an input to an AND gate 598 along with the $\phi 2$ clock signal, the output of AND gate being the clock to the subscan register 590, which is a monolithic D type flip-flop with complementary output from each flip-flop, type 74175. The TSSP8 signal is input to an inverter 602, the output of which is returned to a home pulse dual D type flip-flop 582, type number 7474. The outputs of such flip-flop 582 are home pulse flip-flop signals 583 and 587. A home pulse flip-flop signal serves as one input to NAND gate 604 and AND gates 606, 608, and 610 with outputs thereof being fed to the register 590. The outputs of the register are sent out as subscan register 1 signal 591, SSR2 signal 605, SSR3 signal 609, and SSR4 signal 611. A NAND gate 612 receives a home pulse flip-flop signal and the SSR4 signal, the output of such NAND gate 612 being the home pulse flip-flop AND SSR4 signal 613. A dual 4 input NAND gate 614, type number 7420 receives inputs of the TSSP4 signal, the HP FF AND SSR4 signal 613, the print 2 signal 551, and the scan counter=255 signal 571, the output of which is the signal 615 to the hammer drivers, wherein the contents of the shift register are transmitted to the drivers. The signal 613 is also an input to the NAND gate 600, the output thereof being the shift register clear signal 601 to the hammer drivers.

Figure 27A:
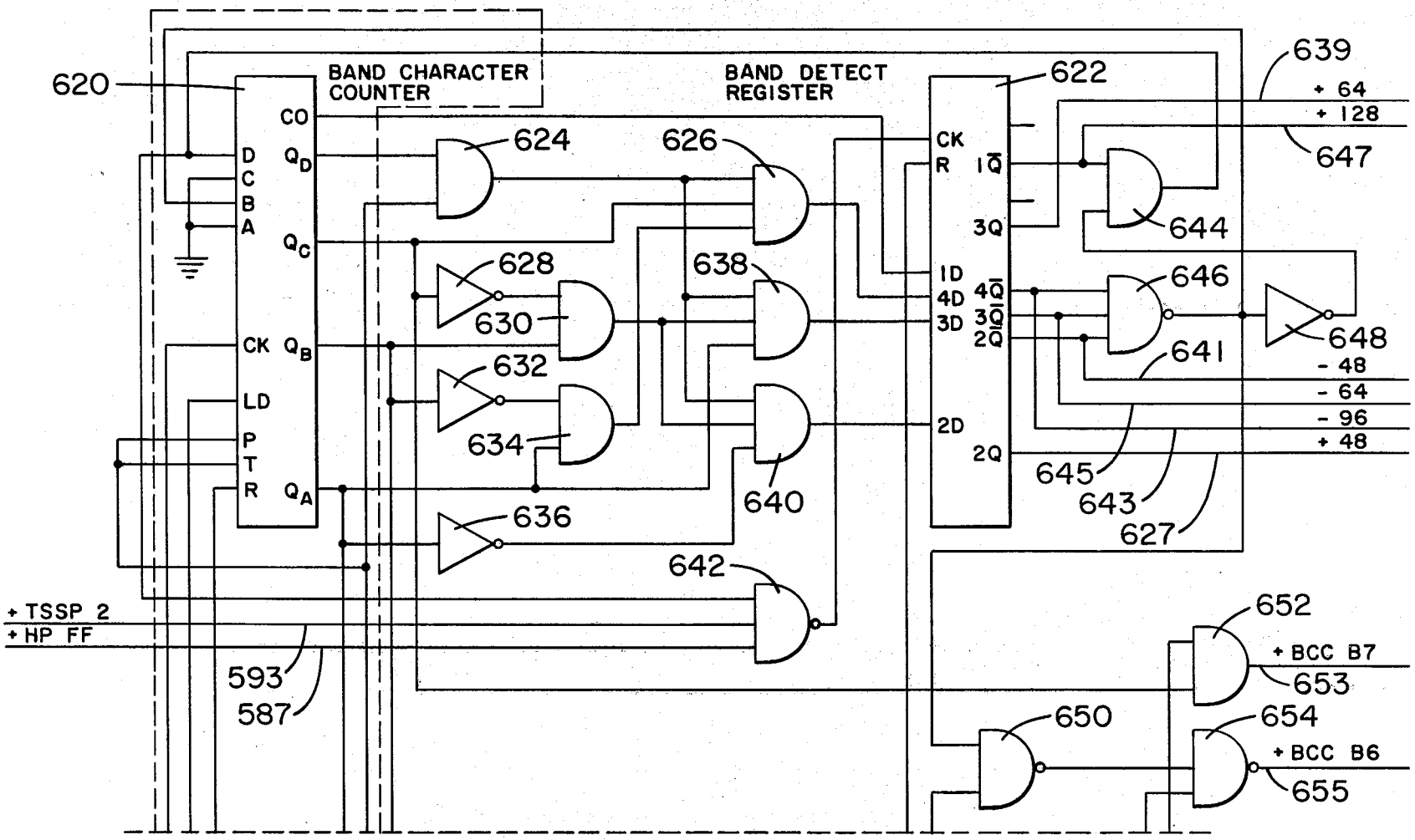
FIGS. 27A and 27B constitute a diagram for the band character counter and band detect register logic.
Figure 27B:
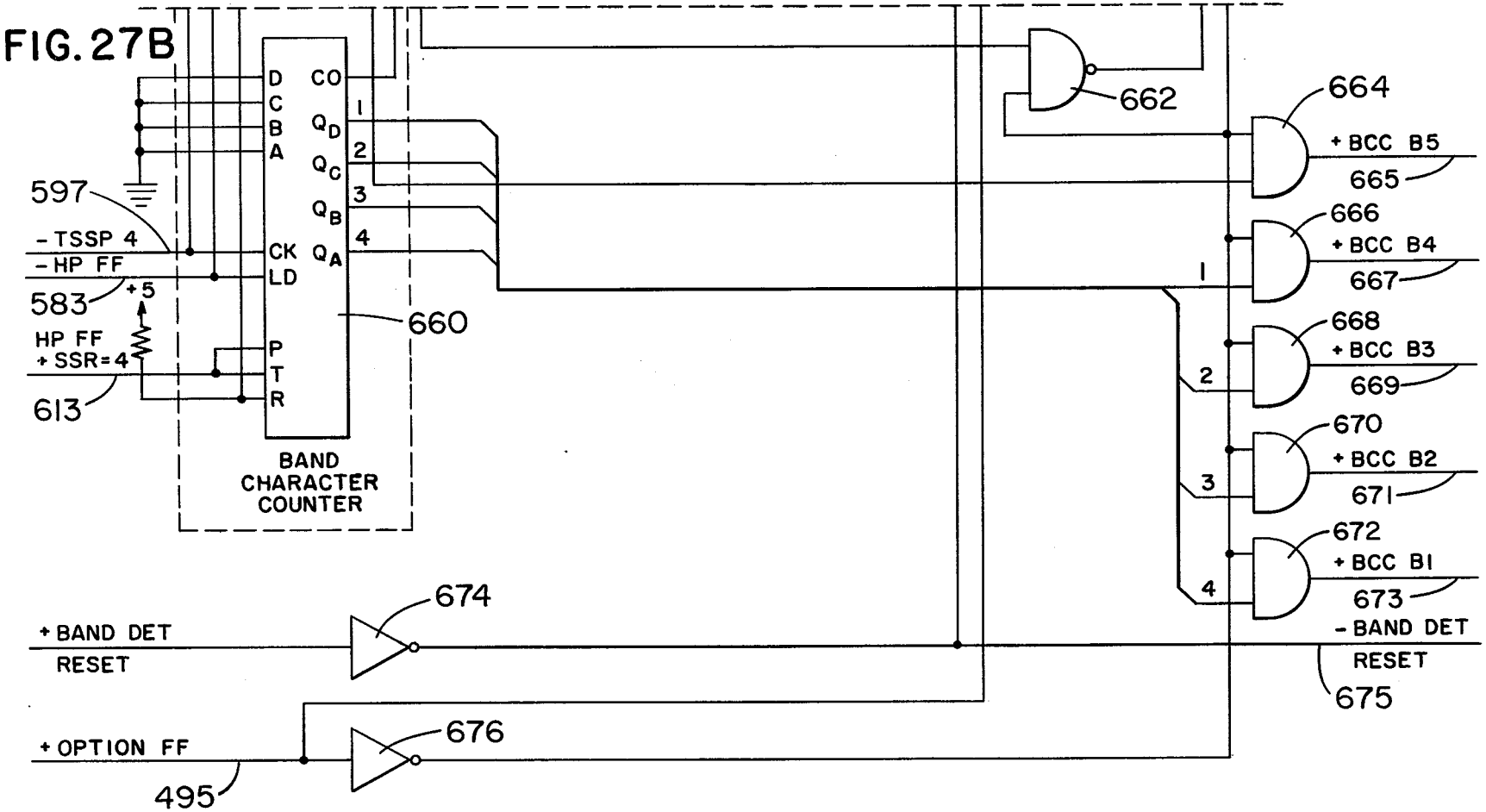

FIGS. 27A and 27B show the logic for the band character counter 167, the band detect logic 169, and the band character counter multiplexer 171, all shown on FIG. 4C. The band character counter increments once per scan (TSSP4 when subscan register=4) and is loaded to a start code for the band at TSSP4 time when the home flip-flop 582 (FIG. 26A) is set. Upon initial power up or after a gate open/closure sequence, the band detect reset signal 675 is active and holds a reset on a band detect register. This signal remains active until the band comes up to speed. During this time the band character counter is preset to the count of decimal 128 every time the home pulse flip-flop 582 (FIG. 26A) is set and the TSSP4 signal 597 becomes active. Every succeeding scan the band character counter is incremented. When the band detect reset signal 675 becomes inactive, the reset to the band detect register is removed allowing one of the four flip-flops in the register to be set at TSSP 2 time (signal 593) when the home pulse flip-flop 582 is set (signal 587). The specific flip-flop to be set in the band detect register is determined by the count in the band character counter at the above time. In this manner, the number of scans between settings of the home pulse flip-flop 582 are counted, thus allowing the determination of the type font (48, 64, 96, or 128) on the band. This information is stored in the band detect register. When one of the flip-flops in the register is set, the band character counter is loaded to decimal 32 for a 48, 64, or 96 character band and to 0 for a 128 character band—at TSSP 4 time when the home pulse flip-flop is set. The purpose of the band character counter is to track the specific character on the band which will be aligned with the first print column during the next scan. As seen in Table A, the band character counter would contain the code for Z+0 in scan Z0, Z+1 in scan Z1, etc. The code in the band character counter is clocked into the band code generator just prior to the start of an option cycle, the output of the band character counter being supplied to the band code generator via the band character counter multiplexer. When in an option cycle, and signal 495 is active high, the output of the band character counter multiplexer is set to decimal 32 for a 48, 64, or 96 character band and to 0 for a 128 character band. This provides the home or start code for the band code generator.

Referring again to FIGS. 27A and 27B, the timing subscan pulse 2 signal 593 and the home pulse flip-flop signal 587 are inputs to a 3 input NAND gate 642, type number 7410, the output going to clock a band detect register 622, which contains four monolithic D type flip-flops with complementary output from each flip-flop, type number 74175. The outputs of register 622 are respectively an input to AND gate 644, such input being a 128 character signal 647, a 64 character signal 639, a 96 character signal 643, a 64 character signal 645, a 48 character signal 641 and 627, the 641, 645, and 643 signals being inputs to a 3 input NAND gate 646, type number 7410, the output of which is sent to a band character counter 620, which is a synchronous 4 bit binary counter, type number 74161. The output of NAND gate 646 is also sent through an inverter 648, the output thereof being an input to the AND gate 644, with the output of such gate 644 being an input to the counter 620 and also an input to the NAND gate 642.

The timing subscan pulse 4 signal 597, the home pulse flip-flop signal 583, and the home pulse flip-flop+SSR=4 signal 613 are inputs to a like counter 660 as the counter 620, the first two signals 597 and 583 being input to the counter 620. Outputs of the counter 620 include the carry out therefrom as an input to the register 622, an input to AND gate 624 which receives a $\phi$ signal from the counter 660, the output of AND gate 624 being an input to a 3 input AND gate 626, type number 7411, a second input thereto being an output of the counter 620, the same output being sent through an inverter 628 as an input to AND gate 630. A third output of counter 620 is an input to the AND gate 630 and is sent through an inverter 632 as an input to AND gate 634, the fourth output of counter 620 being the second input to AND gate 634, such fourth output being sent through an inverter 636.

The output of AND gate 624 is also an input to a 3 input AND gate 638, type number 7411, and a like AND gate 640, the outputs of AND gates 626, 638, and 640 being inputs to the register 622.

A band detect reset signal is sent through an inverter 674 and is input to the register 622, with the inverted signal 675 sent as an output. The output of NAND gate 646 is an input to a NAND gate 650, the other input thereto being the option flip-flop signal 495, the output of NAND gate 650 being an input to a NAND gate 654. An input to the AND gate 630 is also an input to a NAND gate 662, the output thereof being an input to the NAND gate 654. The option flip-flop signal 495 is fed through an inverter 676, the output of which is an input to a plurality of AND gates 652, 664, 666, 668, 670, 672, and an input to the NAND gate 662, the devices 652, 654, 650, 662, 664, 666, 668, 670, 672, and 676 comprising the band character counter multiplexer. The outputs of the counter 660 are inputs to the gates 666, 668, 670, and 672. The second input to AND gate 664 is from an output of counter 620. The outputs of the AND gates 672, 670, 668, 666, 664, the NAND gate 654, and the AND gate 652 are respectively the band character counter B1 signal 673, the BCC B2 signal 671, the BCC B3 signal 669, the BCC B4 signal 667, the BCC B5 signal 665, the BBC B6 signal 655, and the BCC B7 signal 653 are sent as inputs to the band code generator.

Figure 28:
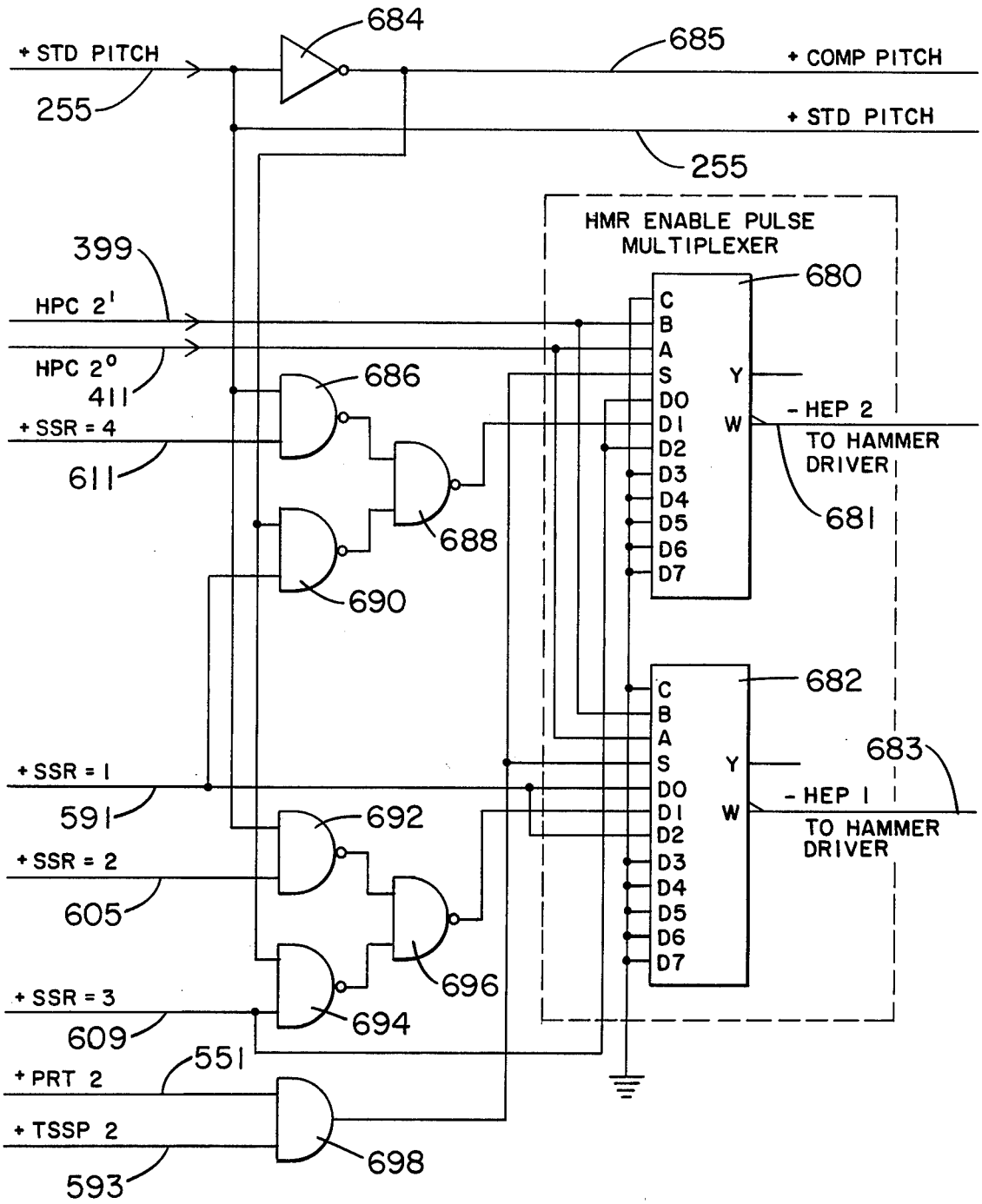
FIG. 28 is a diagram for the hammer enable pulse system logic.
Figure 29:
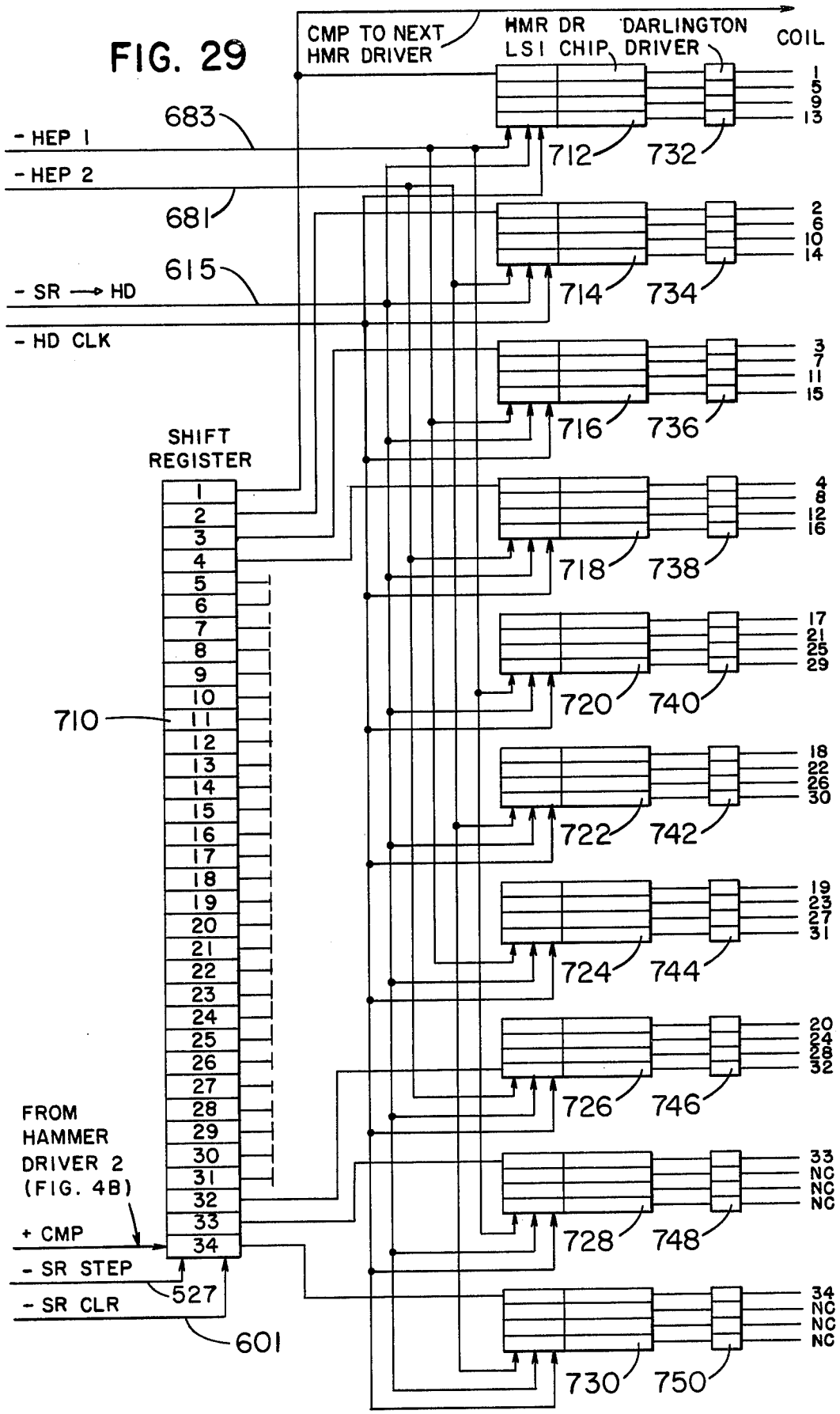
FIG. 29 is a detailed block diagram for the print hammer drivers.

FIG. 28 is the detailed logic for the hammer enable system pulse logic and represents the logic block 183 in FIG. 4D. The hammer enable pulse 1 and 2 signals (683 and 681) are connected to the hammer driver boards 1 and 2 (180 and 182 in FIG. 4B). These pulses 681 and 683, when active, cause the hammers to be activated for which compares are stored in the appropriate hammer drive latches in the hammer driver LSI chip (FIG. 29). The hammer enable pulses 681 and 683 are timed to occur at TSSP2 (signal 593) when in a Print 2 (signal 551) if the appropriate enabling conditions are present. The enabling conditions or variables which determine which hammer enable pulse is to be activated are (1) the type band on the printer (standard or compressed), (2) the position of the hammer bar as determined by the horizontal position counter (HPC $2^0$ and HPC $2^1$), and (3) the quadrant in the existing scan, (SSR=1, SSR=2, SSR=3, or SSR=4). The logic shown in FIG. 28 is the implementation of the equations below Table J for a 2 position standard pitch machine and below Table K for a 3 position compressed pitch machine.

FIG. 28 shows the circuitry for the generation of the hammer enable pulses (HEP) wherein standard pitch signal 255 is sent through an inverter 684 to provide the compressed pitch signal 685, the signal 255 being an input to a NAND gate 686 and an input to a NAND gate 692. The horizontal position counter $2^1$ signal 399 and the HPC $2^0$ signal 411 are input to the horizontal enable pulse multiplexer comprised of 680 and 682, which are 8 line to 1 line data selector/multiplexer with strobe, type number 74151. The signal 685 is an input to a NAND gate 690 and to a NAND gate 694. The subscan register=4 signal 611 is an input to NAND gate 686, the SSR=1 signal 591 is input to NAND gate 690 and to multiplexer 682, the SSR=2 signal 605 is fed to NAND gate 692, and the SSR=3 signal 609 is an input to NAND gate 694 and to the multiplexer 680. The outputs of NAND gates 686 and 690 are input to NAND gate 688, the output of which is an input to the multiplexer 680, and the outputs of NAND gates 692 and 694 are input to NAND gate 696, the output thereof sent to the multiplexer 682. The outputs of multiplexers 680 and 682 are HEP 2 signal 681 and HEP 1 signal 683 sent to the hammer drivers.

A circuit diagram of one hammer driver is shown in FIG. 29 wherein the hammer enable pulses (HEP1 and HEP2) are input to terminals of a plurality of latches and timing devices which are in the form of hammer driver LSI chips 712–730. A 34 bit serial shift register 710 is provided to receive the shift register step signals 527, the compare signal from hammer drive 2 (FIG. 4B), and the shift register clear signal 601, the output of the shift register 710 being connected to the LSI chips, the output of the LSI chips being connected to darlington drive circuits 732–750 for driving the various hammers by connection to the hammer coils.

FIG. 29 specifically represents hammer driver board 1 (180 in FIG. 4B) due to the coil numbering, the connections of hammer enable pulse 1 and hammer enable pulse 2 (683 and 681), and the fact that the compare signal to shift register 710 is coming from the previous hammer drivers (182 in FIG. 4B). For FIG. 29, to represent hammer driver board 2 (182 in FIG. 4B), add 34 to all coil numbers, interchange the hammer enable pulse signals 683 and 681, and indicate that the compare signal to shift register 710 is the compare signal 457 in FIG. 4B. These interchanges are accomplished via harness changes in the basic machine allowing the use of the same hammer drive assembly for both hammer driver board 1 (180 in FIG. 4B) and hammer driver board 2 (182 in FIG. 4B).

FIG. 4B shows the general arrangement of the hammer driver circuit boards 180 and 182 and the coils which drive the hammers, FIG. 29 shows the circuitry for enabling a group of 34 hammers with the HEP 1 signal 683 firing the odd numbered hammers and the HEP 2 signal 681 firing the even numbered hammers. The shift register 710 has a capacity to store 34 compare bits, such compare or lack of compare bits being stored when the shift register step 615 occurs, such shift register step signals 615 only occurring in an option cycle when the shift register counter matches the horizontal position counter indicating the presence of a hammer. Since the options are one scan ahead of the time that the contents of the shift register are transferred into the LSI chips, the compares or lack of compares are stored in the shift register 710. At the end of the scan, the shift register transfer to hammer driver signal 615 transfers the contents of the shift register 710 to the latches within the hammer driver LSI chip (712 through 730). When a HEP1 or a HEP2 pulse is sent to the chips that have compares stored therein, the darlington drivers 732–750 will fire the hammers. The chips 712–730 also contain counters which count to 100 and then turn off the drivers 732750 after 100 hammer driver clock pulses are counted, which turn off the hammers. Regardless of whether the machine is standard or compressed pitch, only 68 shift register step signal 615 are sent to the shift register 710 in any one scan, and firing of the hammers is done when only in the print 2 cycle, when hammer enable pulse 1 or 2 is received. The 68 shift register steps per scan are for a two position standard pitch machine printing 136 columns or for a three position compressed pitch machine printing 204 columns. The coils for the hammers are shown in groups wherein all the odd coils may be energized by hammer enable pulse 1 and all even coils by hammer enable pulse 2. This is shown more clearly in Tables J and K and the subsequent hammer enable pulse equations for Printer Number 2.

Also it should be noted that by connecting together the hammer enable pulse 1, 683, and the hammer enable pulse 2, 681, as shown in FIG. 29, and implementing the equations for hammer enable pulse 1 in the equations following Tables J and K for Printer Number 3, the hammer driver configuration shown in FIG. 29 can be used for such Printer Number 3.

Figure 30:
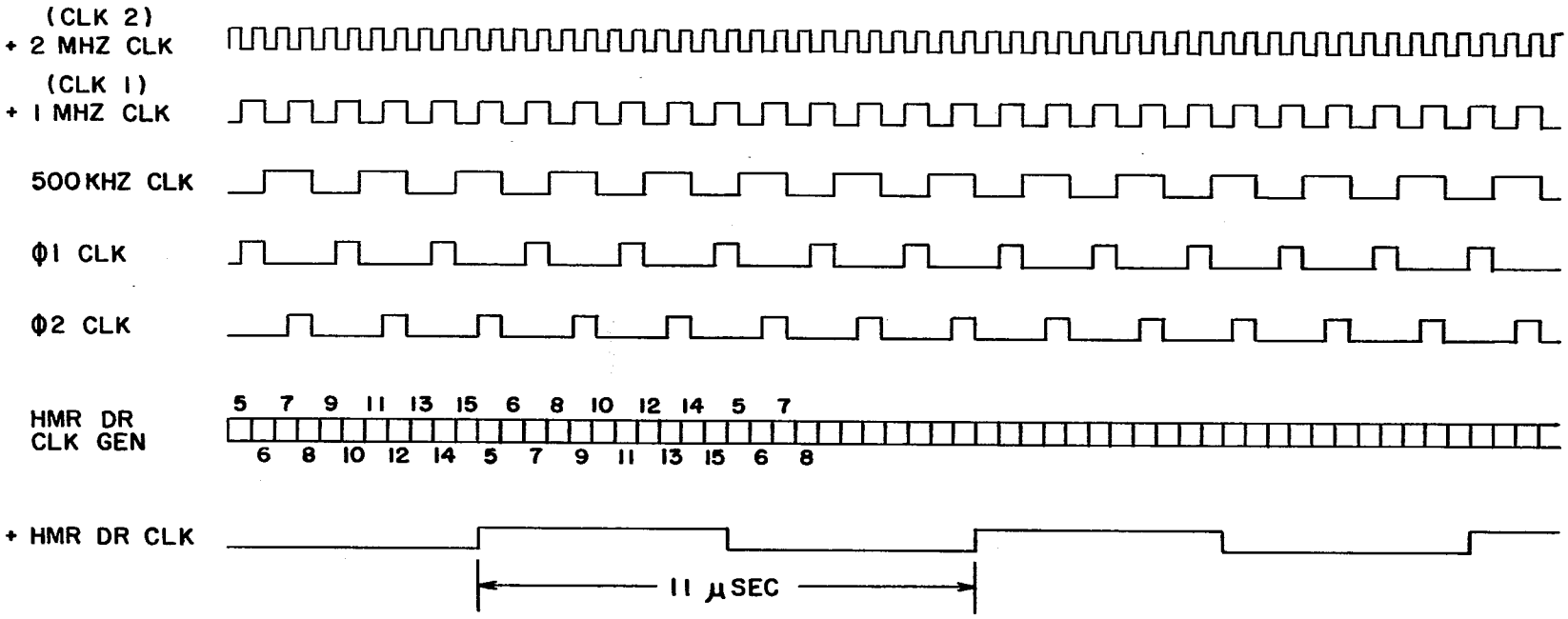
FIG. 30 is a timing diagram of the system clocks generated in the control logic.

FIG. 30 shows the timing diagram of the system clocks. The printer controller operates synchronously under the control of a 4 MHz oscillator which generates a series of pulses having a pulse width of 125 nanoseconds and a pulse repetition time of 250 nanoseconds. This clock frequency is then divided by a flip-flop to form the 2 MHz (clock 2) which has a pulse width of 250 nanoseconds and a pulse repetition time of 500 nanoseconds. The clock 2 frequency is then divided to form the 1 MHz clock (clock 1) which has a pulse width of 500 nanoseconds and a pulse repetition time of 1 second. The clock 1 frequency is then divided to form a 500 KHz clock used to generate the $\phi$1 and $\phi$2 clock pulses. The $\phi$1 and $\phi$2 clocks are generated by "anding" the clock 1 pulse with the 500 KHz signal, producing 500 nanosecond pulses with pulse repetition times of 2 microseconds, with the $\phi$1 and $\phi$2 clocks being offset from each other in timing by 1.5 microsecond. A hammer driver clock signal is generated by a 4 bit counter that is clocked by the clock 2 signal. The counter is preloaded to the count of 5 by the first clock 2 pulse and each succeeding clock 2 pulse increments the counter. When the counter reaches the count of decimal 15, the load signal is activated and the counter is reset to the count of 5, at which time the hammer driver clock flip-flop is set. When the counter again reaches the count of decimal 15, the flip-flop is reset, which provides a hammer driver clock pulse with a width of 5.5 microseconds and a repetition time of 11 microseconds.

FIG. 31 shows the character pulse and home pulse waveforms and the timing diagrams of the circuitry shown in FIGS. 5 and 6. The character pulse waveform is of sinusoidal shape for all characters of a standard pitch band and a compressed pitch band. The home pulse is shown as a solid line for standard pitch whereas, if a compressed pitch band is installed, the added home pulse shown in dotted line form also occurs, such pulse occurring within 1 millisecond after the first home pulse. The outputs of the Q4 and Q5 transistors are shown along with the timing of the home pulse latch. The output of the standard or compressed pitch detector devices, i.e., the home trigger one shot, the compressed pitch delay one shot, and the compressed pitch one shot is timed to set the compressed pitch latch if a second home pulse occurs, otherwise the compressed pitch latch remains reset indicating a standard pitch band.

FIGS. 32A and 32B show the timing diagrams of the major print cycles for standard and compressed pitch, respectively, the standard pitch being a two position printer and the compressed pitch being a three position printer. The load cycle for standard pitch is for a print line of 136 maximum columns and the compressed pitch is a print line of 204 maximum columns. In standard pitch after all data has been loaded, the option cycle or compares are made, wherein during each scan, the 136 positions of memory are compared with the contents of the standard pitch band and 68 shift register step pulses are transmitted to the hammer drivers. After completion of an option cycle, or 136 compares, the print 1 cycle is initiated along with the print 2 cycle, such print 2 cycle being the time during which the hammers may be fired. A print 2 cycle extends for the scan time corresponding to the number of characters in the set or font, 48 scans for 48 characters, 64 scans for 64 characters, 96 scans for 96 characters, and 128 scans for 128 characters. At the end of a print 2 cycle, wherein one-half of the print columns may be printed, the horizontal motion cycle is performed to move the hammers 1/10 inch and a second print 2 cycle is initiated to print on the other half of the columns. At the start of the first print 1 and assuming that the home position is fully left, the horizontal position counter indicates the count of zero and the leading edge of print 1 sets the horizontal direction control signal high corresponding to a horizontal motion to the right, when required. After two print 2 cycles are completed, Print 1 is reset and the vertical advance signal causes the paper to advance to the next line. Since the period of each waveform represents 1/30 inch, the horizontal motion is 1/10 inch. The horizontal position counter counts 0, 1 for the two position standard pitch machine. During the horizontal shift of the first line, the horizontal position counter is incremented from 0 to 1. Line 2 is a repetition of line 1 except that the horizontal direction control signal is set low at the leading edge of print 1 since the horizontal position counter is not equal to zero. Also during the shift in the second line the horizontal position counter is decremented from 1 to 0. This indicates that after the shift takes place the hammer bar will again be at the far left. It should be noted that the horizontal transducers indicate 3 sine waves for each horizontal shift, which indicates a displacement of 1/10 inch. It may be noted from FIG. 32A that for line 1, the two print cycles (prt 2) occur both at horizontal position counter equal 0 and 1—the first print cycle occurring at horizontal position counter equal 0, the second at 1. The converse is true for line 2, that is, the first print cycle occurs at horizontal position counter equal to 1 and the second at 0. The last print cycle of line 1 and the first print cycle of line 2 occurs at the same horizontal position. There are no horizontal shifts between the end of line 1 and the start of line 2.

In compressed pitch one hammer can cover three print columns and there are three print 2 cycles for every print 1 cycle, with 204 compares made of the memory positions and the characters during each scan in the option cycle. The horizontal motion is 1/30 inch for each waveform period of the horizontal transducer, these two waveform periods indicating a movement of 1/15 inch. During the print 1 cycle, there are three print 2 cycles and two horizontal motions. The horizontal position counter counts 0, 1, 2 for the compressed pitch.

FIG. 33 shows timing for the one character pulse to four subscan pulse logic 156 and for the one home pulse per character set logic 160 shown in FIG. 4A. The upper portion of FIG. 33 shows timing for the logic 156 and the lower portion of FIG. 33 for the logic 160, the logic 156 being expanded in FIG. 20 and the logic 160 being expanded in FIG. 9. For each character pulse produced from the band, there are four subscan pulses generated by the one character pulse to four subscan pulse logic which is in the form of the modulo 135 counter, the pulse counter modulo 4, the home pulse enable flip-flop, and the pulse counter clock (see FIG. 20). When the pulse counter clock device or the home pulse enable flip-flop is set, a subscan pulse is generated to the control logic. There is a delay in time between the triggering of the character trigger pulse one shot and the start of the subscan pulse which delay is determined by changes in the 36 volt D.C. supply and operator's phase adjust control. The nominal time between character pulses is 540 microseconds so a subscan pulse is generated every 135 microseconds. When the subscan start pulse becomes active, the pulse counter modulo 4 is setting at three, and the subscan start pulse resets the pulse counter modulo 4, which enables the clock to set the home pulse enable and generate the first subscan pulse. Three additional pulses are generated from the modulo 135 counter to increment the modulo 4 counter.

The standard/compressed pitch detector logic 162 insures that the control logic sees one home pulse regardless of standard or compressed pitch to provide a reference for tracking the band. The home pulse is synchronized to a particular subscan pulse and only allows one pulse per character font set even though in the compressed pitch there are two home pulses received from the band, i.e., only one home pulse will be generated per font set to the control logic.

Figure 34:
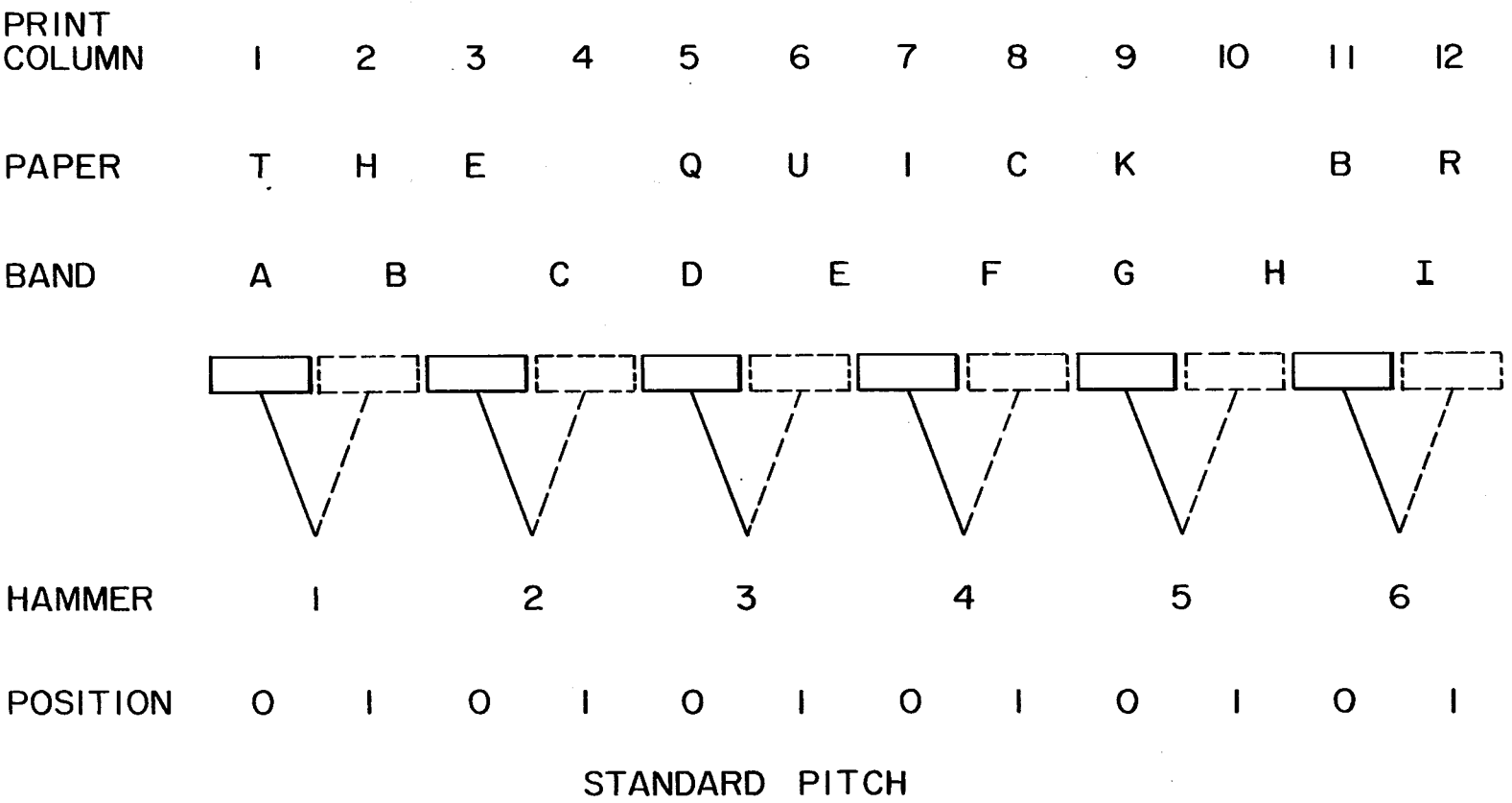
FIG. 34 is a diagram showing the relationship of several hammers with print column positions and characters on the band in a two position standard pitch mode.

FIG. 34 shows a diagram of the relationship of several of the print hammers with the print column positions and the character positions of the band for a two position standard pitch mode. In this relationship, the print columns are spaced at 1/10 inch with printing on the paper being at the same spacing. The characters on the band are spaced at 4/30 inch and the hammers are spaced at every other print column position or at 2/10 inch centerlines. Each of the hammers is horizontally movable one print column position, as shown by the solid and dotted lines, and is designated as position 0 or position 1 in the standard pitch printing mode.

Figure 35:
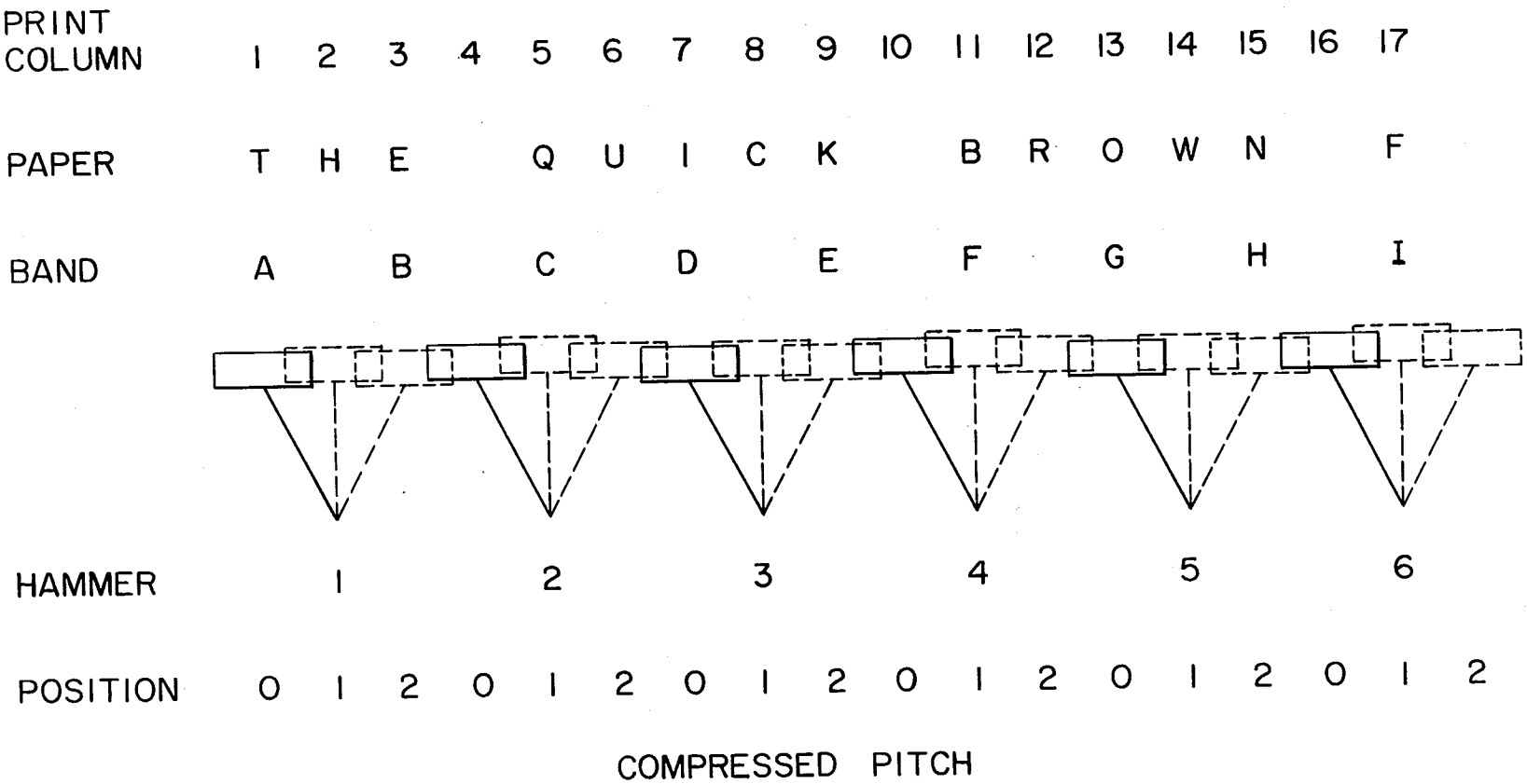
FIG. 35 is a diagram similar to the diagram shown in FIG. 34 except for a three position compressed pitch mode.

FIG. 35 shows a similar diagram as FIG. 34 of the relationship of several print hammers with the print column positions and the character positions on the band for a three position compressed pitch mode. In this relationship, the print columns are spaced at 1/15 inch with printing on the paper being at the same spacing. As in the standard pitch mode, the characters on the band are spaced at 4/30 inch and the hammers are positioned so that one hammer can be moved to any one of three positions to cover the spacing for the compressed pitch. Each of the hammers being movable to any one of the three positions is designated to be in position 0, position 1 or position 2 in the compressed pitch printing mode. The hammers are spaced every 3rd print column position or on 2/10 inch centerlines, the same as when in the standard pitch mode.

Figure 36:
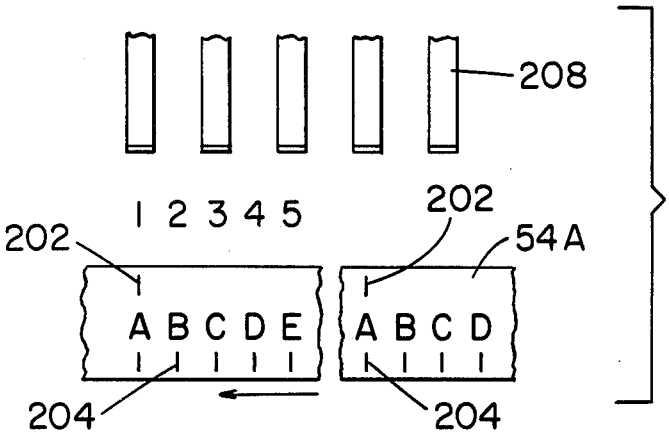
FIG. 36 is a diagrammatic view of several hammers together with a portion of the character band showing the pulse marking for standard pitch.

In FIG. 36 is shown a simple diagram of the hammers 208, the print column positions, and a portion of the character band 54A showing the character marks 204 and the home mark 202 thereon for a standard pitch machine.

Figure 37:
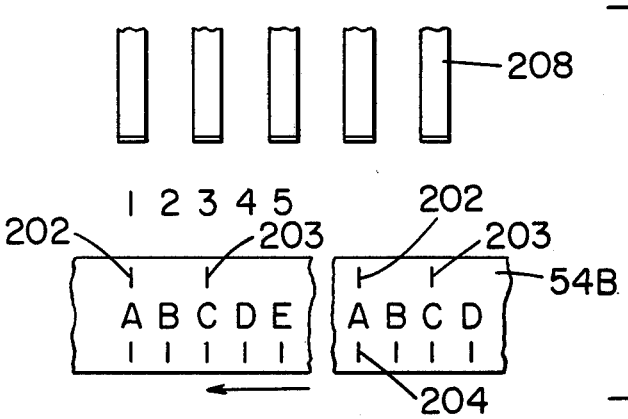
FIG. 37 is a similar view as FIG. 36 and showing the pulse marking for compressed pitch.

In FIG. 37 is shown a similar diagram as FIG. 36 including the hammers 208 and portions of the character band 54B for a compressed pitch mode wherein the band includes character marks 204 for each character, a home mark 202 and a second home mark 203 indicating a compressed pitch band.

Figure 38:
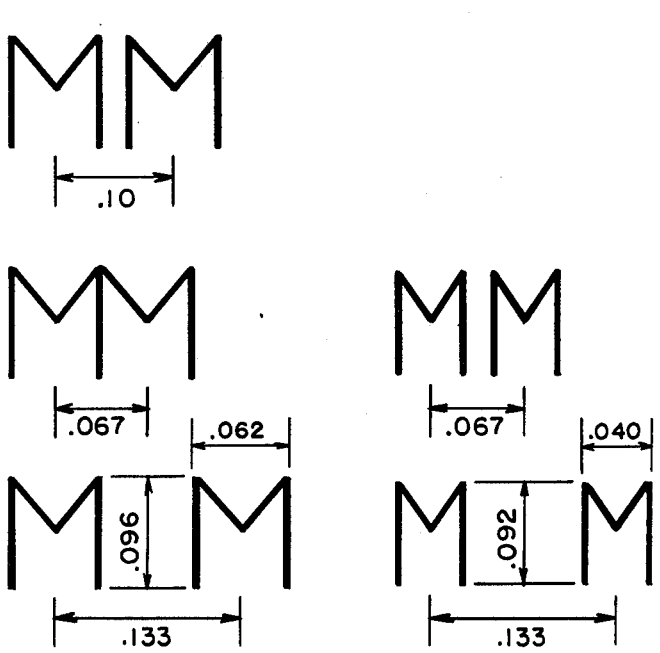
FIG. 38 is a diagram showing the relationships in spacing the standard pitch characters and the compressed pitch characters.

A comparison of the size and spacing of the characters for a standard and a compressed pitch mode is shown in FIG. 38 wherein the top line shows a pair of standard pitch characters M printed on 1/10 inch centers. The second line of characters shows on the right thereof the compressed pitch characters M printed in the compressed pitch mode of 1/15 inch, while the left portion of the second line shows the standard pitch characters M spaced at 1/15 inch and it is thus seen that the standard pitch character would be too wide for the compressed pitch print spacing. The lower line shows the spacing of both the standard pitch character and the compressed pitch character on the band as being 4/30 inch.

Figure 39:
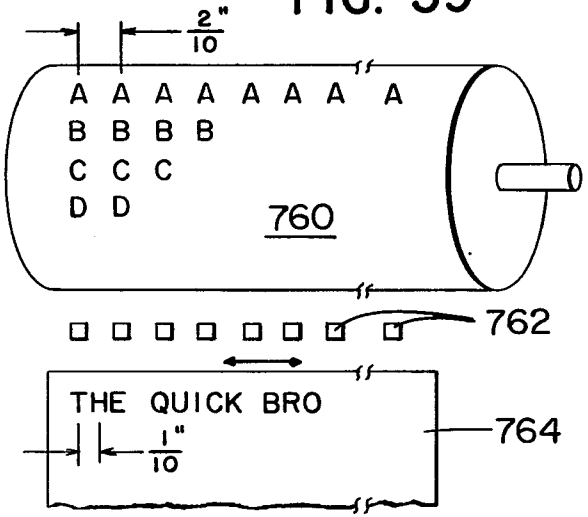
FIG. 39, on the sheet with FIGS. 7 and 8, is a view of a character carrying drum as a modification of the inventive structure.

FIG. 39, on the sheet with FIGS. 7 and 8, shows a modification of the invention wherein the type character carrying member is a drum 760 having rows and columns of type characters thereon, such characters being spaced at 2/10 inch for both a two position standard pitch printer and a three position compressed pitch printer. A plurality of hammers 762 are aligned with the columns of type characters, and paper 764 is shown with printing thereon at 1/10 inch in standard pitch spacing. In compressed pitch the spacing of the printed characters would be at 1/15 inch for printing at 15 characters per inch.

The hammers 762 may be selectively energizable, as in typical drum printer applications, and controlling the position of the paper in similar manner that the hammer bar is controlled in the description of the preferred embodiment of the invention. The drum 760 is caused to be continuously rotated at a desired speed by any well-known drive means, and the paper is caused to be horizontally shifted in the required direction to obtain the required horizontal motion of 1/10 inch in the standard pitch mode, or shifted to obtain the required horizontal motion of 1/15 inch in the compressed pitch mode. Shifting the paper could also be performed by a voice coil connected to move the paper feed tractors in horizontal motion along the printing station.

In a four position standard pitch printer or a six position compressed pitch printer, the characters on the drum would be spaced at 4/10 inch and the paper would be shifted in three increments of 1/10 inch for standard pitch or five increments of 1/15 inch for compressed pitch.

It should be readily apparent that with a band or like horizontal font machine, the hammers may be shifted or the paper may be shifted, whereas with a drum printer the paper would be shifted the required distance. Additionally, while the type character carrying member may be horizontally shifted, the means or mechanism for so doing would be more complex and such shifting of these members would not be common practice.

While the preferred embodiment shows and describes a dual pitch printing system, it is understood, of course, that extensions thereof may include a triple pitch system. For example, such system may print 10, 15, or 20 characters per inch. The addition of a modulo 8 counter, as seen in Table L, gives an example of how the present invention can be modified or extended to track the band. The band code generator is only incremented when the modulo 8 counter is at the count of decimal 0, 2, or 5 when printing at 20 characters per inch. Needless to say, 8 subscans would now have to be developed from each character mark on the band and possibly a third home mark per character set added to the band to detect the 1/20 inch print band. The hammer drivers would have to be modified along with the hammer enable pulse signal logic and, as previously stated, the horizontal servo logic would also have to be changed or modified.

TABLE L

| Prt. Col. -- | 1 | 2 | 3 | 4 | 5 | 6 | 7 | 8 | 9 | 10 | 11 | 12 |
|---|---|---|---|---|---|---|---|---|---|---|---|---|
| Sub Scan | | | | | | | | | | | | |
| 1 | Z+0 | | | | | | | | Z+3 | | | |
| 2 | | | | | | Z+2 | | | | | | |
| 3 | | | Z+1 | | | | | | | | Z+4 | |
| 4 | | | | | | | | Z+3 | | | | |
| 5 | | | | | Z+2 | | | | | | | |
| 6 | | Z+1 | | | | | | | | Z+4 | | |
| 7 | | | | | | | Z+3 | | | | | Z+5 |
| 8 | | | | Z+2 | | | | | | | | |
| | | Band Code Generator | | | | | | | | | | |
| Mod 8 Cntr. | 0 | 1 | 2 | 3 | 4 | 5 | 6 | 7 | 0 | 1 | 2 | 3 |
| (FOUR POSITION AT 1/20" PRINTING) | | | | | | | | | | | | |
| Hmrs. | [1] | X | X | X | [2] | X | X | X | [3] | X | X | X |
| HPC | 0 | 1 | 2 | 3 | 0 | 1 | 2 | 3 | 0 | 1 | 2 | 3 |
| (EIGHT POSITION AT 1/20" PRINTING) | | | | | | | | | | | | |
| Hmrs. | [1] | X | X | X | X | X | X | X | [2] | X | X | X |
| HPC | 0 | 1 | 2 | 3 | 4 | 5 | 6 | 7 | 0 | 1 | 2 | 3 |

Note: The above table depicts the hammers at HPC=0.

In any event it would be possible to add a third pitch to printer numbers 2 and 3, as described in Table I, which would allow a specific printer to print any one of three character pitches by changing bands.

Figure 40A:
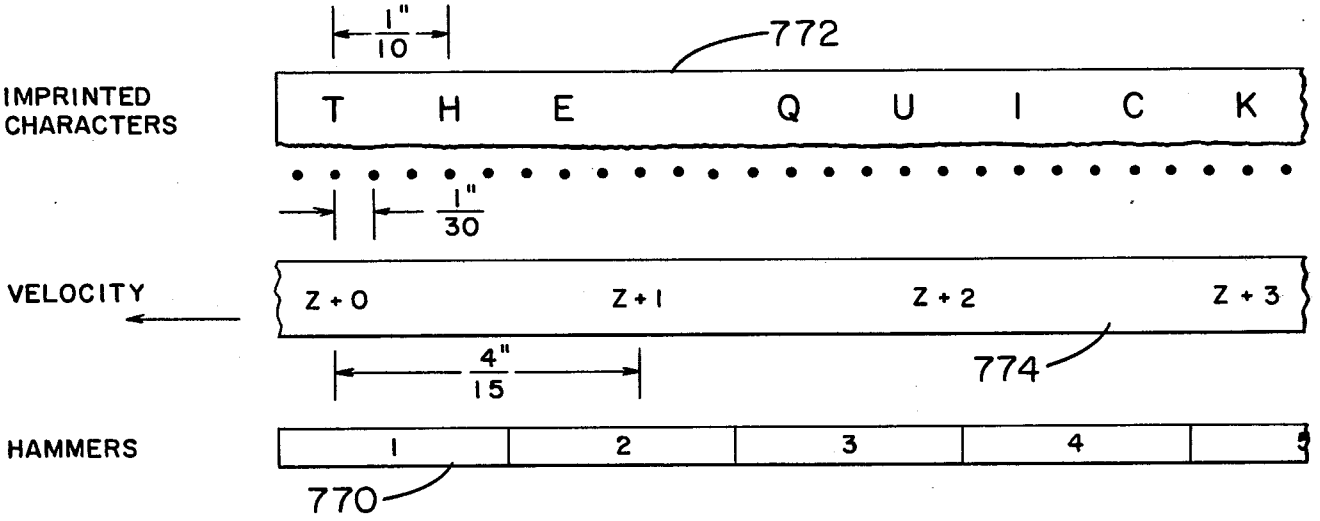
FIGS. 40A and 40B show the relationship of the print columns, the band characters, and double width hammers for standard and compressed pitch, respectively.
Figure 40B:
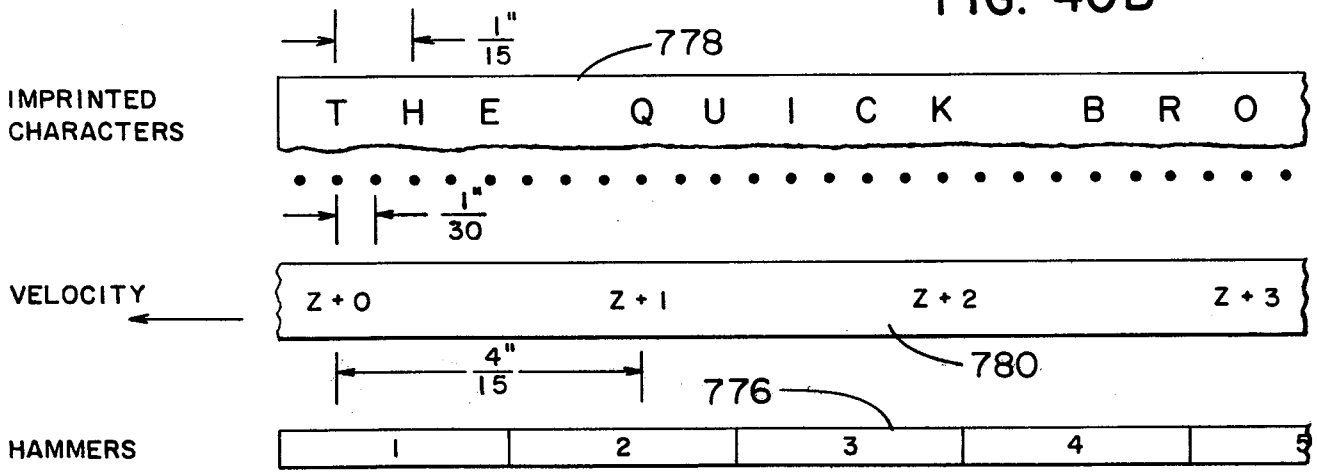

Another method to obtain a multi-pitch printing printer is to use a multi-width hammer. For simplicity of explanation, a double width hammer approach utilizing two different bands will be explained. The centerline distance between adjacent characters on the type character carrying member will be defined as 4/15 inch—twice the distance between characters on the band as described in the preferred embodiment of the present invention. The hammer width is defined as slightly less than 2/10 inch. The relationship of the print columns, the band characters, and the hammer width is shown in FIGS. 40A and 40B for both printing at 10 and 15 characters per inch. As can be readily seen from FIG. 40A, one hammer 770 covers two print columns or imprints two characters on paper 772 when printing at 10 characters per inch, with the characters on the band 774 being represented as Z+0, Z+1, Z+2, etc. at 4/15 inch. FIG. 40B shows each hammer 776 covering three print columns or imprinting three characters on paper 778 when printing at 15 characters per inch, with the characters on the band 780 being represented as Z+0, Z+1, Z+2, etc. at 4/15 inch. This concept is almost identical in philosophy to the preferred embodiment of the present invention except that the time sharing of hammers is accomplished via hammers covering more than one print column using the dimensions of the hammers rather than causing a single width hammer to move in order to cover more than one print column.

Referring back to and utilizing equation 1, it can be shown that the X/Y ratio is 8/3 for 10 character per inch printing and 4/1 for 15 character per inch printing.

Tables M and N are parallels to Tables E and F. Table M represents a pictorial aid in defining the major bookkeeping required for a double width hammer and printing at 10 characters per inch.

TABLE M

| DOUBLE WIDTH - IMPRINTED CHARACTERS AT 10 CPI | | | | | | | | | | | | |
|---|---|---|---|---|---|---|---|---|---|---|---|---|
| Prt. Col. -- | 1 | 2 | 3 | 4 | 5 | 6 | 7 | 8 | 9 | 10 | 11 | 12 |
| Hmrs. at HFC=0 | 1 | | 2 | | 3 | | 4 | | 5 | | 6 | |
| HFC=1 | | 1 | | 2 | | 3 | | 4 | | 5 | | 6 |
| Sub-Scan | | | | | | | | | | | | |
| 1 | Z+0 | | | | | | | | Z+3 | | | |
| 2 | | | | | | Z+2 | | | | | | |
| 3 | | | Z+1 | | | | | | | | Z+4 | |
| 4 | | | | | | | | Z+3 | | | | |
| 5 | | | | | Z+2 | | | | | | | |
| 6 | | Z+1 | | | | | | | | Z+4 | | |
| 7 | | | | | | | Z+3 | | | | | |
| 8 | | | | Z+2 | | | | | | | | Z+5 |
| | Band Code Generator | | | | | | | | | | | |
| Mod 8 Cntr. SR Step | 0 | 1 | 2 | 3 | 4 | 5 | 6 | 7 | 0 | 1 | 2 | 3 |

TABLE M-continued

| DOUBLE WIDTH - IMPRINTED CHARACTERS AT 10 CPI | | | | | | | | | | | | |
|---|---|---|---|---|---|---|---|---|---|---|---|---|
| Counter | 0 | 1 | 0 | 1 | 0 | 1 | 0 | 1 | 0 | 1 | 0 | 1 |

The HFC term stands for hammer face counter, HFC=0 being defined as the portion of the hammer which prints the odd columns with HFC=1 being that portion of the hammer face required to print the even columns. The modulo 8 counter is shown as a means to control the band code generator. Based on knowing the position of Z+0 in front of column 1, it can be seen that the band code generator can be incremented when the modulo 8 counter equals 0, 2, and 5. The shift register step counter is utilized to match the hammer face counter to perform the same function that the shift register step counter and horizontal position counter performed in the present invention.

Table N is merely an extension of Table M for printing at 15 characters per inch using a double width hammer.

TABLE N

| DOUBLE WIDTH - IMPRINTED CHARACTERS AT 15 CPI | | | | | | | | | | | | |
|---|---|---|---|---|---|---|---|---|---|---|---|---|
| Prt. Col. -- | 1 | 2 | 3 | 4 | 5 | 6 | 7 | 8 | 9 | 10 | 11 | 12 |
| Hmrs. at HFC=0 | 1 | | | 2 | | | 3 | | | 4 | | |
| HFC=1 | | 1 | | | 2 | | | 3 | | | 4 | |
| HFC=2 | | | 1 | | | 2 | | | 3 | | | 4 |
| Sub-Scan 1 | Z+0 | | | | Z+1 | | | | Z+2 | | | |
| 2 | | | | | | | | | | | | |
| 3 | | | | Z+1 | | | | Z+2 | | | | Z+3 |
| 4 | | | | | | | | | | | | |
| 5 | | | Z+1 | | | | Z+2 | | | | Z+3 | |
| 6 | | | | | | | | | | | | |
| 7 | | Z+1 | | | | Z+2 | | | | Z+3 | | |
| 8 | Band Code Generator | | | | | | | | | | | |
| Mod 4 Cntr. | 0 | 1 | 2 | 3 | 0 | 1 | 2 | 3 | 0 | 1 | 2 | 3 |
| SR Step Counter | 0 | 1 | 2 | 0 | 1 | 2 | 0 | 1 | 2 | 0 | 1 | 2 |

It should also be apparent that hammer widths wider than a double width could be utilized. Also more than two pitches can be produced such as 10, 15, and 20 character per inch printing. In addition it should also be apparent that multi-width hammers with associated hammer face movement could be utilized thereby employing two techniques for time sharing, and that multi-width hammers and horizontal movement of paper could also be employed.

It is thus seen that herein shown and described is a dual pitch impact printing mechanism for printing at one pitch or at another pitch, dependent upon the type character band installed on the printer. The control mechanism detects or senses the particular band and adjusts to print at 10 characters per inch or at 15 characters per inch, the imprinted characters being spaced at 1/10 inch in the standard pitch mode and the imprinted characters being spaced at 1/15 inch in the compressed pitch mode. Although one basic embodiment and several modifications have been disclosed herein, variations thereof may occur to those skilled in the art. It is contemplated that all such variations, not departing from the spirit and scope of the invention hereof, are to be construed in accordance with the following claims.

What is claimed is:

1. A method of printing characters in print columns at one or another character pitch, comprising the step of:

providing a plurality of type character carrying members, each having one or another type character pitch defining indicia thereon;

conditioning printing of said characters dependent upon detecting either the one or another character pitch defining indicia;

receiving printing data in serial order;

comparing said printing data with characters on one of said type character carrying members; and causing printing of said characters with printing means in accordance with said character pitch indicia detected.

2. The method of claim 1 including the additional step of sorting the printing data after receipt thereof.

3. The method of claim 1 including the additional step of time sharing adjacent print columns by movement of printing means in accordance with said character pitch indicia detected.

4. The method of claim 3 including the additional step of maintaining said printing means to in print column printing relationship during the comparing of said print data.

5. The method of claim 1 including the additional step of shaping the detected character pitch indicia to provide a timing pattern and to generate therefrom a physically positioned relationship between the characters on the type carrying member and print columns to be printed.

6. The method of claim 1 including the additional step of tracking the characters on said type character carrying member for determining the format of the characters thereon.

7. A method of printing characters along a line of printing at one or another character pitch, comprising the steps of:

providing a plurality of type character carrying members, each having first or second character pitch sensing indicia thereon;

selecting printing control of characters to be printed dependent upon sensing of the first or the second character pitch sensing indicia;

inputting printing data in serial order;

comparing said printing data with characters on one of said type character carrying members; and impacting hammer means against said type character carrying member for printing said characters in print column order in accordance with said character pitch sensing indicia sensed.

8. The method of claim 7 including the additional step of time sharing adjacent print columns by movement of said hammer means in accordance with the character pitch sensing indicia sensed.

9. The method of claim 7 including the additional step of storing the printing data after input thereof.

10. The method of claim 7 including the additional step of maintaining said hammer means to in print column printing relationship during the comparing of said printing data.

11. The method of claim 7 including the additional step of tracking the characters on said type character carrying member for determining the format of the characters thereon.

12. A method of printing characters in print columns at one or another character pitch dependent upon the type character carrying member on a printer, comprising the steps of:

sensing an initial character of a plurality of characters on said type character carrying member;

sensing each of said plurality of characters on said type character carrying member in successive manner;

utilizing the sensed characters to provide a timing pattern and to generate therefrom a physically positioned relationship between the sensed initial character, the sensed successive characters, and the position of the type character carrying member relative to the print columns;

receiving printing data;

comparing said printing data with the characters on said type character carrying member; and enabling printing of characters with impact means at the one or another character pitch.

13. The method of claim 12 including the additional step of time sharing adjacent print columns by movement of said impact means in accordance with the initial character sensed.

14. The method of claim 12 including the additional step of shaping the sensed initial character and the sensed successive characters to provide said timing pattern for generating the physical relationship between the characters on the type carrying member and the print columns.

15. A printer for printing characters at one or another character pitch, comprising a plurality of removable type character carrying members for said printer, each of said type character carrying members defining standard or compressed pitch characters thereon;

impact means;

means for conditioning said impact means in accordance with the pitch of said characters;

means inputting printing data in serial order;

means comparing said printing data with the characters of one of said type character carrying members; and means for actuating said impact means for printing characters in accordance with said conditioning means.

16. The printer of claim 15 wherein said type character carrying members each defines character pitch defining indicia thereon.

17. The printer of claim 16 wherein said printer includes means sensing the character pitch defining indicia.

18. The printer of claim 16 wherein said printer includes means responsive to said character pitch defining indicia for conditioning said impact means.

19. The printer of claim 15 wherein said conditioning means includes means determining a relationship between the standard or compressed characters on the type character carrying member and print columns to be printed.

20. The printer of claim 15 including means sensing an initial character and means sensing each character on said type character carrying member in successive manner for conditioning said impact means.

21. Printing apparatus capable of printing characters along a line of printing on record media at one or another character pitch, said apparatus comprising a:

type character carrying member being continuously moved past said line of printing;

means for sensing an initial character on said type character carrying member;

means for sensing each character on said type character carrying member in successive manner;

means for detecting the pitch of characters to be printed;

means providing a timing pattern for generating a physical relationship between the characters on the type character carrying member and print columns making up said line of printing in relation to the position of the type character carrying member, the sensed initial character, and the sensed successive characters;

means for accepting print data and storing thereof;

means for comparing said stored data with characters on said type carrying member;

means for impacting against the characters on said type character carrying member in one or another of said print columns in accordance with the character pitch detected;

means for determining an impacting means to print column relationship; and means for enabling said impacting means to be actuated for printing characters at the character pitch dependent upon the type character carrying member, the impacting means to print column relationship, and the physical relationship generated from the detected initial character and the detected successive characters on said type character carrying member.

22. The printing apparatus of claim 21 wherein said type character carrying member is a removable band having characters thereon at one or another character pitch.

23. The printing apparatus of claim 21 wherein said type character carrying member is a drum having characters thereon at one or another character pitch.

24. The printing apparatus of claim 21 wherein said type character carrying member includes character pitch defining indicia thereon and means sensing said indicia for causing said impacting means to print characters at one or another character pitch.

25. The printing apparatus of claim 21 wherein said type character carrying member is a drum having characters at one or another character pitch and means for displacing said record media along said drum is provided for printing at the one or another character pitch on said record media.

26. In a printer, means for determining the character pitch for printing characters at one or another character pitch, a plurality of removable type character carrying members each having one or another character pitch thereon;

means for impacting one of said type character carrying members;

first character pitch indicia on said type character carrying member;

second character pitch indicia on said type character carrying member;

means for detecting said first and said second character pitch indicia and having an output indicative of the character pitch detected; and means responsive to the output of said detecting means for enabling said impacting means to print characters at the one or another character pitch.

27. In the printer of claim 26 including means for displacing said impacting means for sharing adjacent print columns in timed relationship for printing at the one or another character pitch.

28. In the printer of claim 26 including means for receiving print data in serial order and comparing said print data with said characters on said type character carrying member for causing said impacting means to impact said type character carrying member.

29. In the printer of claim 26 wherein said detecting means comprises transducers for detecting said first and said second character pitch indicia.

30. A control system for controlling printing of characters in print columns along a line of printing at one or another character pitch, type characters carried on removable type character carrying members continuously moved past said line of printing, and impact means positioned adjacent said line of printing, said control system comprising:

character pitch defining indicia of one or another pitch on each of said type character carrying members;

means responsive to the character pitch defining indicia dependent upon detecting one or another character pitch;

means for receiving printing data;

means for comparing said printing data with the type characters on the detected type character carrying member and having an output; and means for transferring said comparing means output to said impact means for printing at the detected character pitch.

31. The control system of claim 30 wherein said character pitch defining indicia comprises one timing mark on said type character carrying member for indicating type characters of one pitch or two timing marks on said type character carrying member for indicating type characters of another pitch.

32. The control system of claim 31 including transducer means adjacent said type character carrying member for sensing said timing marks.

33. In a printer for printing characters in print columns defining a line of printing at one or another character pitch dependent upon the type character carrying member on the printer, a plurality of type character carrying members, each having a plurality of characters thereon and indicia defining one or another character pitch;

impact means adjacent said type character carrying member for impacting thereagainst;

means for sensing each of said characters on said type character carrying member in successive manner;

means for sensing the one or another character pitch indicia;

means responsive to the sensing means for providing timing for said impact means and for generating a positional relationship between the sensed characters in the first print column and between the successive sensed characters and the remaining print columns;

means for inputting print data;

means for comparing said input print data with the sensed characters;

means for time sharing said impact means for printing at one or another print column;

means for generating an impact means to print column relationship based on time sharing thereof; and means enabling said impact means to be impacted against said characters on said type character carrying member in accordance with the sensing of the one or another character pitch indicia.

34. In the printer of claim 33 wherein each of said type character carrying members includes a timing mark associated with each character thereon and said character pitch defining indicia comprises one additional timing mark thereon for identifying one character pitch or two additional timing marks thereon for identifying another character pitch.

35. In the printer of claim 34, wherein said relationship generating means comprises counter means for generating a code dependent upon the sensing of said one additional timing mark or the sensing of said two additional timing marks on said type character carrying member.

36. In the printer of claim 33 wherein said means for sensing each of said characters and said means for sensing the one or another character pitch indicia are transducer elements adjacent said type character carrying member.

37. In the printer of claim 33 wherein said impact means comprises a plurality of hammers displaceable from one to another of said print columns along said line of printing.

38. In the printer of claim 37 wherein said time sharing means includes means for shifting said impact means from one print column to another.

39. In the printer of claim 38 including code means positionable to one or another position in accordance with the character pitch indicia sensed, said shifting means comprises electromagnetic means connected with said impact means and operated an amount in each instance defined by the position of said code means.

40. In the printer of claim 39 wherein said electromagnetic means comprises a voice coil.

41. In the printer of claim 33 wherein said relationship generating means comprises counter means for tracking the characters on said type character carrying member.

42. In the printer of claim 33 wherein said relationship means includes means for synchronizing the one or another character pitch indicia with the characters on said type character carrying member to provide a reference for tracking the characters on said type character carrying member.

43. In the printer of claim 33 wherein said relationship generating means includes means for generating a plurality of signals from the sensing of each character on said type character carrying member.

44. In the printer of claim 33 wherein said comparing means includes means for counting the number of comparisons of the input print data with said sensed characters.

45. In the printer of claim 33 wherein said time-sharing means include means for counting the number of shift positions of said printer in accordance with one or another character pitch indicia.

46. In a printer, means for printing characters in print columns at one or another character pitch, a plurality of removable type character carrying members, each having characters of one or another character pitch thereon, means on each of said type character carrying members identifying the pitch of the characters thereon, means sensing said identifying means for conditioning the printer for printing characters at said one or another character pitch, and impact means responsive to said sensing means for printing characters of the pitch identified.

47. Apparatus for printing characters at one or another character pitch comprising a plurality of removable type character carrying members, each having characters of one or another character pitch thereon, means identifying the pitch of the characters on each of said type character carrying members, and means responsive to said pitch identifying means for printing characters of the pitch identified.

48. A method of printing characters at one or another character pitch comprising the steps of providing a plurality of type character carrying members, each having one or another type character pitch defining indicia thereon, identifying the pitch defining indicia of the characters on a selected type carrying member, and enabling printing of characters at one or another pitch dependent upon the pitch defining indicia identified.

49. A printer for printing characters in print columns at one or another character pitch, comprising a plurality of removable type character carrying members for said printer, each of said type character carrying members defining characters of one or another pitch thereon, impact means comprising a plurality of elements each spanning more than one of said print columns, means for conditioning said impact means in accordance with the pitch of said characters, and means for actuating said impact means for printing characters in accordance with said conditioning means.

50. In a printer for printing characters in print columns along a line of printing at one or another character pitch dependent upon the type character carrying member on the printer, a plurality of type character carrying members, each having a plurality of characters thereon and having indicia defining one or another character pitch;

impact means adjacent said type character carrying member for impacting thereagainst, said impact means comprising a plurality of elements each spanning more than one of said print columns;

means for sensing each of said characters on said type character carrying member in successive manner;

means for sensing said one or another character pitch indicia;

means responsive to the sensing means for generating a relationship between the sensed characters and a first print column and between the sensed characters and all the print columns;

means for generating an impact means to print column relationship; and means enabling said impact means to be impacted against said characters on said type character carrying member in accordance with the sensing of one or another character pitch indicia.

* * * * *